US007242885B2

(12) United States Patent
Abe et al.

(10) Patent No.: US 7,242,885 B2
(45) Date of Patent: Jul. 10, 2007

(54) PROCESS CARTRIDGE AND IMAGE FORMING APPARATUS

(75) Inventors: Daisuke Abe, Shizuoka-ken (JP); Hideyuki Matsubara, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 315 days.

(21) Appl. No.: 11/091,781

(22) Filed: Mar. 29, 2005

(65) Prior Publication Data

US 2005/0226648 A1 Oct. 13, 2005

(30) Foreign Application Priority Data

Mar. 31, 2004 (JP) ..... 2004-105245

(51) Int. Cl.
*G03G 15/00* (2006.01)

(52) U.S. Cl. ..... 399/90; 399/111

(58) Field of Classification Search ..... 399/75, 399/90, 107, 110, 111
See application file for complete search history.

(56) References Cited

U.S. PATENT DOCUMENTS

| | | | | |
|---|---|---|---|---|
| 5,920,753 | A | 7/1999 | Sasaki et al. | 399/111 |
| 5,930,560 | A | 7/1999 | Sawaki | 399/111 |
| 6,185,390 | B1 * | 2/2001 | Higeta et al. | 399/90 |
| 6,334,035 | B1 | 12/2001 | Abe et al. | 399/106 |
| 6,377,759 | B1 | 4/2002 | Abe et al. | 399/27 |
| 6,463,225 | B1 | 10/2002 | Abe et al. | 399/27 |
| 6,473,585 | B2 | 10/2002 | Abe et al. | 399/254 |
| 6,505,008 | B2 | 1/2003 | Abe | 399/27 |
| 6,535,699 | B1 | 3/2003 | Abe et al. | 399/27 |

(Continued)

FOREIGN PATENT DOCUMENTS

| | | |
|---|---|---|
| JP | 62-215278 | 9/1987 |
| JP | 7-77921 | 3/1995 |
| JP | 9-68833 | 3/1997 |
| JP | 10-63166 | 3/1998 |
| JP | 2002-221889 | 8/2002 |
| SU | 373690 | 4/1971 |

OTHER PUBLICATIONS

Decision on Grant for Russian Appln. No. 2005109227, pp. 1-7.

*Primary Examiner*—Hoan Tran
(74) *Attorney, Agent, or Firm*—Fitzpatrick, Cella, Harper & Scinto

(57) ABSTRACT

A process cartridge detachably mountable to a main assembly of an image forming apparatus, wherein the main assembly includes a main assembly electrical contact, a movable member movable between a protecting position for covering the main assembly electrical contact and an exposing position for exposing the main assembly electrical contact, and a locking member movable between a locking position for limiting an operation of the movable member and a releasing position for permitting the operation of the movable member, the cartridge includes an electrophotographic photosensitive drum; process means actable on the drum; a first engaging portion for moving the locking member from the locking position to the releasing position in midstream of mounting the cartridge to the main assembly of the apparatus; a second engaging portion for moving the movable member from the protecting position to the exposing position in midstream of mounting the cartridge to the main assembly of the apparatus; and a cartridge contact for electrically connecting with the main assembly electrical contact when the cartridge is mounted to the main assembly of the apparatus.

22 Claims, 42 Drawing Sheets

U.S. PATENT DOCUMENTS

| | | | | |
|---|---|---|---|---|
| 6,560,423 | B2 | 5/2003 | Matsubara | 399/107 |
| 6,823,155 | B2 | 11/2004 | Tsuda et al. | 399/111 |
| 6,934,485 | B2 | 8/2005 | Miyabe et al. | 399/90 |
| 6,993,264 | B2 | 1/2006 | Oguma et al. | 399/90 |
| 6,999,696 | B2 * | 2/2006 | Noda et al. | 399/90 |
| 7,136,604 | B2 * | 11/2006 | Chadani et al. | 399/90 |
| 2005/0201773 | A1 | 9/2005 | Matsubara et al. | 399/90 |
| 2006/0029416 | A1 | 2/2006 | Oguma et al. | 399/90 |

* cited by examiner (a)

(b)

(a)

(b)

(a)

(b)

(a)

(b) Z DIRECTION (a)

(b) Z DIRECTION (a)

(b) Z DIRECTION (a)

(b) Z DIRECTION

PROCESS CARTRIDGE AND IMAGE FORMING APPARATUS

FIELD OF THE INVENTION AND RELATED ART

The present invention relates to a process cartridge and an electrophotographic image forming apparatus Here, an electrophotographic image forming apparatus means an apparatus for forming an image on recording medium with the use of one of the electrophotographic image forming methods. As for examples of an electrophotographic image forming apparatus, an electrophotographic copying machine, an electrophotographic printer (for example, LED printer, laser beam printer, etc.), an electrophotographic facsimileing machine, an electrophotographic wordprocessor, etc., are included.

Here, a process cartridge means a cartridge in which an electrophotographic photosensitive member, and at least one of the charging member and a developing member, as a processing means, are integrally disposed, and which is removably mountable in the main assembly of an electrophotographic image forming apparatus.

It also means a cartridge in which a charging means, a developing means or cleaning means, and an electrophotographic photosensitive member, are integrally disposed, and which is removably mountable in the main assembly of an electrophotographic image forming apparatus, a cartridge in which at least one among a charging means, a developing means, and a cleaning means, and an electrophotographic photosensitive member, are integrally disposed, and which is removably mountable in the main assembly of an electrophotographic image forming apparatus. Further, it means a cartridge in which at least a developing means, and an electrophotographic photosensitive member, are integrally disposed, and which is removably mountable in the main assembly of an electrophotographic image forming apparatus.

(1) An electrophotographic image forming apparatus employing a process cartridge system enables a user to mount a process cartridge into the apparatus main assembly, or dismount it therefrom, without relying on a service person, drastically improving an electrophotographic image forming apparatus in operability.

In order to form an image with the use of an electrophotographic image forming apparatus, it is necessary to apply voltage to the charging member to charge the electrophotographic photosensitive member (which hereinafter will be referred to as photosensitive drum) of a process cartridge, the developing member for developing an electrostatic latent image formed on the photosensitive drum, and the like.

For the above described purpose, that is, in order to establish electrical connection between a process cartridge and the main assembly of an electrophotographic image forming apparatus, the frame of a cartridge and the frame of the main assembly are provided with electrical contacts. Thus, as a cartridge is mounted into the main assembly, the electrical contacts of the cartridge come into contact with the electrical contacts of the main assembly, respectively, making it possible for the cartridge to be supplied with the voltage from the main assembly.

More concretely, the following structural arrangement has been known.

The main assembly of an electrophotographic image forming apparatus is provided with a movably protective plate for covering the electrodes (electrical contacts of main assembly), preventing thereby an operator and/or tools from coming into contact with the electrodes while maintaining a printer (image forming apparatus). The protective plate is retracted into its retreat, by the insertion of a cartridge into the apparatus main assembly, allowing thereby electrical connection to be established between the electrodes on the main assembly side and the electrodes (electrical contacts) of the cartridge (Japanese Laid-open Patent Application 7-77921: FIGS. 1-3).

Further, as the unit is removed from the apparatus main assembly, the connector pins (electrical contacts of apparatus main assembly) are retracted behind the partition wall, preventing thereby a service person or a user from contacting the connector pins, whereas, as the unit is removed from the apparatus main assembly, the connector pins are made to project into the cartridge compartment, into which the unit is mounted, allowing thereby electrical connection to be established between the connector pins and the connector portions (electrical contact on cartridge side) of the unit (Japanese Laid-open Patent Application 62-215278 (line 15 of bottom left section of page 4—line 15 of top left section of page 6).

The electrodes (electrical contact of main assembly) are enabled to move between their retreat positions and normal positions, enabling thereby the electrical contacts of the cartridge and the electrodes of the apparatus main assembly to properly contact each other. More specifically, the removal of the cartridge from the apparatus main assembly causes the electrodes (electrical contacts of apparatus main assembly) to retract into their retreats (prior to the insertion of the cartridge into the apparatus main assembly, the electrodes are in their retreats), whereas the insertion of the cartridge into the apparatus main assembly causes the electrodes to move back into the normal positions, allowing electrical connection to be established between the electrodes and electrical contacts (Japanese Laid-open Patent Application 9-68833).

(2) In recent years, various products employing a cartridge having a memory (storage element) in which various service and/or process data are stored have been realized. With the utilization of the data stored in the memory of the cartridge, an electrophotographic image forming apparatus has been further improved in maintenance. The utilization of the data is made possible by the electrical communication between the memory of a cartridge and the main assembly of an electrophotographic image forming apparatus, which is made possible by the electrical connection between the connectors of the cartridge and apparatus main assembly.

Even an electrophotographic image forming apparatus employing a process cartridge removably mountable in the main assembly of the electrophotographic image forming apparatus sometimes suffers from the problem that recording medium such as recording paper becomes stuck in the main assembly. If this problem occurs, a user takes the process cartridge out of the apparatus main assembly, and removes the stuck recording paper. Then, the user reinserts the process cartridge. If the removed process cartridge has static electricity, it is possible that as the process cartridge is reinserted into the apparatus main assembly, electrical discharge occurs between the process cartridge and the exposed electrical contacts in the apparatus main assembly. Thus, in order to prevent the problem that this kind of electrical charge will generate electrostatic noises in the electrical circuit in the image forming apparatus, some image forming apparatuses are provided with a static electricity discharging member (Japanese Laid-open Patent Application 10-63166).

SUMMARY OF THE INVENTION

The present invention is one of the further developments of the above described prior art.

The primary object of the present invention is to provide a process cartridge and an electrophotographic image forming apparatus, superior to those in accordance with the prior art, in terms of the reliability in the electrical connection which occurs between the electrical contacts of the process cartridge(s) and the electrical contacts of the main assembly of the electrophotographic image forming apparatus as the process cartridge(s) is mounted into the main assembly of the electrophotographic image forming apparatus.

Another object of the present invention is to provide a process cartridge and an electrophotographic image forming apparatus, which are structured so that as the process cartridge is inserted into the main assembly of the electrophotographic image forming apparatus, the member with which the main assembly of the electrophotographic image forming apparatus is provided to protect the electrical contacts of the main assembly is moved from the position in which it protects the electrical contacts of the main assembly, to the position in which it exposes them.

Another object of the present invention is to provide an electrophotographic image forming apparatus which employs a process cartridge(s) removably mountable in the main assembly of the electrophotographic image forming apparatus, and in which when the process cartridge(s) is mounted into the electrophotographic image forming apparatus main assembly, static electricity discharge does not occur between the electrical contacts of the process cartridge and the electrical contacts of the apparatus main assembly.

Another object of the present invention is to provide an electrophotographic image forming apparatus, the electrical circuit of the main assembly of which is not subject to damage.

Another object of the present invention is to provide an electrophotographic image forming apparatus superior to that in accordance with the prior art, in terms of the reliability in the electrical connection which occurs between the electrical contacts of a process cartridge(s) and the electrical contacts of the main assembly of the electrophotographic image forming apparatus as the process cartridge(s) is mounted into the main assembly of the electrophotographic image forming apparatus.

According to an aspect of the present invention, there is provided a process cartridge detachably mountable to a main assembly of an electrophotographic image forming apparatus, wherein said main assembly includes a main assembly electrical contact, a movable member movable between a protecting position for covering the main assembly electrical contact and an exposing position for exposing the main assembly electrical contact, and a locking member movable between a locking position for limiting an operation of the movable member and a releasing position for permitting the operation of the movable member, said process cartridge comprising: an electrophotographic photosensitive drum; process means actable on said electrophotographic photosensitive drum; a first engaging portion for moving the locking member from the locking position to the releasing position in midstream of mounting said process cartridge to the main assembly of the apparatus; a second engaging portion for moving the movable member from the protecting position to the exposing position in midstream of mounting said process cartridge to the main assembly of the apparatus; and a cartridge contact for electrically connecting with the main assembly electrical contact when said process cartridge is mounted to the main assembly of the apparatus.

According to another aspect of the present invention, there is provided an electrophotographic image forming apparatus for forming an image on a recording material, to which a process cartridge is detachably mountable, said apparatus comprising: (a) a main assembly electrical contact; (b) a movable member movable between a protecting position for covering the main assembly electrical contact and an exposing position for exposing the main assembly electrical contact; (c) a locking member movable between a locking position for limiting an operation of the movable member and a releasing position for permitting the operation of the movable member; (d) a mounting member for detachably mounting said process cartridge, said process cartridge including, an electrophotographic photosensitive drum, process means actable on said electrophotographic photosensitive drum, a first engaging portion for moving the locking member from the locking position to the releasing position in midstream of mounting said process cartridge to the main assembly of the apparatus, a second engaging portion for moving the movable member from the protecting position to the exposing position in midstream of mounting said process cartridge to the main assembly of the apparatus, and a cartridge contact for electrically connecting with the main assembly electrical contact when said process cartridge is mounted to the main assembly of the apparatus; (e) feeding means for feeding said recording material.

According to a further aspect of the present invention, there is provided a process cartridge detachably mountable to a main assembly of an electrophotographic image forming apparatus, wherein said main assembly includes a main assembly electrical contact, an electroconductive member movable between a first position for electrically connecting with a ground and a second position for electrically disconnecting with the ground, and a locking member movable between a locking position for limiting an operation of said electroconductive member and a releasing position for permitting the operation of said electroconductive member, said process cartridge comprising: an electrophotographic photosensitive drum; process means actable on said electrophotographic photosensitive drum; a first engaging portion for moving the locking member from the locking position to the releasing position in midstream of mounting said process cartridge to the main assembly of the apparatus; a second engaging portion for moving the movable member from the protecting position to the exposing position in midstream of mounting said process cartridge to the main assembly of the apparatus; and a cartridge contact for electrically connecting with the main assembly electrical contact when said process cartridge is mounted to the main assembly of the apparatus.

According to a further aspect of the present invention, there is provided an electrophotographic image forming apparatus for forming an image on a recording material, to which a process cartridge is detachably mountable, said apparatus comprising: (a) (a) a main assembly electrical contact; (b) an electroconductive member movable between a first position for electrically connecting with a ground and a second position for electrically disconnecting with the ground, (c) a locking member movable between a locking position for limiting an operation of the movable member and a releasing position for permitting the operation of the movable member; (d) a mounting member for detachably mounting said process cartridge, said process cartridge including, an electrophotographic photosensitive drum; process means actable on said electrophotographic photosensitive drum; a first engaging portion for moving the locking member from the locking position to the releasing position in midstream of mounting said process cartridge to the main assembly of the apparatus, a second engaging portion for moving the movable member from the protecting position to the exposing position in midstream of mounting said process cartridge to the main assembly of the apparatus; and a cartridge contact for electrically connecting with the main assembly electrical contact when said process cartridge is mounted to the main assembly of the apparatus; (e) feeding means for feeding said recording material.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the process cartridge, image forming apparatus, and electrical contact protection mechanism, in accordance with the present invention, will be described in detail with reference to the appended drawings.

Embodiment 1

(1) General Description of Process Cartridge

Figure 1:
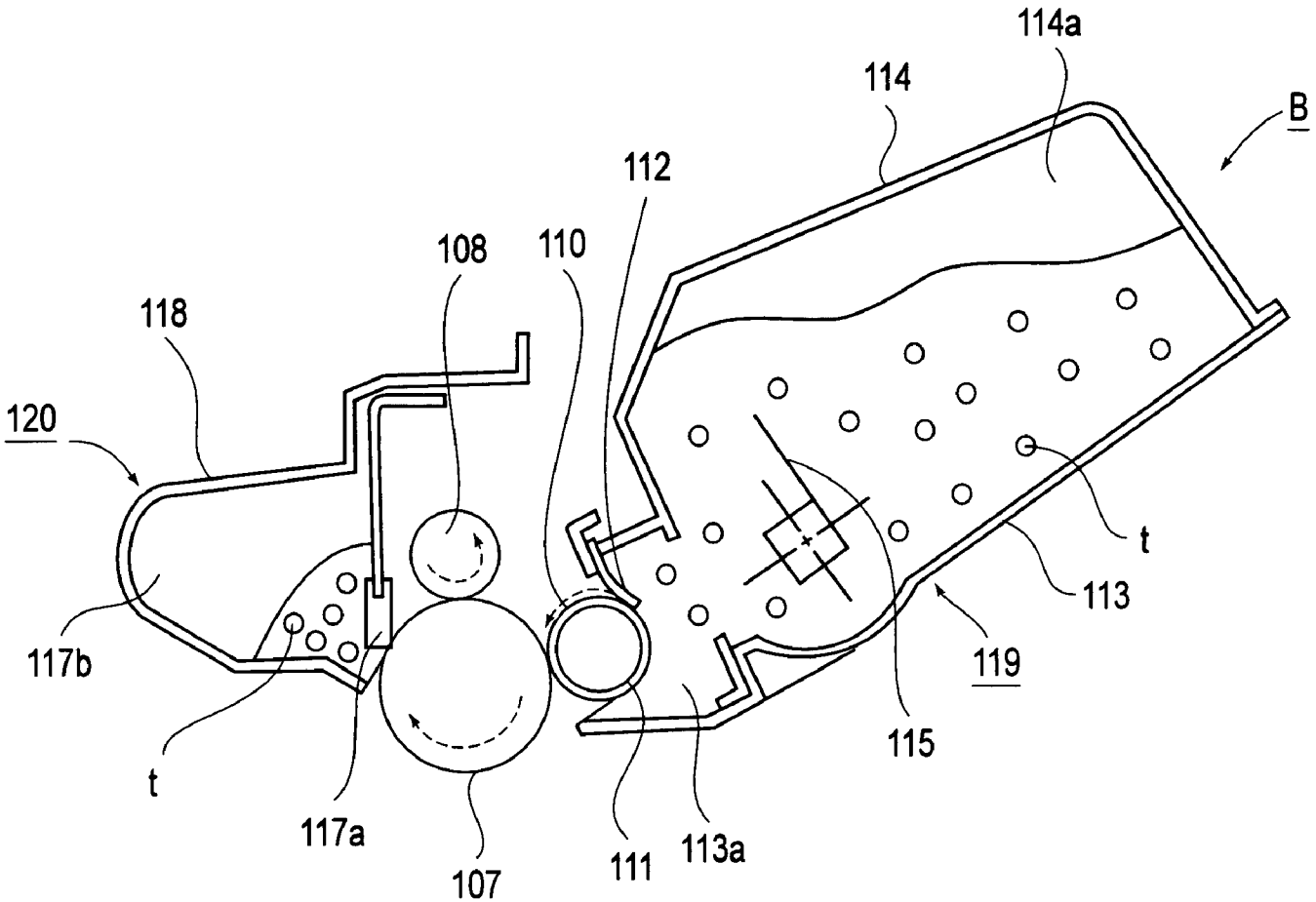
FIG. 1 is a sectional view of the process cartridge in the first embodiment of the present invention.

First, referring to FIG. 1, the process cartridge B (which hereinafter will be referred to simply as cartridge) in the first embodiment of the present invention will be described. FIG. 1 is a sectional view of the cartridge B.

Figure 2:
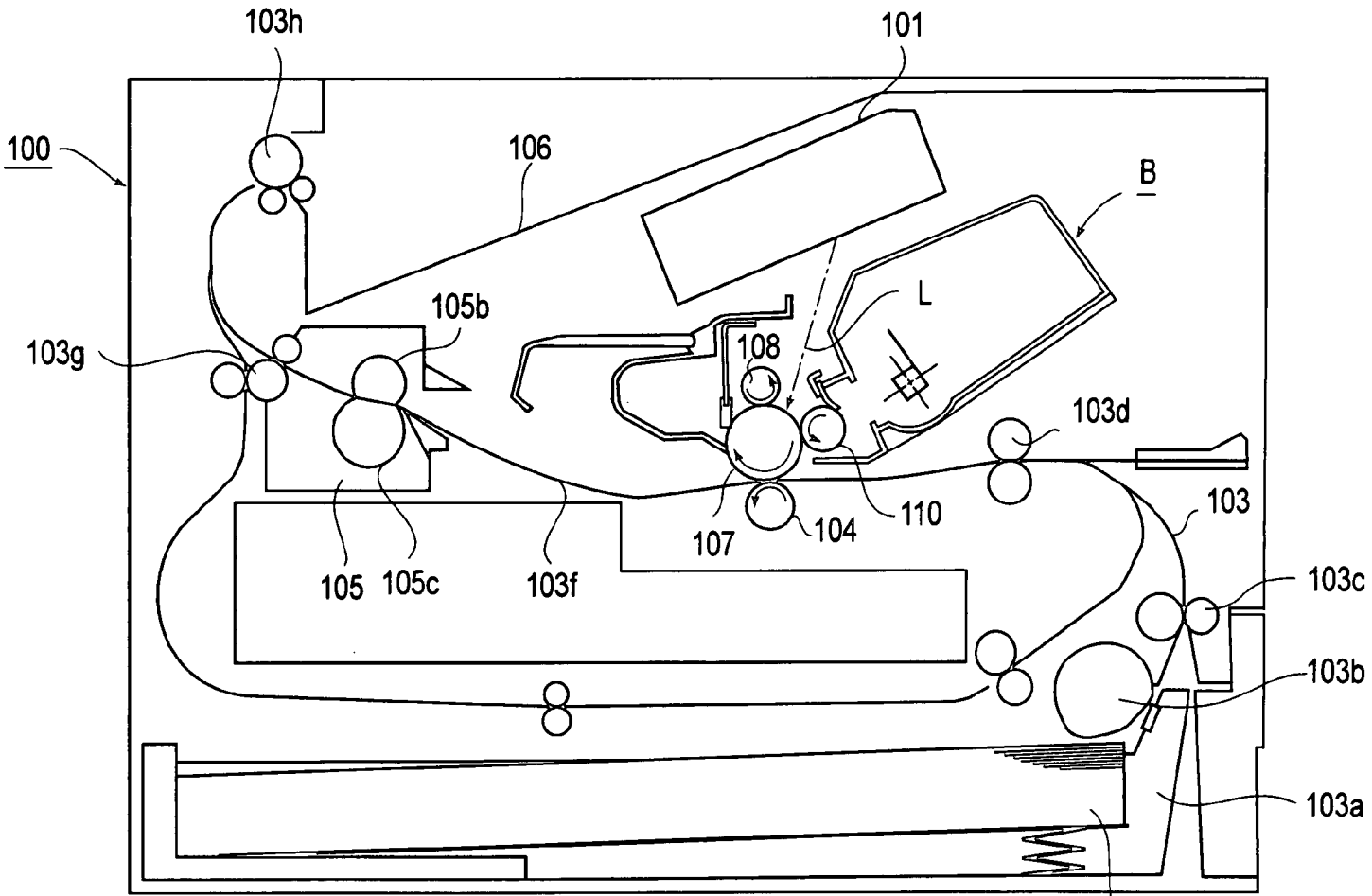
FIG. 2 is a schematic drawing of the image forming apparatus in the first embodiment, showing the general structure thereof.

Referring to FIG. 1, the cartridge B has an electrophotographic photosensitive drum 107 (which hereinafter will be referred to simply as photosensitive drum). With the cartridge B mounted in the electrophotographic image forming apparatus A (which hereinafter will be referred to simply as apparatus main assembly) as shown in FIG. 2, the photosensitive drum 107 rotates as it receives driving force from the apparatus main assembly A.

The apparatus main assembly A is provided with a charge roller 108 as a charging member, which is disposed in the immediate adjacencies of the peripheral surface of the photosensitive drum 107. To the charge roller 108, voltage is applied from the apparatus main assembly A to charge the photosensitive drum 107. The charge roller 108 is kept in contact with the peripheral surface of the photosensitive drum 107, and is rotated by the rotation of the photosensitive drum 107.

With the cartridge B mounted in the apparatus main assembly A, the charge roller 108 receives voltage from the apparatus main assembly A, and as it receives the voltage, it charges the photosensitive drum 107.

The cartridge B is provided with a development roller 110 as a developing member for supplying the portion of the peripheral surface of the photosensitive drum 107, in the development range, with developer t. The development roller 110 develops an electrostatic latent image formed on the photosensitive drum 107 with the use of the developer t. It internally holds a magnetic roller (stationary magnet).

Figure 11:
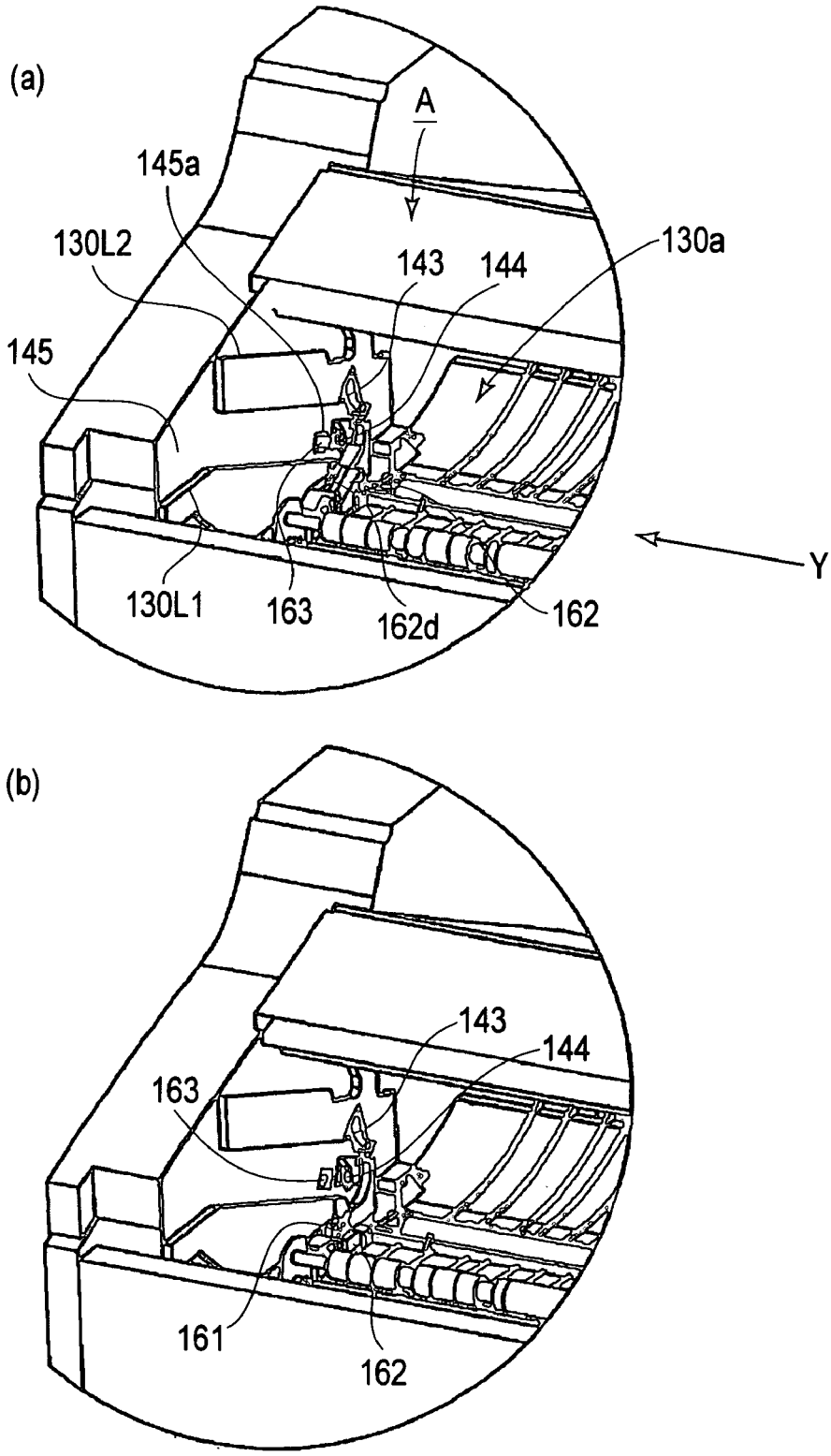
FIG. 11 is a perspective view of the electrical contact protection mechanism of the image forming apparatus main assembly, showing the structures thereof (No. 1).

With the cartridge B mounted in the apparatus main assembly A, the development roller 110 receives voltage from the apparatus main assembly A through a development bias transmission electrical contact 161 (FIG. 11(*b*)) as one of the electrical contacts on the main assembly side, and a development bias reception electrical contact 160 (FIG. 8) as one of the electrical contacts on the cartridge side. As the development roller 110 receives this voltage, it develops the aforementioned electrostatic latent image.

The apparatus main assembly A is provided with a development blade 112, which is disposed in the adjacencies of the peripheral surface of the development roller 110, being disposed in contact with the peripheral surface of the development roller 110. The development blade 112 regulates the amount by which the developer t having adhered to the peripheral surface of the development roller 110 is allowed to be conveyed to the aforementioned development area. It also frictionally charges the developer t.

The developer t stored in a developer storage portion 114*a* is sent out by the rotation of a stirring member 115 to a development chamber 113*a*. Meanwhile, the development roller 110 receiving the aforementioned voltage through the electrical contacts 160 rotates by receiving driving force from the apparatus main assembly A. As a result, a layer of developer t having been frictionally charged by the development blade is formed on the peripheral surface of the development roller 110. Then, the developer t on the peripheral surface of the development roller 110 is transferred onto the peripheral surface of the photosensitive drum 107 in the pattern of the latent image; in other words, the latent image is developed into an image formed of the developer t (which hereinafter will be referred to simply as developer image).

The developer image formed on the photosensitive drum 107 is transferred by a transfer roller 104 (FIG. 2) onto a recording medium 102.

The apparatus main assembly A is also provided with an elastic cleaning blade 117*a*, which is disposed in the adjacencies of the peripheral surface of the photosensitive drum 107, with its free edges disposed in contact with the peripheral surface of the photosensitive drum 107. The cleaning blade 117*a* removes the developer t remaining on the peripheral surface of the photosensitive drum 107 after the transfer of the developer image onto the recording medium 102. After being removed from the peripheral surface of the photosensitive drum 107 by the cleaning blade 117*a*, the removed developer t is stored in a bin 117*b* for the removed developer t.

The cartridge B comprises a development unit 119 and a drum unit 20 integrally connected to each other.

The development unit 119 comprises a top frame 114 which constitutes a part of the cartridge frame, and a bottom frame 113 which also constitutes a part of the cartridge frame. The development unit 119 has the development roller 110, development blade 112, development chamber 113*a*, developer storage chamber 114*a*, and stirring member 115. It is also provided with the aforementioned development bias reception electrical contact, which will be described later.

The drum unit 120 comprises a drum frame 118, which also constitutes a part of the cartridge frame. It has the photosensitive drum 107, cleaning blade 117*a*, bin 117*b* for removed developer, and charge roller 108.

Figure 6:
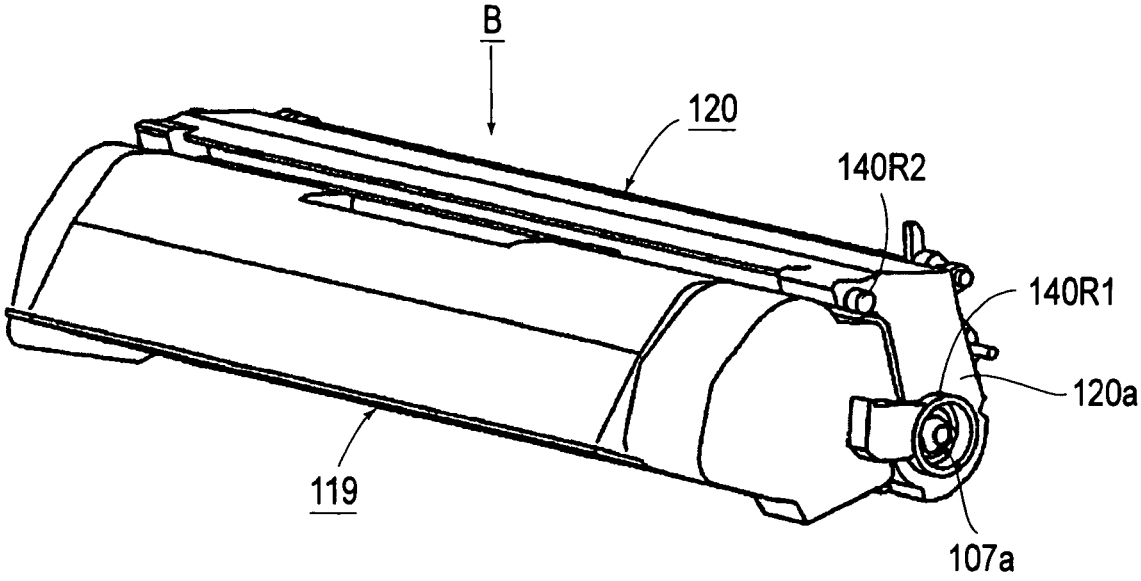
FIG. 6 is a perspective view of the process cartridge (No. 1).
Figure 7:
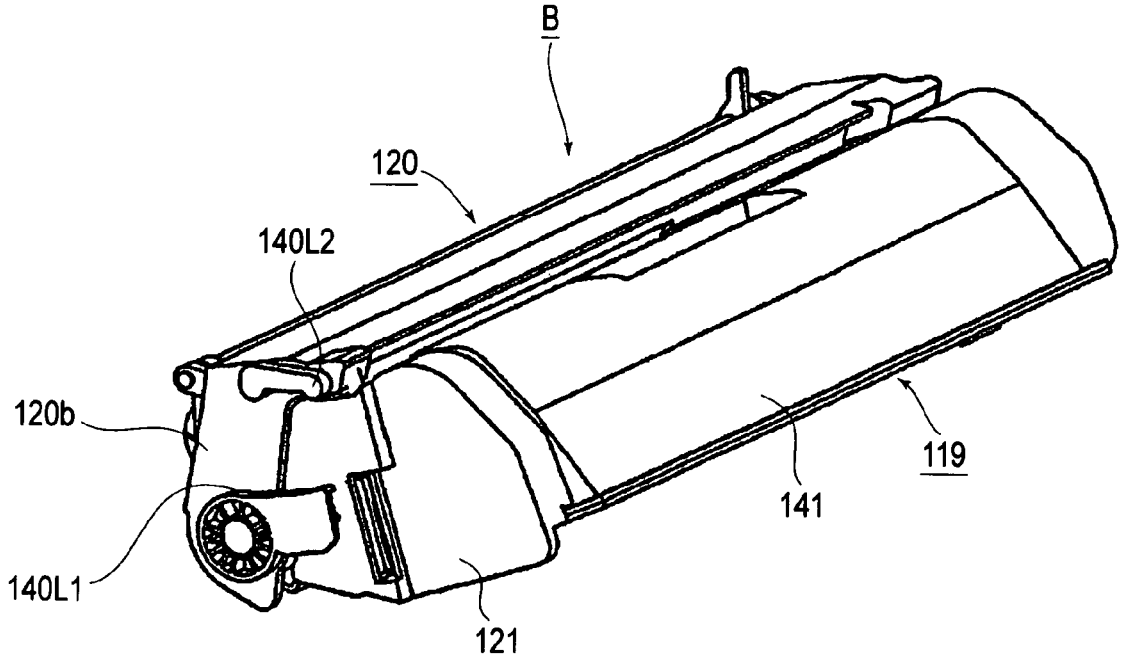
FIG. 7 is a perspective view of the process cartridge (No. 2).

As will be evident from FIG. 6, the drum unit 120 is provided with a cartridge guide 140R1 and a cartridge guide 140R2, which are located at the lengthwise end 120*a* of the drum unit 120. Referring to FIG. 7, the other lengthwise end 120*a* of the drum unit 120 is provided with a cartridge guide 140L1 and a cartridge guide 140L2.

The development unit 119 and drum unit 120 are connected to each other so that they can be pivoted relative to each other, and also, so that the development roller 110 is kept pressed upon the photosensitive drum 107.

(2) Description of Electrophotographic Image Forming Apparatus

Next, referring to FIG. 2, the electrophotographic image forming apparatus 100 comprising the above described apparatus main assembly A and cartridge B will be described. FIG. 2 is a schematic drawing of the electrophotographic image forming apparatus 100 (which hereinafter will be referred to simply as image forming apparatus), depicting the general structure thereof. In the following description of the image forming apparatus 100, the image forming apparatus 100 will be described as a laser beam printer.

As the image forming operation of the image forming apparatus 100 begins, the peripheral surface of the rotating photosensitive drum 107 is uniformly charged by the charge roller 108. Next, a beam of laser light L is projected onto the peripheral surface of the photosensitive drum 107, while being modulated by image formation data, from an optical means 101 comprising a laser diode, a polygon mirror, a lens, and a deflection mirror (none of which are shown). As a result, an electrostatic latent image reflecting the image formation data is formed on the peripheral surface of the photosensitive drum 107. This latent image is developed by the abovementioned development roller 110.

Meanwhile, in synchronism with the progression of the developer image formation, the recording medium 102 stored in a cassette 103*a* is sent out of the cassette 103*a*, into the apparatus main assembly A by a feeding roller 103*b*, and is conveyed to the transfer location by a pair of conveyance rollers 103*c* and a pair of conveyance rollers 103*d*.

At the transfer location, a transfer roller 104 as a transferring means is disposed. As voltage is applied to the transfer roller 104, the developer image on the photosensitive drum 107 is transferred onto the recording medium 102.

After the transfer of the developer image onto the recording medium 102, the recording medium 102 is guided by the guide 103*f* to a fixing means 105, which comprises a driver roller 105*c* and a fixation roller 105*b*. The fixation roller 105*b* internally holds an unshown heater. As the recording medium 102 is conveyed through the fixing means 105, heat and pressure are applied to the recording medium 102. As a result, the developer image is permanently fixed to the recording medium 102. Thereafter, the recording medium 102 is further conveyed, and is discharged into a delivery tray 106, by a pair of conveyance rollers 103*g* and a pair of conveyance rollers 103*h*. The abovementioned roller 103*b*, pairs of conveyer rollers 103*c* and 103*d*, guide 103*f*, and pairs of rollers 103*g* and 103*h*, etc., constitute a conveying means 103 for conveying the recording medium 102.

The cartridge B is mounted into, or dismounted from, the apparatus main assembly A, as will be described next.

Figure 3:
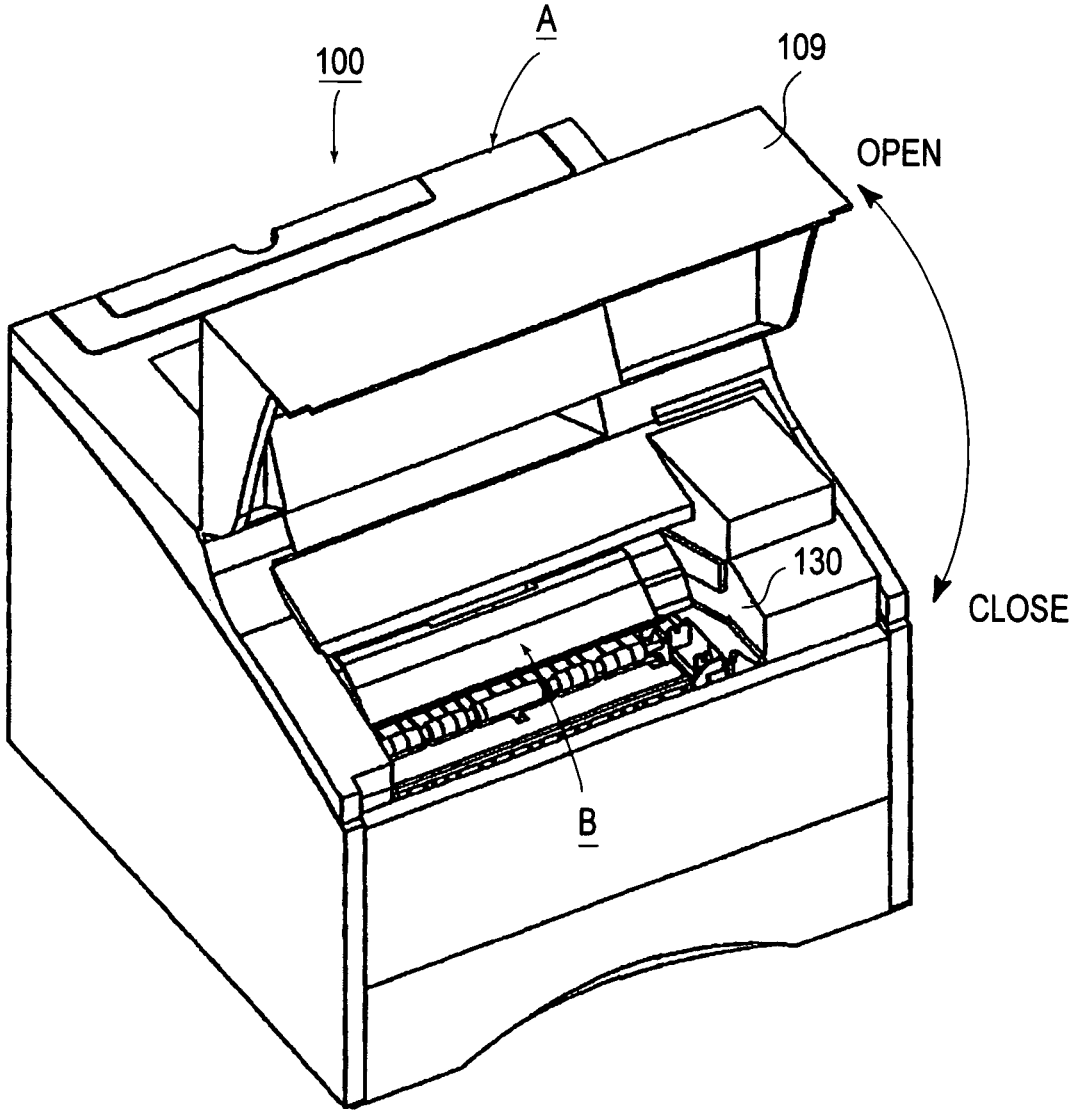
FIG. 3 is a perspective view of the image forming apparatus.

Referring to FIG. 3, first, a door 109 of the apparatus main assembly A is to be opened by an operator in order to allow the cartridge B to be removably mounted into the cartridge mounting means 130 of the apparatus main assembly A.

Figure 4:
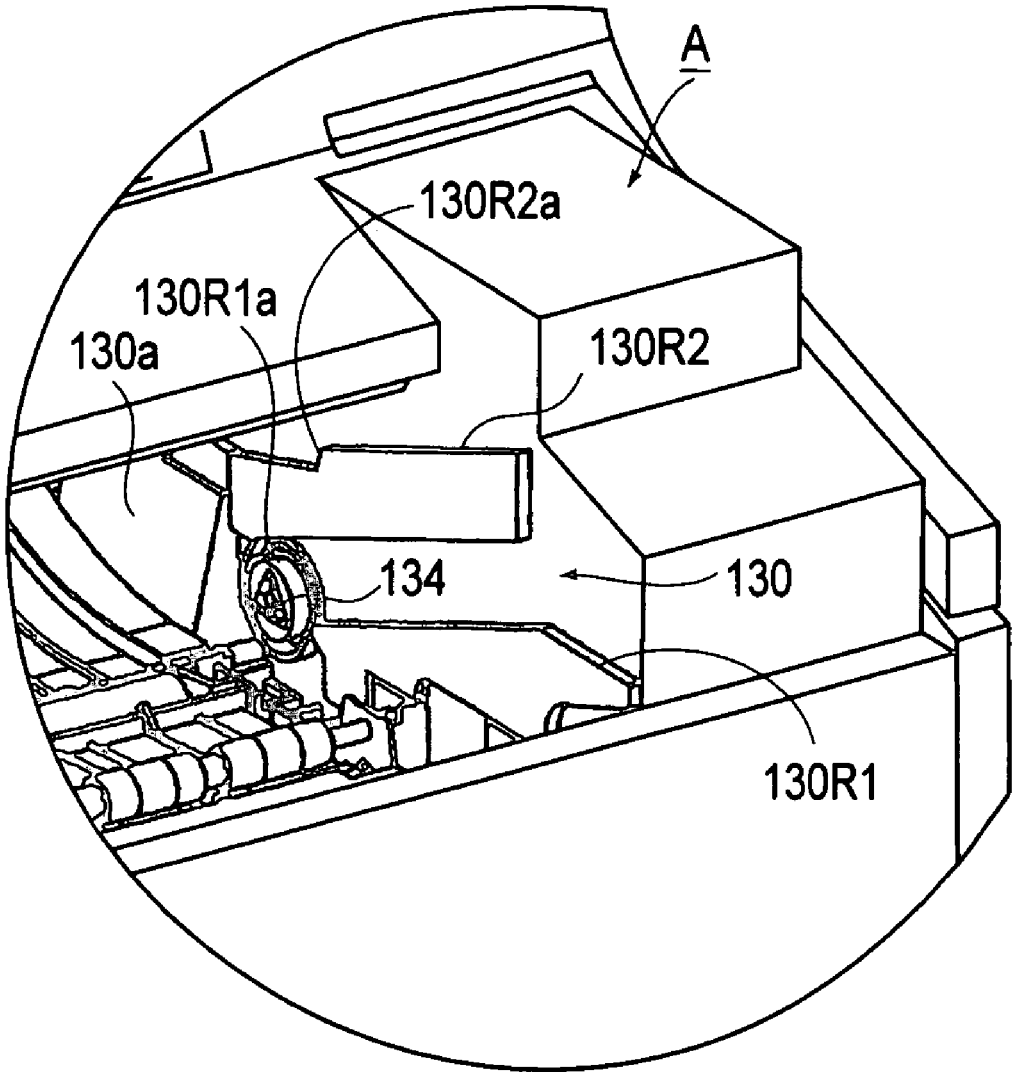
FIG. 4 is a drawing of the process cartridge compartment of the main assembly of the image forming apparatus, and its adjacencies (No. 1).
Figure 5:
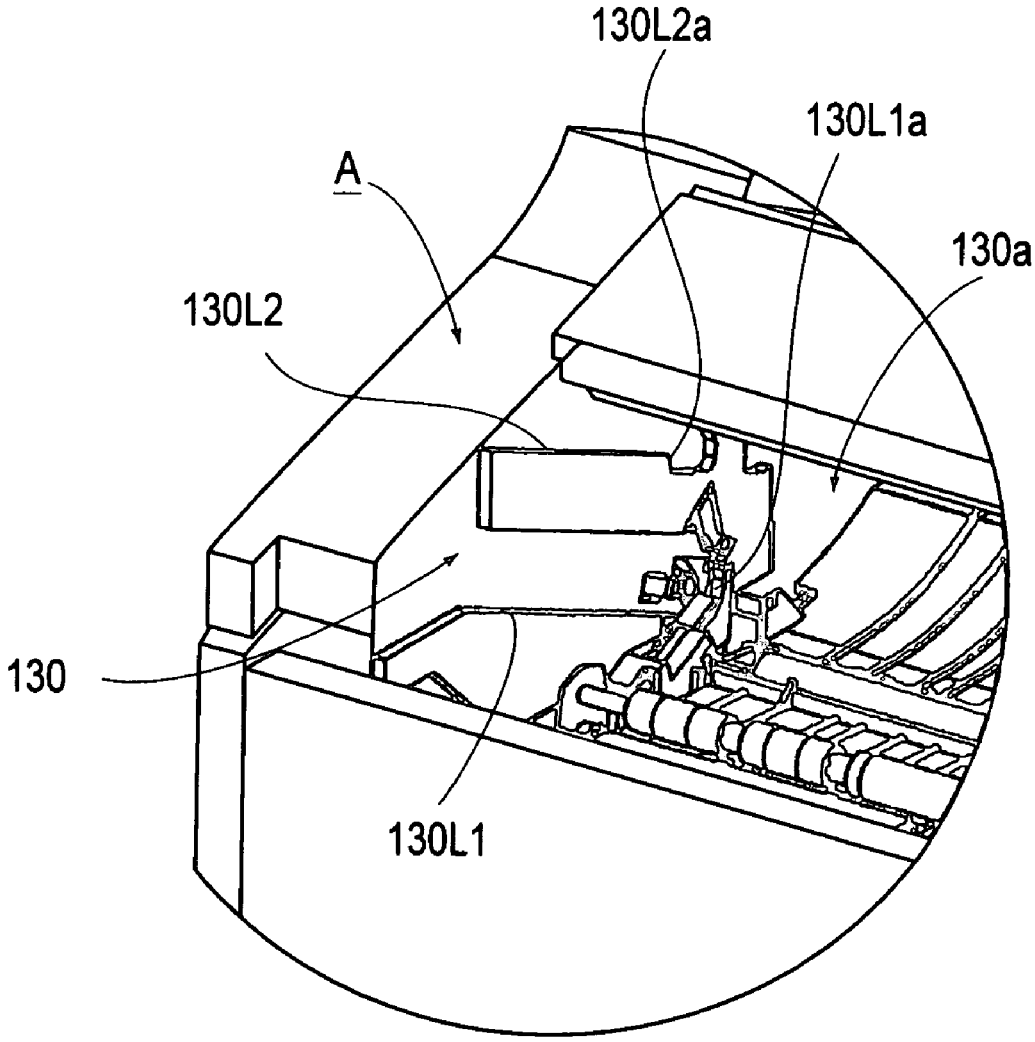
FIG. 5 is a drawing of the process cartridge compartment of the main assembly of the image forming apparatus, and its adjacencies (No. 2).

Referring to FIGS. 4 and 5, the cartridge mounting means 130 in this embodiment comprises guides 130R1, 130R2, 130L1, and 130L2, which are parts of apparatus main assembly A. As for the method for mounting the cartridge B into the apparatus main assembly A, the cartridge B is to be inserted into the apparatus main assembly A, into the cartridge compartment 130*a*, that is, the internal space of the apparatus main assembly A for the cartridge B, so that the cartridge guides 140R1 and 140R2 (FIG. 6) as the cartridge guide portions of the cartridge B are engaged with the guides 130R1 and 130R2, respectively, of the apparatus main assembly A, and the cartridge guides 140L1 and 140L2 of the cartridge B are engaged with the cartridge guides 130L1 and 130L2, respectively, of the apparatus main assembly A.

As the cartridge B is inserted, the cartridge guide 140R1 fits into the positioning portion 13OR1*a* of the guide 130R1 of the apparatus main assembly A, and the cartridge guide 140R2 fits into the positioning portion 130R2*a* of the guide 130R2 of the apparatus main assembly A. Further, the cartridge guides 140L1 and 140L2 fit into the positioning portions 130L1*a* and 130L2*a* of the cartridge guides 130L1 and 130L2 of the apparatus main assembly, respectively. As a result, the cartridge B is removably mounted into the cartridge compartment 130*a* by the cartridge mounting means 130, being thereby readied for image forming operation.

While the cartridge B is mounted into the apparatus main assembly A, a coupling 134 (FIG. 3) as a driving force transmitting portion remains retracted, and therefore, does not interfere with the mounting of the cartridge B. Then, as the cover 109 is closed, the coupling 107*a* (FIG. 6), as a driving force receiving portion, of the cartridge B engages with the abovementioned coupling 134 on the main assembly A side, making it possible for the cartridge B to receive from the apparatus main assembly A the force for driving the photosensitive drum 107.

(3) Electrical Contact Protection Mechanism of Process Cartridge

Next, the electrical contact protection mechanism on the process cartridge side, in accordance with the present invention, will be described.

Figure 8:
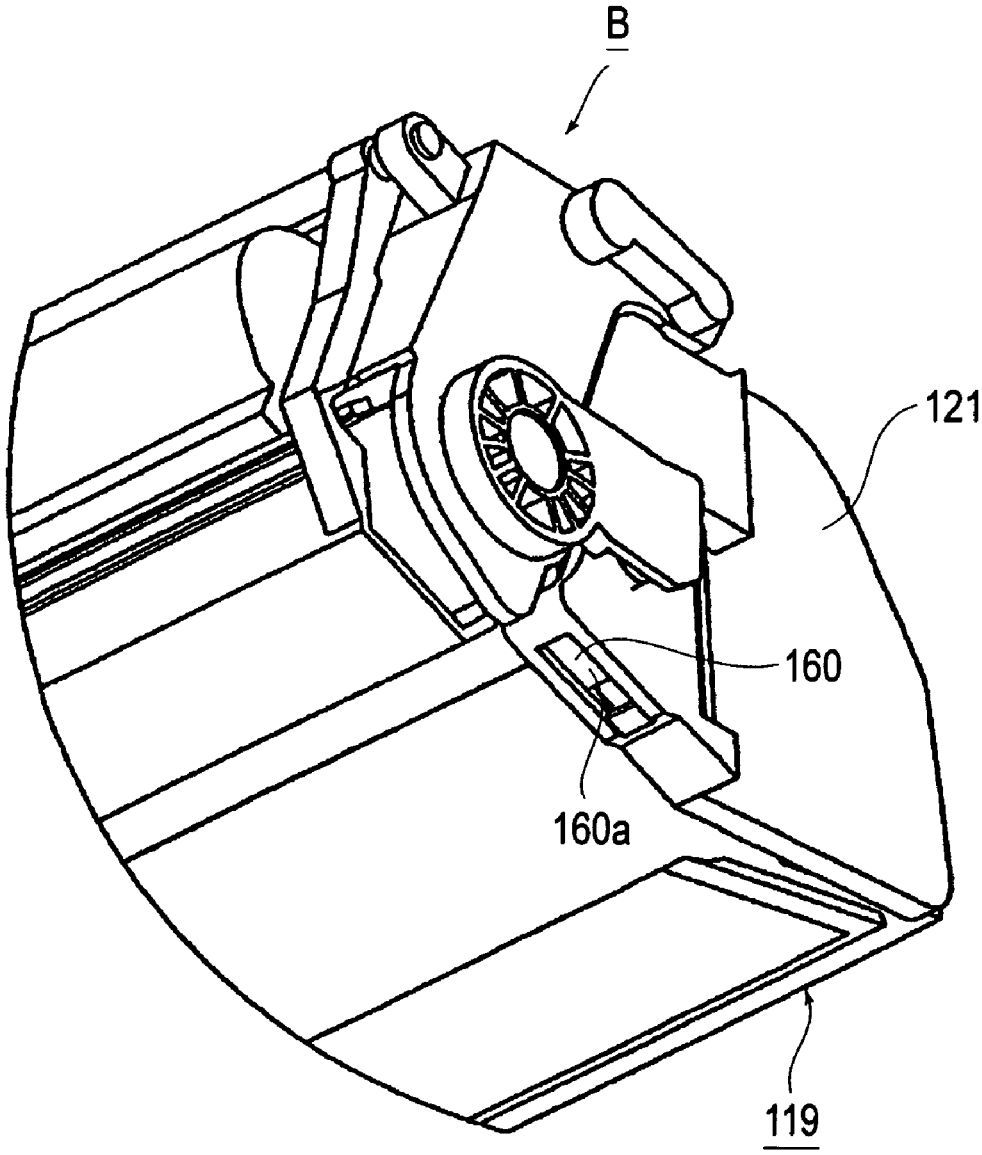
FIG. 8 is a drawing showing the positioning of the various components of the electrical contact protection mechanism of the process cartridge.

FIG. 8 is a perspective view of one of the lengthwise ends of the cartridge B, showing the positioning of the development bias reception electrical contact thereof. The development bias reception electrical contact 160, that is, one of the electrical contacts on the cartridge side, is attached to a part of the end cover 121 of the development unit 119. It has a contact portion 160*a*, by which it contacts the counterpart of the apparatus main assembly A.

Figure 9:
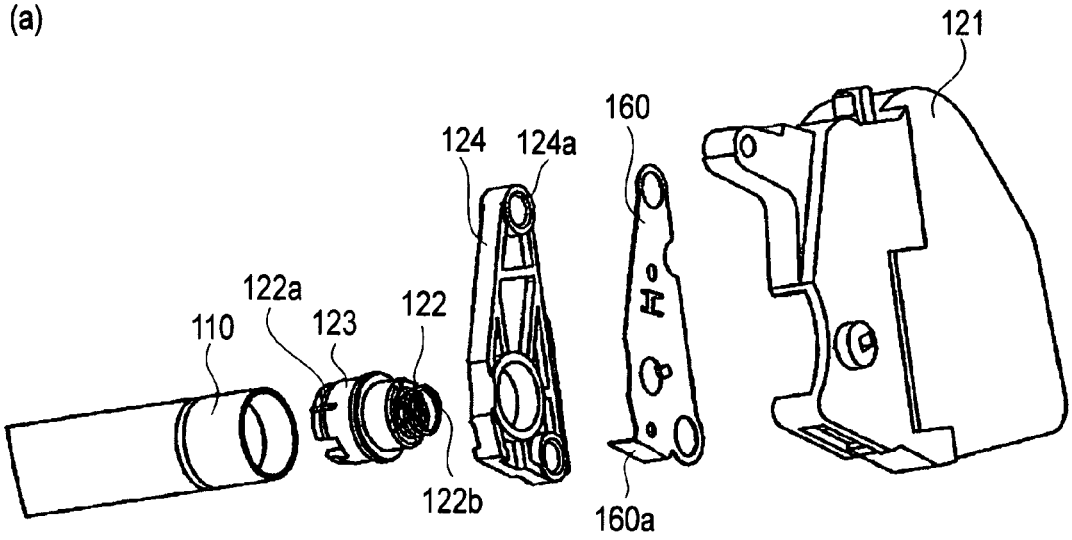
FIG. 9 is an exploded view of the electrical contact protection mechanism of the process cartridge, and the components related thereto, showing the structures thereof.
Figure 9:
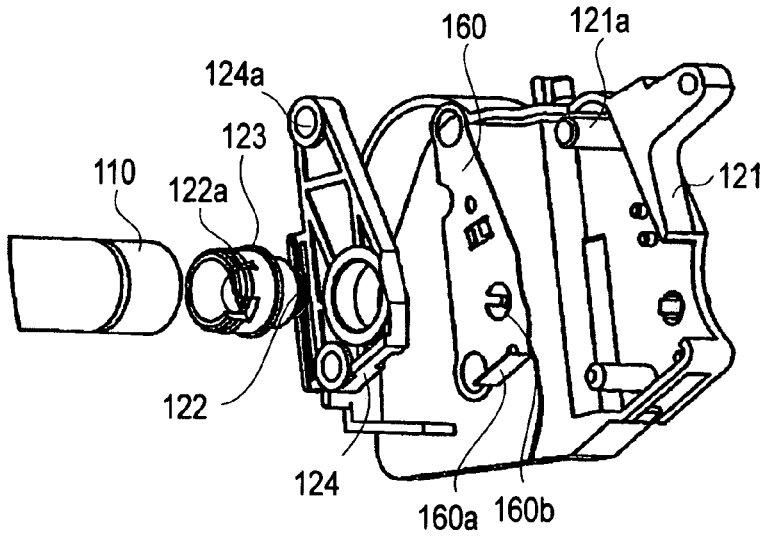

FIG. 9 is an exploded drawing of the electrical contact protection mechanism of the cartridge B, and the components related thereto, showing the structures thereof through which development bias is applied to the development roller 110. Referring to FIG. 9(*a*), the development unit 119 is provided with a developer roller spring 122 and a flange 123. The developer roller spring 122 is fixed to the flange 123, and the flange 123 is attached to one of the lengthwise ends of the development roller 110 by pressing or the like means, with one end 122*a* of the development roller spring 122 held between the internal surface of the development roller 110 and flange 123, establishing thereby electrical connection between the development roller 110 and development roller spring 122. The flange 123 is rotatably supported by a bearing 124. As will be evident from FIG. 9(*b*), the development bias reception electrical contact 160 is fixed to the end cover 121. Further, the shaft 121*a* of the end cover 121 is fitted in the hole 124*a* of the bearing member 124; in other words, the end cover 121 is supported by the bearing member 124 to support the development roller 110. After the bearing member 124 and development bias reception electrical contact 160 are sandwiched between the top frame 114 (FIG. 7) and end cover 121, the end cover 121 is fixed to the top frame 114 with fixing means such as small screws.

With the end cover 121 fixed to the top frame 114, the end portion 122*b* of the development roller spring 122 (coil spring), that is, the end opposite to the end portion 122*a* of the development roller spring 122, is in contact with the contact portion 160*b* (FIG. 9(*b*)) of the development bias reception electrical contact 160*a* fixed to the cover 121, establishing electrical connection between the two. Because of the resiliency of the coil spring, a predetermined amount of contact pressure is maintained between the development roller spring 122 and development bias reception electrical contact 160. With the provision of the above described structural arrangement, electrical connection is maintained between the development bias reception electrical contact 160 and development roller 110.

Next, the engaging portion and retaining portion of the cartridge B will be described. The engaging portion and retaining portion of the cartridge B function as actuators for the retaining member of the apparatus main assembly and the movable member of the apparatus main assembly A, respectively.

Figure 10:
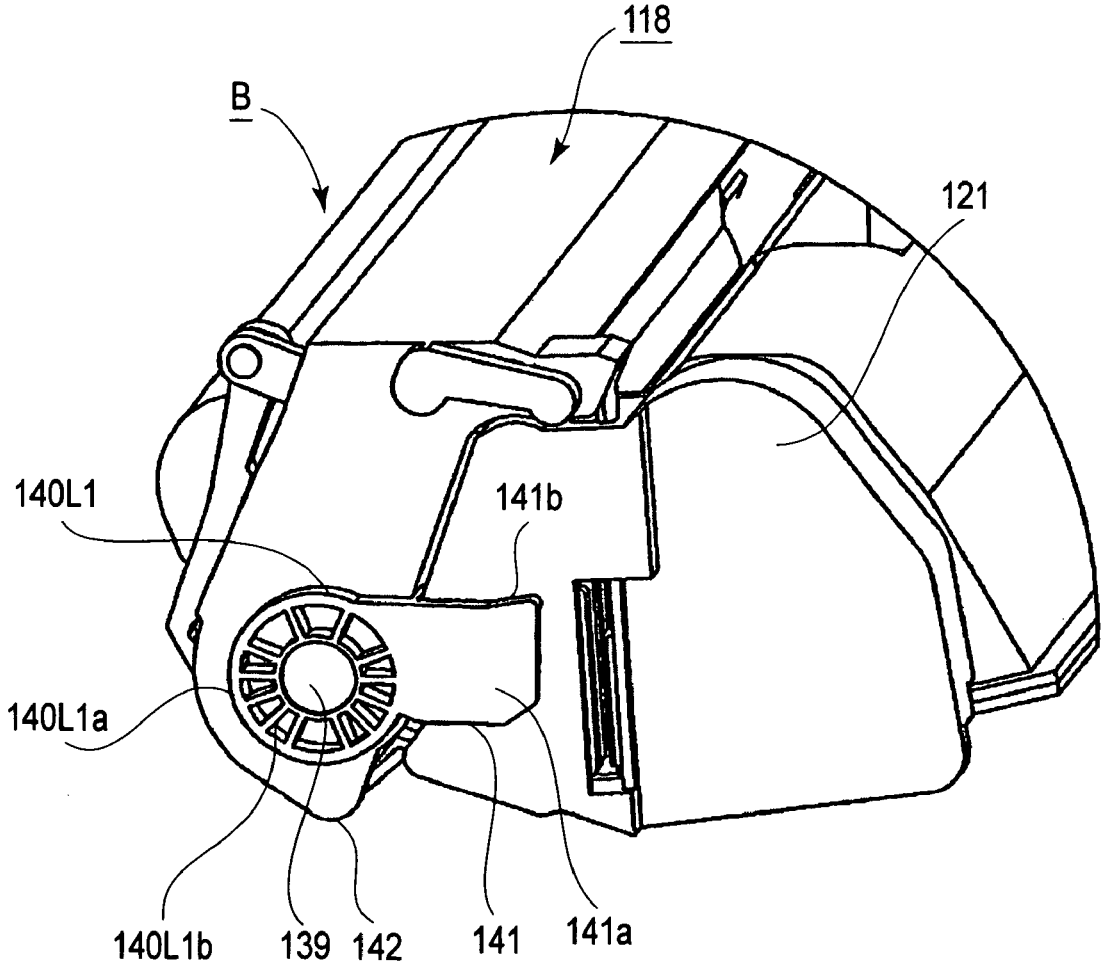
FIG. 10 is a perspective view of one of the lengthwise end portions of the process cartridge.

FIG. 10 is a perspective view of the cartridge B. The drum frame 118 holds the photosensitive drum 107, charge roller 108, cleaning blade 117*a*, etc., which were integrally disposed therein. One end of the photosensitive drum 107 is rotatably supported by a drum shaft 130. The drum shaft 130 is rotatably fitted in the center hole of the cartridge guide 140L1, by which the cartridge B is supported by the counterpart on the apparatus main assembly A when the cartridge B is mounted into the apparatus main assembly A. The contact portion 140L1*a*, as a first engaging portion, which is a part of the cartridge guide 140L1, has the function of engaging with the movable member of the apparatus main assembly A. The cartridge guide L1 is provided with a plurality of radial ribs 140L1*b*, which extend from the edge of the center hole of the cartridge guide 140L1 toward the peripheral edge of the cartridge guide 140L1. The cartridge guide L1 is also provided with an extension 141, which extends from the peripheral edge portion of the cartridge guide 104L1 toward the end cover 121. The outward primary surface of the extension 141 functions as contact area 141*a* as a first retaining portion for holding the retaining member in the release position. In other words, the first retaining portion for holding the retaining member movable between the releasing position in which the retaining member does not retains the movable member, and the retaining position in which it retains the movable member, is located at one of the lengthwise ends of the process cartridge. The top surface of the extension 141 functions as a portion 141*b* for regulating the attitudes of the cartridge B when cartridge B is mounted into the apparatus main assembly A. Further, the drum frame 118 is provided with a projection 142, which projects downward. The projection 142 functions as a second engaging portion of the process cartridge, which engages with the movable member of the apparatus main assembly A, which will be described later, and also, as a second retaining portion for retaining the moving member in the exposing portion.

(4) Electrical Contact Protection Mechanism on Apparatus Main Assembly Side

Next, the structure of the electrophotographic image forming apparatus in accordance with the present invention will be described in detail.

Figure 12:
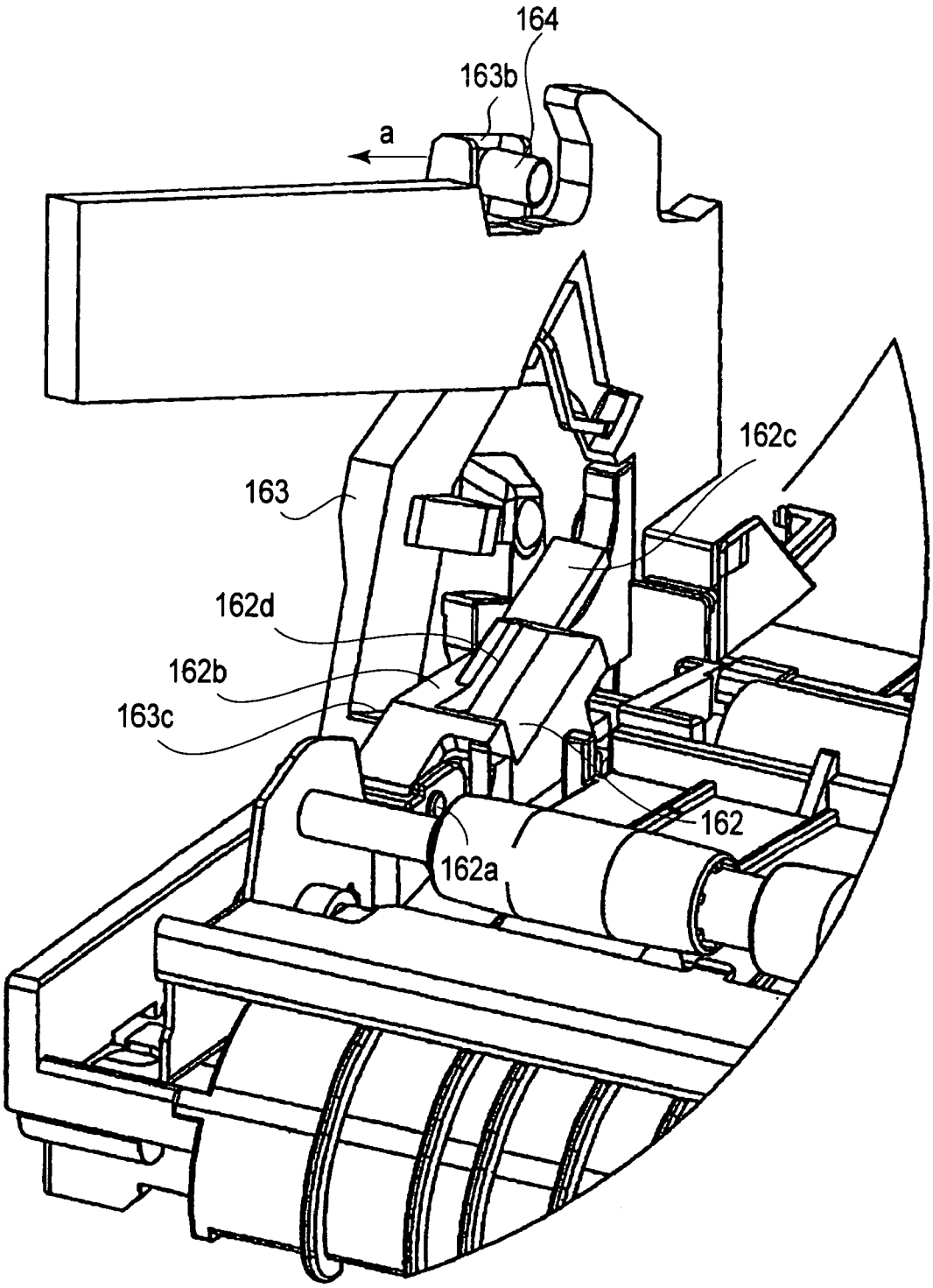
FIG. 12 is a perspective view of the electrical contact protection mechanism of the image forming apparatus main assembly, showing the structures thereof (No. 2).
Figure 13:
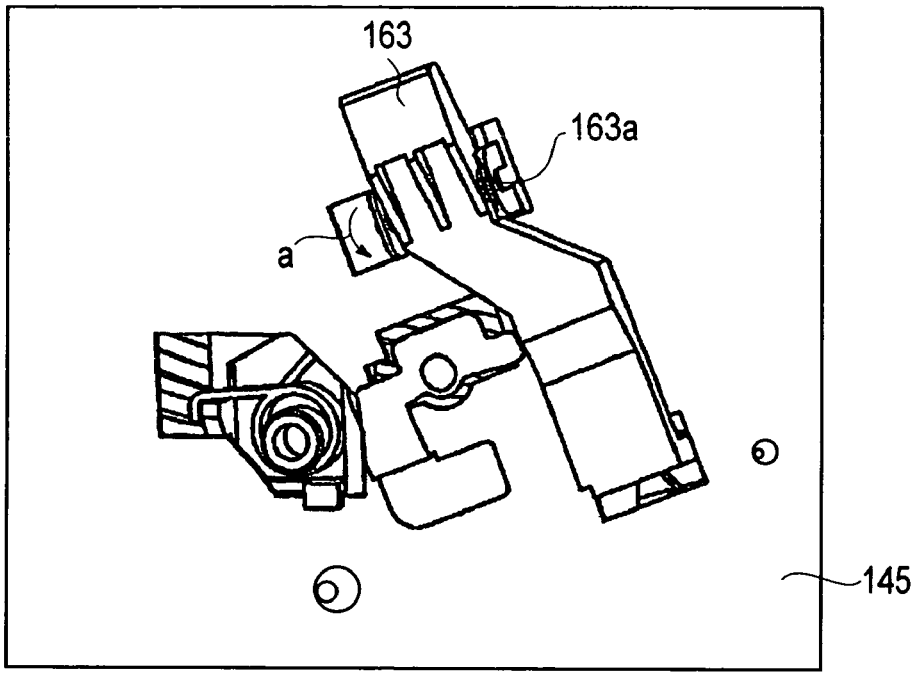
FIG. 13 is a perspective view of the electrical contact protection mechanism of the image forming apparatus main assembly, showing the structures thereof (No. 3).
Figure 13:
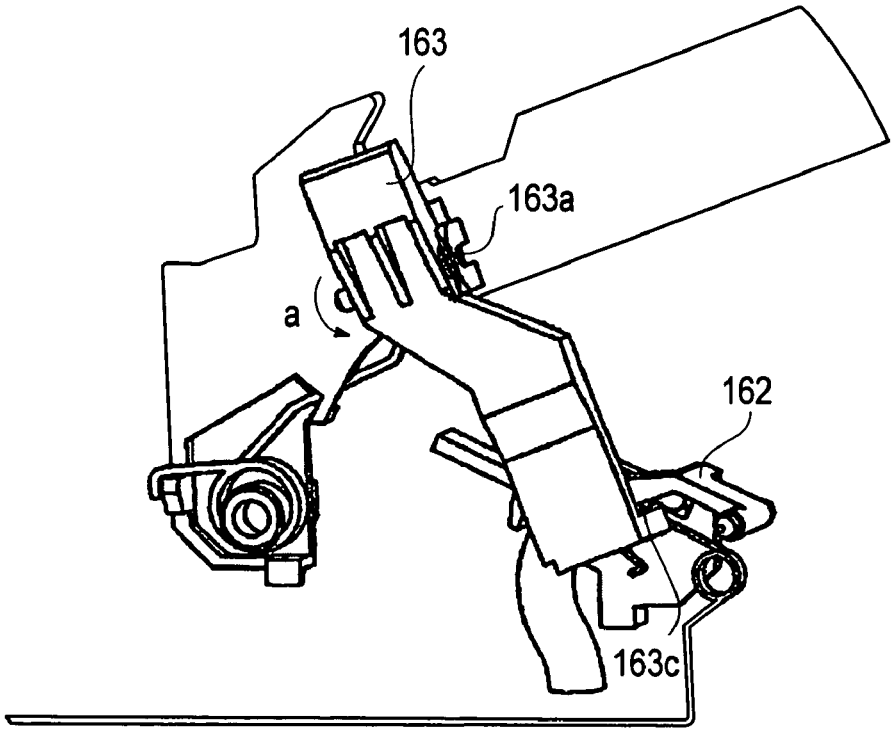

FIGS. 11-13 are perspective views of the main assembly of the electrophotographic image forming apparatus, depicting the structure thereof. FIG. 11(*a*) shows the apparatus main assembly in which the cartridge B is yet to be mounted, whereas FIG. 11(*b*) shows the apparatus main assembly in which the cartridge B is present, although the cartridge B itself is not drawn. Referring to FIG. 11(*a*), the apparatus main assembly A is provided with the guides 130L1 and 130L2 for facilitating the mounting of the cartridge B into the apparatus main assembly A. It is also provided with: a retention spring 143 for retaining the cartridge B after the mounting of the cartridge B into the image formation position; a ground contact 144 which is placed in contact with the drum shaft 139 (FIG. 10) to ground the photosensitive drum 107; an electrical contact protecting movable member 162 movable between the protective position in which it covers the development bias transmission electrical contact 161 (FIG. 11(*b*)) as one of the electrical contacts on the main assembly side, and the exposing position in which it leaves the development bias transmission electrical contact 161 exposed; and a retaining member 163 for retaining the movable member 162.

To the development bias transmission electrical contact 161 as one of the electrical contacts on the main assembly side, development voltage is applied from an electrical power source (unshown) with predetermined control timing.

Next, the structures of the movable member 162 and retaining member 163 will be described in more detail. Referring to FIG. 12, the movable member 162 is rotatably supported by the shaft 162*a*, and the movable member 162 is kept pressured by a spring in the direction to be rotated into the protective position shown in FIG. 11(*a*). The rotational axis of the movable member 162 is parallel to the axial line of the photosensitive drum 107 in the cartridge B, and is rotatably movable relative to the apparatus main assembly A. As for the movement of the movable member 162 into the exposing position (FIG. 11(*b*)) in which it keeps the development bias transmission electrical contact 161 exposed, the movable member 162 is moved into the exposing position by the insertion of the cartridge B into the apparatus main assembly A. To describe in more detail, which will be repeated later, during the insertion of the cartridge B into the apparatus main assembly A, the projection 142 (FIG. 10) as the second engaging portion of the cartridge B engages with the engaging portion 162*b*, which is a part of the movable member 162 (FIG. 12). As the cartridge B is inserted into the image forming position, the projection 142 as the second retaining portion retains the movable member 162 by the surface 162*c*, retaining the movable member 162 in the exposing position (FIG. 11(*b*)). As a result, the development bias transmission electrical contact 161 is exposed and remains exposed through the slit 162*d* of the movable member 162. The internal plate 145 is provided with a small hole 145*a*, through which the retaining member 163 for retaining the movable member 162 partially projects (FIG. 11(*a*)). Not only does the projection 142 function as the first engaging portion, but also, as the first retaining portion.

FIG. 13 is a drawing of the same portions of the image forming apparatus shown in FIG. 11, except that in FIG. 13, they are seen from the opposite direction from the direction in which they are seen in FIG. 11. Referring to FIG. 13(*a*), the retaining member 163 is rotatably supported by the shaft 163*a*. Referring to FIG. 12, there is an elastic member 164 as a first elastic member between the surface 163*b* of the retaining member 163 and an unshown internal plate 145, and the retaining member 163 is kept pressured by the elastic member 164 in the direction indicated by an arrow mark a.

Thus, as will be understood from FIG. 13(*b*), the engaging portion 163*c* of the retaining member 163 slips into the underside of the movable member 162, preventing the movable member 162 from rotating into the exposing position.

(5) Description of Movements of Electrical Contact Protection Mechanism

Figure 14:
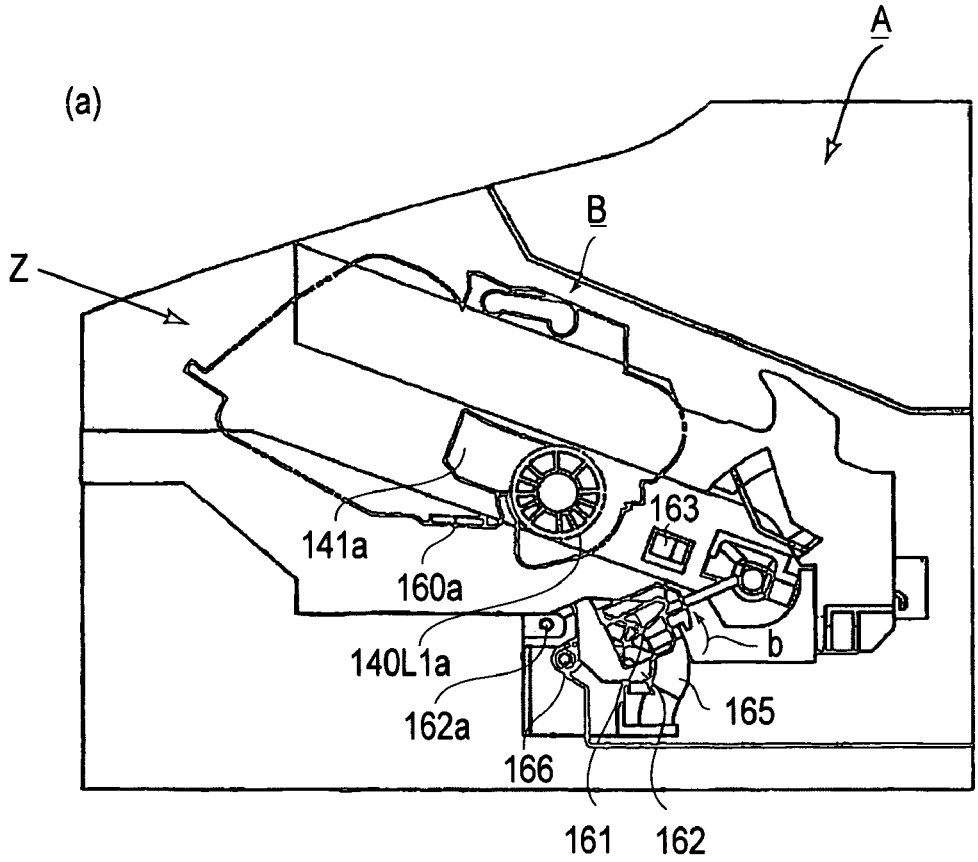
FIG. 14 is a schematic drawing depicting the movements of the electrical contact protection mechanism (No. 1).
Figure 14:
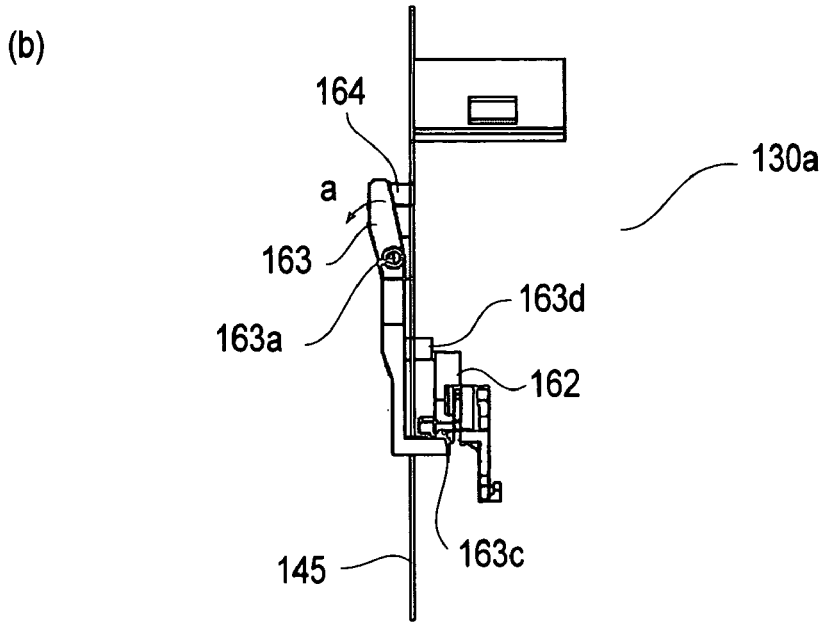
Figure 15:
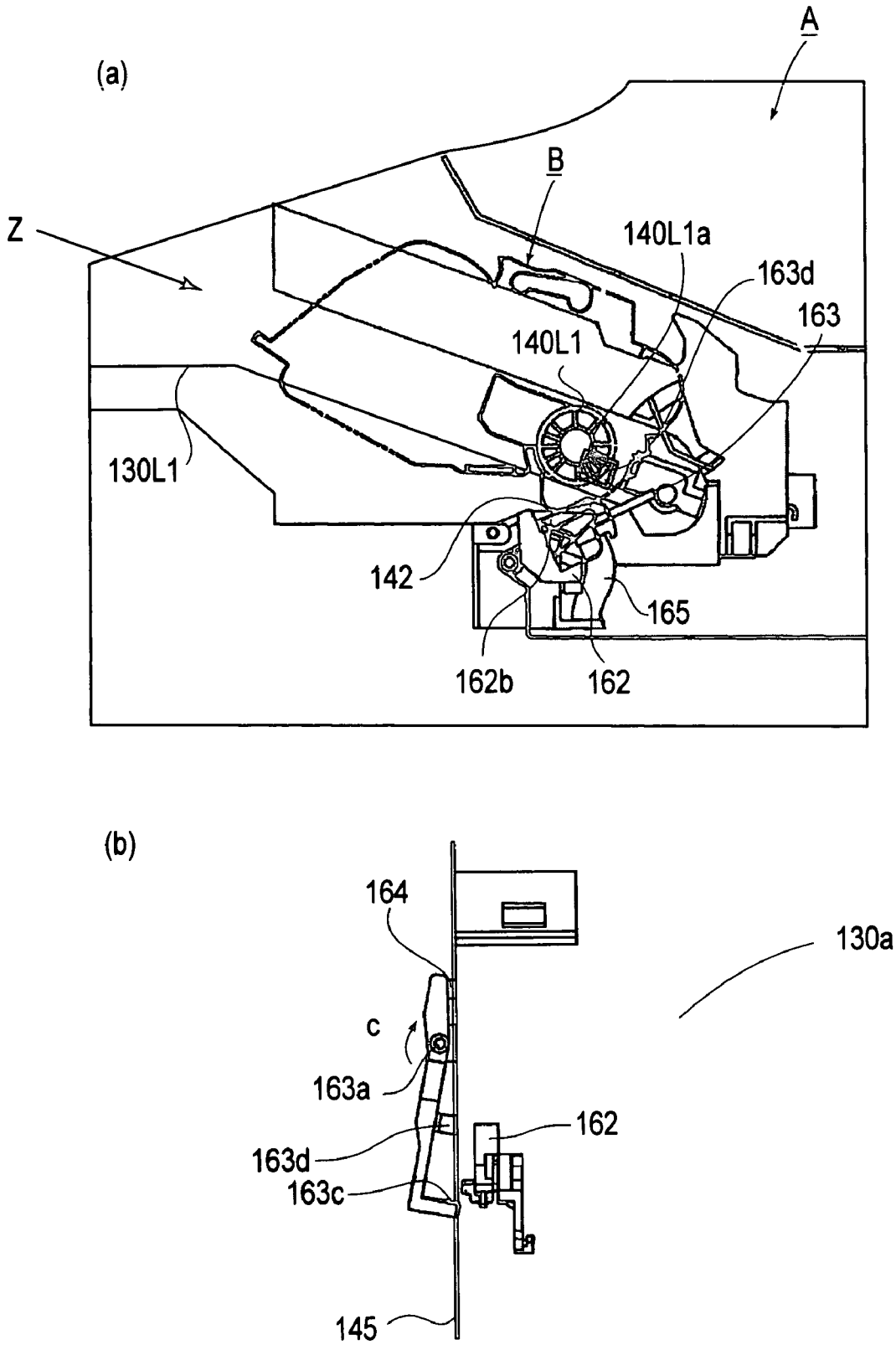
FIG. 15 is a schematic drawing depicting the movements of the electrical contact protection mechanism (No. 2).
Figure 16:
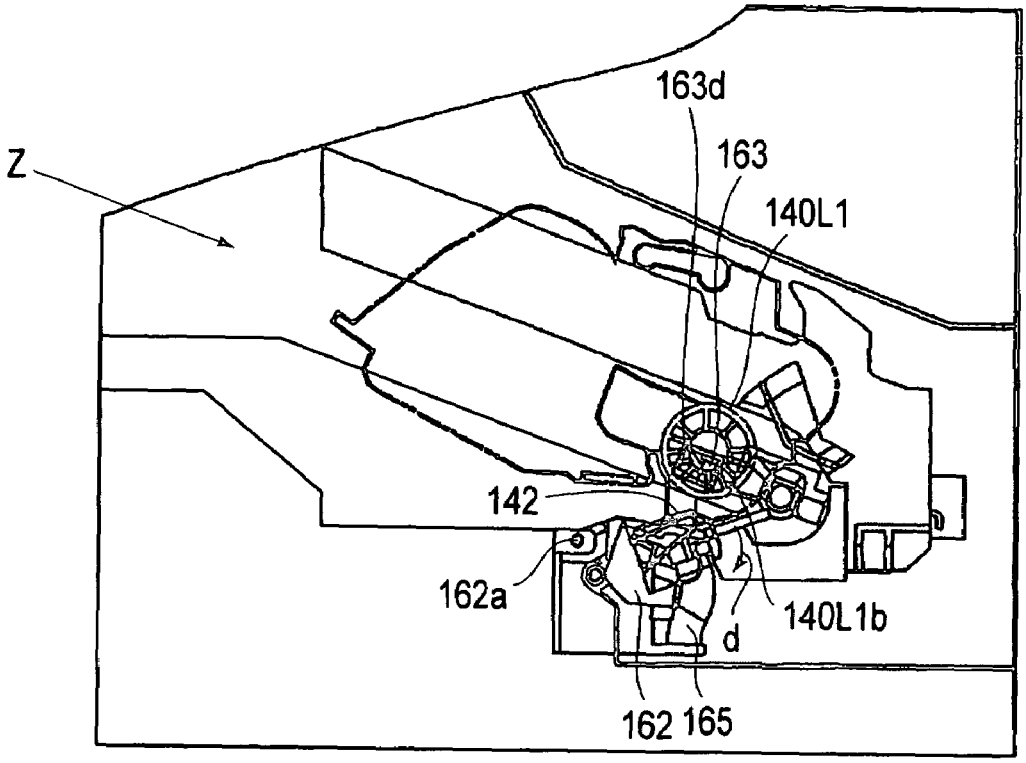
FIG. 16 is a schematic drawing depicting the movements of the electrical contact protection mechanism (No. 3).
Figure 16:
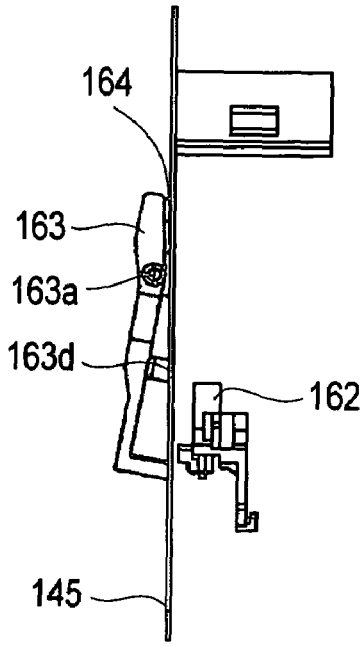

Next, the movement of the electrical contact protection mechanism will be described in detail. FIGS. 14-16 are drawings for describing the movements of the electrical contact protection mechanism, which occur as the cartridge B is inserted (advanced) into the apparatus main assembly A.

FIGS. 14(*a*), 15(*a*), and 16(*a*) are drawings of the electrical contact protection mechanism, as seen from the cartridge compartment 130*a* side toward the internal plate 145 (as seen from direction indicated by arrow mark Y in FIG. 11(*a*)). FIGS. 14(*b*), 15(*b*), and 16(*b*) are drawings of the electrical contact protection mechanism, as seen from the direction indicated by an arrow mark Z in FIGS. 14(*a*), 15(*a*), and 16(*a*). In FIGS. 14(*a*), 15(*a*), and 16(*a*), the cartridge B is outlined with broken lines for ease of understanding. Further, for the purpose of showing the development bias transmission electrical contact 161, a part of the movable member 162 is not drawn.

The development bias transmission electrical contact 161 as one of the electrical contacts on the main assembly side is supported by the shaft 166, being enabled to rotate. That is, with the cartridge B mounted in the apparatus main assembly A, the rotational axis of the development bias transmission electrical contact 161 is parallel to the axial line of the photosensitive drum 107 of the cartridge B, and is rotatable relative to the apparatus main assembly A.

Further, in terms of the direction parallel to the axial line of the photosensitive drum 107, the movable member 162, and the development bias transmission electrical contact 161 as one of the electrical contacts on the main assembly side, overlap with each other.

FIGS. 14(*a*) and 14(*b*) show the states of the electrical contact protection mechanism during the mounting of the cartridge B into the apparatus main assembly A. The movable member 162 is in the position in which it covers the development bias transmission electrical contact 161, and the retaining member 163 is in the position in which it retains the movable member 162. The movable member 162 is kept pressured in the direction indicated by an arrow mark b by the elastic member 165 as the second elastic member (FIG. 14(*a*)). As described above, the retaining member 163 is kept pressured in the arrow a direction by the elastic member 164 (FIG. 14(*b*)). Thus, the engaging portion 163*c* of the retaining member 163 is projecting into the cartridge compartment 130*a* through the hole of the internal plate 145 as shown in FIG. 14(*b*), having slipped into the underside of the movable member 162, preventing thereby the movable member 162 from rotating. Also, the projection 163*d* of the retaining member 163 is projecting into the cartridge compartment 130*a*. In other words, when the retaining member 163 is in the retaining position, it prevents the movable member 162 from moving from the protective position to the exposing position.

FIGS. 15(*a*) and 15(B) show the states of the electrical contact protection mechanism, in which the cartridge B has been advanced deeper into the apparatus main assembly than the state shown in FIGS. 14(*a*) and 14(*b*), respectively. They show the very moment when the projection 142 as the second engaging portion of the cartridge B has just engaged with the engaging portion 162*b* of the movable member 162 of the apparatus main assembly A (FIG. 15(*a*)). In this state, the projection 163*d* of the retaining member 163 has engaged with the engaging portion 140L1*a* as the first engaging portion, that is, a part of the cartridge guide 140L1 which engages with the engaging portion retaining member 163, and rotates the retaining member 163 in the direction indicated by an arrow mark c about the shaft 163*a*, and therefore, the retaining member 163 has been moved into the releasing position (FIG. 15(*b*)). When the retaining member 163 is in the releasing position, the engaging portion 163*c* of the retaining member 163 is away from the position in which it prevents the movable member 162 from rotating. Therefore, the movable member 162 is allowed to rotate. In other words, when the retaining member 163 is in the releasing position, it allows the movable member 162 to rotate. The elastic member 164 is disposed in the compressed state.

FIGS. 16(*a*) and 16(*b*) show the state of the electrical contact protection mechanism, in which the cartridge B has been advanced even further into the apparatus main assembly A from the position shown in FIGS. 15(*a*) and 15(*b*), respectively. The retaining member 163 is kept in the same attitude as that shown in FIGS. 15(*a*) and 15(*b*), by the plurality of ribs 140L1*b* radially extending from the center ring portion of the cartridge guide 140L1 to the periphery of the cartridge guide 140L1. As for the movable member 162, it is pressed by the projection 142, being therefore rotated in the direction indicated by an arrow mark d about the shaft 162*a*, against the resiliency of the elastic member 165.

Figure 17:
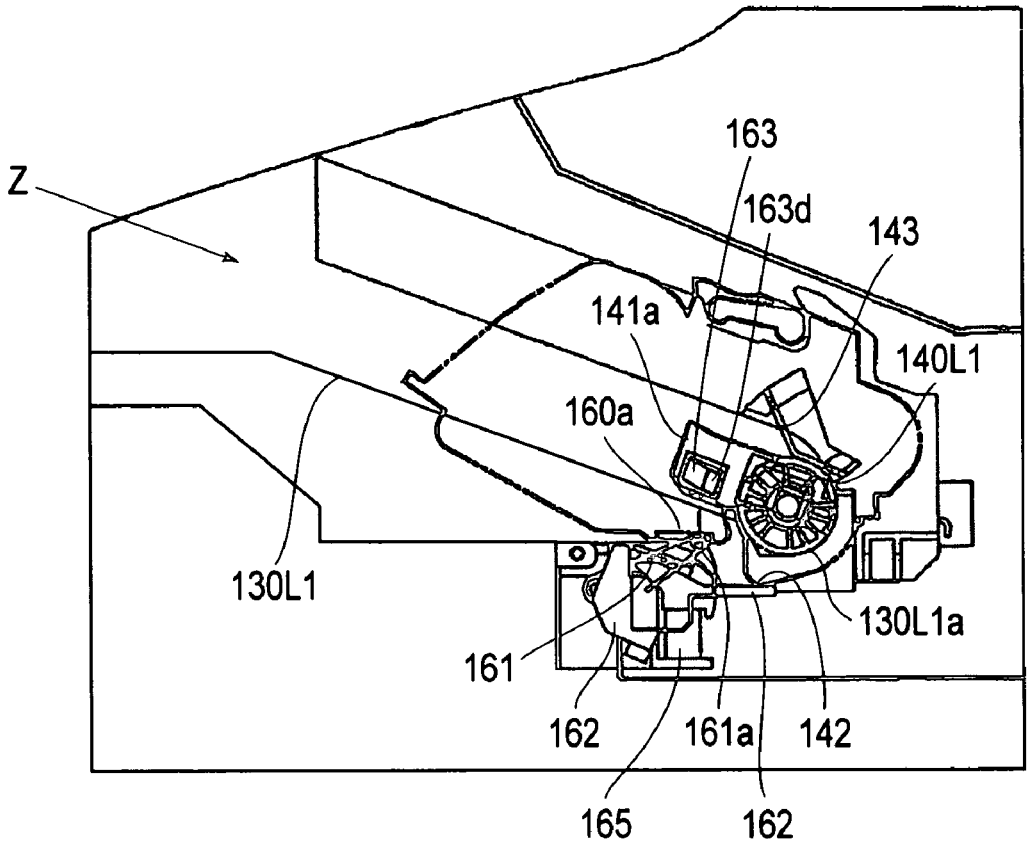
FIG. 17 is a schematic drawing depicting the movements of the electrical contact protection mechanism (No. 4).
Figure 17:
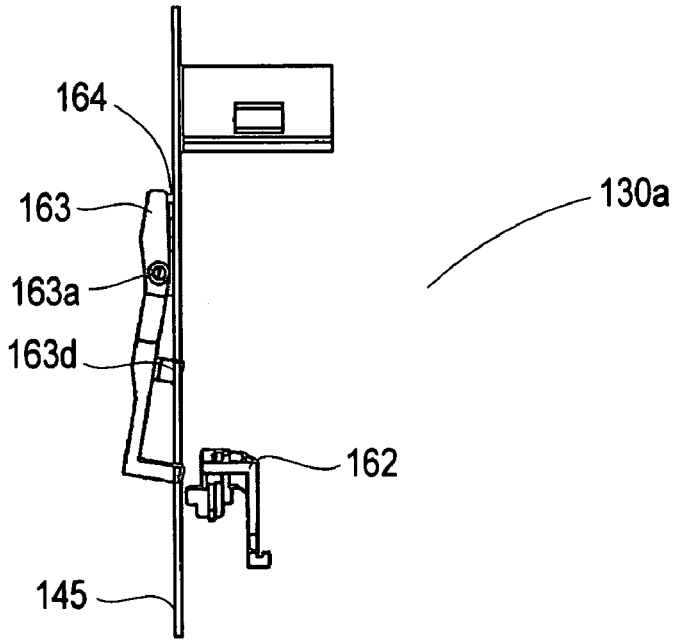

FIGS. 17(*a*) and 17(*b*) show the state of the electrical contact protection mechanism, in which the cartridge B has been inserted into the image forming position. In this state, the cartridge guide 140L1 is engaged with the positioning portion 130L1*a* of the guide 130l1 on the main assembly side, being precisely positioned relative to the apparatus main assembly A. As for the top portion of the cartridge guide 140L1, it is in contact with a retainer spring 143, being thereby pressured downward by the spring 143. The retaining member 163 is held by the contact portion 141*a* as the first retaining portion of the extension portion 141 (FIG. 10) of the cartridge B. Further, the movable member 162 is retained by the projection 142 as the second retaining portion, in the exposing position in which it keeps the development bias transmission electrical contact 161 exposed. As the cartridge B is inserted into this position, the contact portion 161*a* of the development bias transmission electrical contact 161 comes into contact with the contact portion 160*a* of the development bias reception electrical contact 160, establishing electrical connection between the electrical power source on the apparatus main assembly A side and the cartridge B. The image forming operation is carried out when the cartridge B is in this state.

In summary, this embodiment of the present invention can yield the following effects.

1) Even if an operator inserts his hand into the image forming apparatus main assembly A to take care of a paper jam or the like problem after removing the process cartridge B from the image forming apparatus main assembly A, the hand does not easily come into contact with the electrical contact 162 on the main assembly side, because the electrical contact 1621 is not projecting inward of the apparatus main assembly A. Therefore, it does not occur that a bad electrical connection occurs between the process cartridge B and apparatus main assembly A due to the adhesion of human sweat and/or the internal grease of the apparatus main assembly A to the electrical contact 161.

2) The electrical contact protecting movable member is moved by the movement of the cartridge B, making it unnecessary for an operator to perform an operation dedicated to the establishment of electrical connection between the cartridge B and apparatus main assembly A.

3) The apparatus main assembly A is provided with the retaining member 163 for preventing the movable member 162 from moving into the exposing position in which the movable member 162 keeps the electrical contact of the apparatus main assembly A exposed, while no cartridge B is in the apparatus main assembly A. In other words, in order for an operator to touch the electrical contact 161 of the apparatus main assembly A, the movable member 162 must be moved into the electrical contact exposing position while retaining the retaining member 163 in the releasing position. Therefore, even if an operator inserts his hand into the apparatus main assembly A in order to maintain the image forming apparatus, for example, to deal with paper jam or the like problem, the hand of the operator is far less likely to accidentally touch the electrical contact 161, compared to the case in which an operator inserts his hand into the main assembly of an image forming apparatus in accordance with the prior art.

4) The surface 141*a* as the first retaining portion is provided as a part of the extension portion 141 of the cartridge guide 140L1, and the cartridge guide 140L1 is the portion for precisely positioning the cartridge B. Therefore, the surface 141*a* is stable in position, being therefore reliable in function.

5) The movable member 162 is moved by the projection 142 projecting downward from the cartridge B, into the position in which the movable member 162 keeps the electrical contact on the main assembly side exposed, while the retaining member 163 is retained by one of the lateral surfaces of the cartridge B. Therefore, while the cartridge B is inserted, the retaining member 163 is kept in the position in which it does not retain the movable member 162 until the end of the insertion of the cartridge B into the apparatus main assembly A. Therefore, it is assured that the movable member 162 is moved into the exposing position in which it keeps exposed the electrical contact on the main assembly side.

6) The apparatus main assembly A and cartridge B are structured so that when the cartridge B is in the apparatus main assembly A, the rotational axis of the movable member 162 is parallel to the axial line of the photosensitive drum 107, and the movable member 162 is rotatable relative to the apparatus main assembly A; that when the cartridge B is in the apparatus main assembly A, the rotational axis of the development bias transmission electrical contact 161 as one of the electrical contacts on the main assembly side is parallel to the axial line of the photosensitive drum 107, and the development bias transmission electrical contact 161 rotates relative to the apparatus main assembly A; and that the movable member 162, and the development bias transmission electrical contact 161 as one of the electrical contacts of the main assembly A, are disposed in a manner of overlapping in the direction parallel to the aforementioned axial line, contributing to space saving.

Embodiment 2

Next, the second embodiment of the present invention will be described. The structure of the image forming apparatus 100 in this embodiment is similar to that of the image forming apparatus in the first embodiment described above. Here, therefore, only the structural features different from those of the image forming apparatus in the first embodiment will be described. Further, the components of the image forming apparatus in this embodiment, which are identical in structural feature and function to the counterparts in the first embodiment, will be given the same referential symbols so that the descriptions of the counterparts in the first embodiment can be referred to.

(1) Structures of Apparatus Main Assembly and Cartridge

Figure 18:
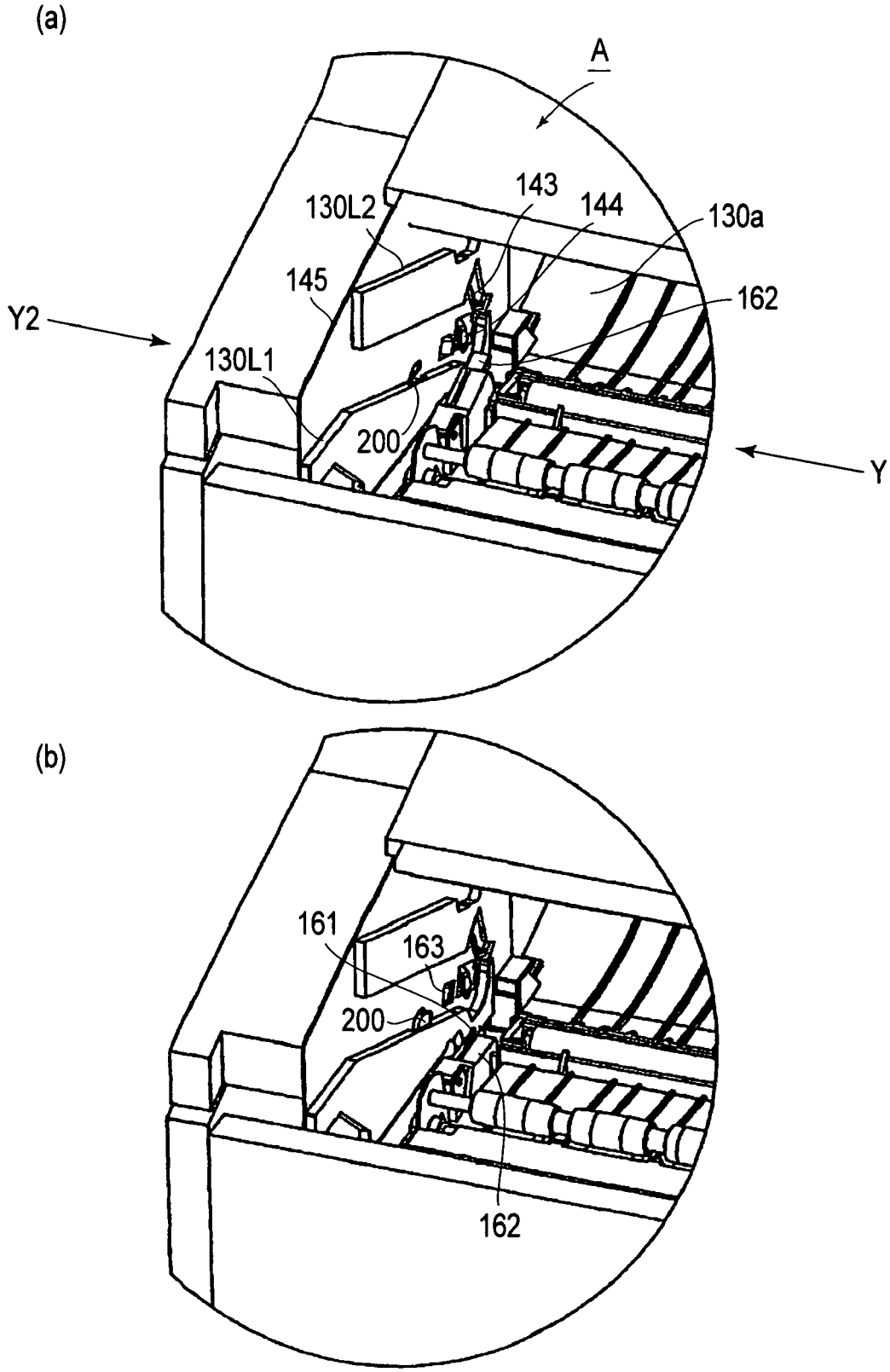
FIG. 18 is a perspective view of the electrical contact protection mechanism, and the components in its adjacencies, of the main assembly of the image forming apparatus, showing the structures thereof.
Figure 19:
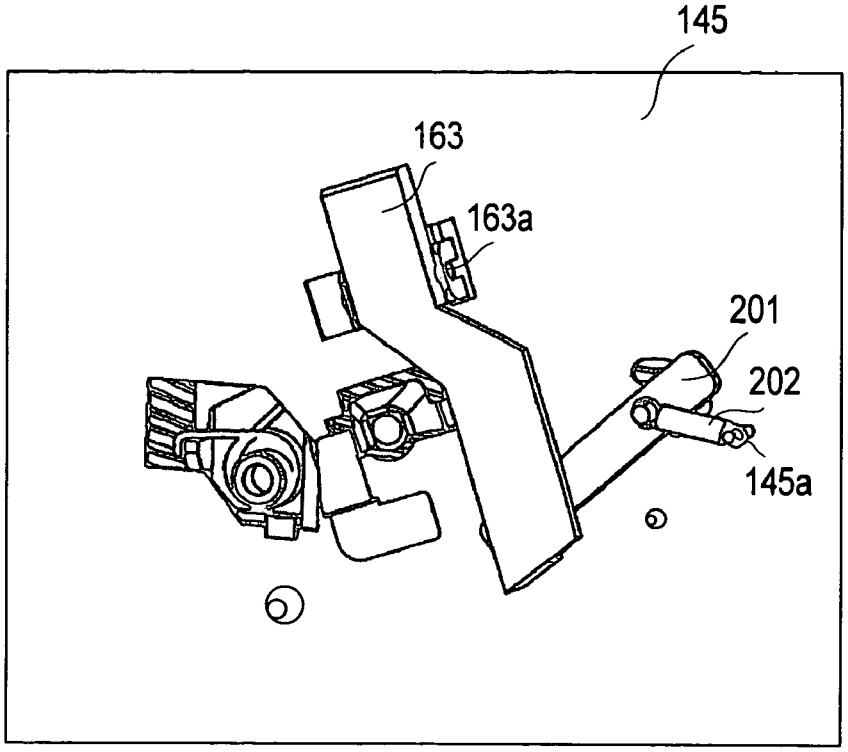
FIG. 19 is a perspective view of the electrical contact protection mechanism, and its adjacencies, of the main assembly of the image forming apparatus, in the second embodiment of the present invention, showing the structures thereof.
Figure 20:
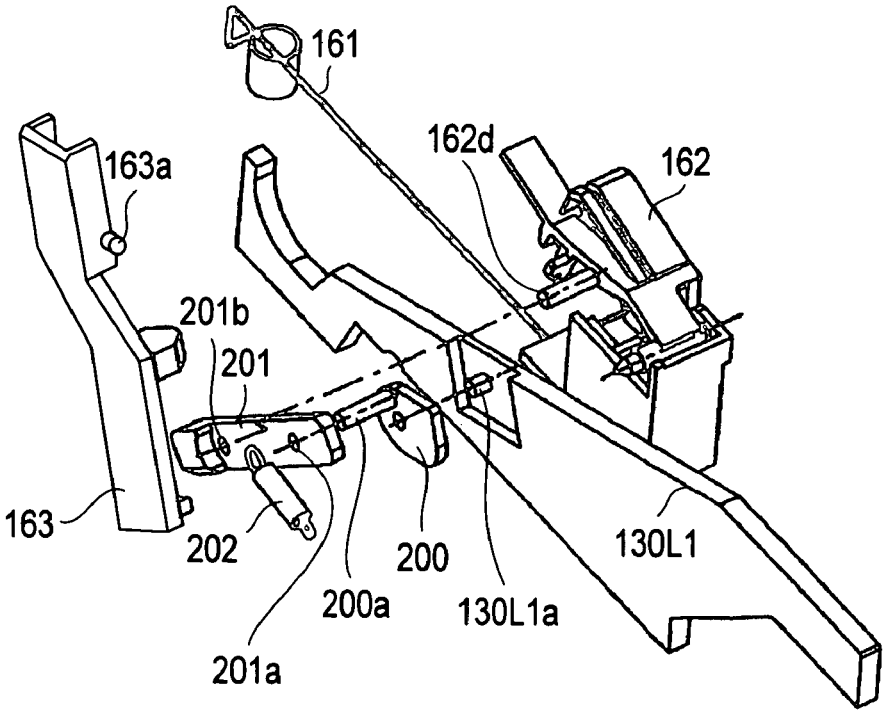
FIG. 20 is an exploded view of the electrical contact protection mechanism of the image forming apparatus main assembly, and the components related thereto, showing the structures thereof.

FIGS. 18-20 are drawings depicting the retaining member and movable member of the apparatus main assembly A in this embodiment.

FIG. 18(*a*) shows the cartridge compartment of the apparatus main assembly A, in which the cartridge B is not present, and FIG. 18(*b*) shows the cartridge compart of the apparatus main assembly A, in which the cartridge B is present, although the cartridge B is not illustrated. When the cartridge B is not in the apparatus main assembly A as shown in FIG. 18(*a*), the development bias transmission electrical contact 161 is covered with the movable member 162, whereas when the cartridge B is in the apparatus main assembly A as shown in FIG. 18(*b*), the development bias transmission electrical contact 161 is exposed; it is not covered with the movable member 162.

Like the apparatus main assembly A in the first embodiment described with reference to the FIGS. 11(*a*) and 11(*b*), the apparatus main assembly A in this embodiment is also provided with the development bias transmission electrical contact 161, movable member 162 for covering the development bias transmission electrical contact 161, and retaining member 163 for retaining the movable member 162.

This embodiment is different from the first embodiment in that the apparatus main assembly A in this embodiment is also provided with a releasing member 200 which moves with the movable member 162 and retaining member 163. When the apparatus main assembly A is in the state shown in FIG. 18(*a*), the releasing member 200 remains retracted in a recess of the guide 130L1 of the apparatus main assembly A. Also, this embodiment is different from the first embodiment, in the structural arrangement regarding how the movable member 162 is retained by the retaining member 163. Next, these differences will be described in detail.

FIG. 19 is a perspective view of the cartridge compartment of the apparatus main assembly A as seen from the direction indicated by an arrow mark Y2 in FIG. 18. The retaining member 163 in FIG. 19 is rotatably supported like the retaining member in the first embodiment. The apparatus main assembly A in this embodiment is also provided with a linking member 201 and an elastic member 202. The linking member 201 connects the releasing member 200, shown in FIGS. 18(*a*) and 18(*b*), and the movable member 162.

FIG. 20 is an exploded view of the releasing member and movable member 162, as well as the components related thereto, showing the structures thereof. The guide 130L1 of the main assembly is provided with a shaft 130L for rotatably supporting the releasing member 200. The releasing member 200 is provided with a shaft 200*a*, which is fitted in the hole 201*a* of the linking member 201, rotatably supporting the linking member 201. Further, one end of the elastic member 202 is hooked to the shaft 200*a* of the releasing member 200, and the other end of the elastic member 202 is hooked to the shaft 145*a* (FIG. 19) projecting from the internal plate 145. Further, the linking member 201 is provided with a hole 202*b*, in which the shaft 162*d* of the movable member 162 is fitted, rotationally supporting thereby the linking member 201. The releasing member 200 and movable member 162 are connected with the provision of the above described structural arrangement.

Figure 21:
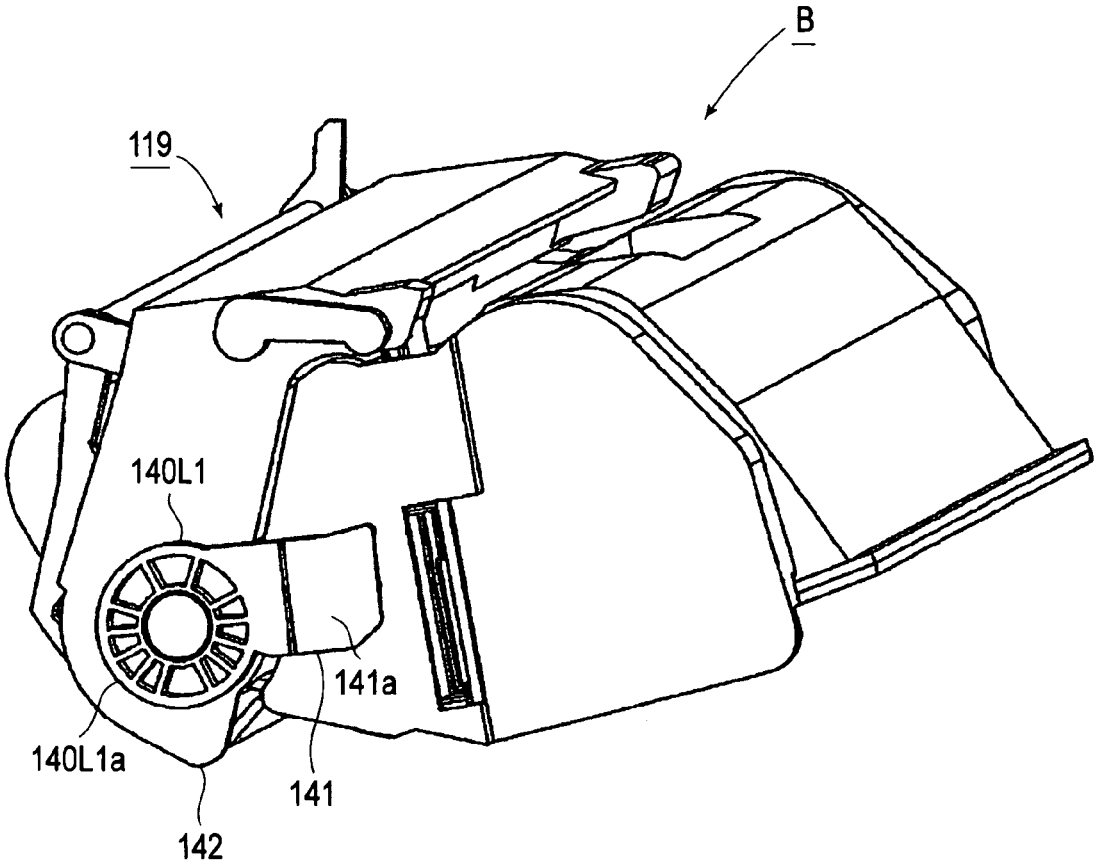
FIG. 21 is a perspective view of one of the lengthwise ends of the process cartridge.

FIG. 21 is a perspective view of the cartridge B in this embodiment. Like the cartridge B in the first embodiment, the cartridge B in this embodiment also has the cartridge guide 140L1, and first engaging portion 140L1*a* as a part of the cartridge guide 140L1, as well as the projection 142 projecting downward from the drum frame 119. However, the extension portion 141 is stepped (the extension portion 141 has two sections: a section level with the cartridge guide 140L1, and a section 141*a* recessed toward the cartridge frame). Therefore, the surface 141*a* of the cartridge guide 140L1, that is, the surface of the section recessed toward the cartridge frame, does not have the function of retaining the retaining member 163 in the releasing position. This is different from the first embodiment.

(2) Description of Movement of Electrical Contact Protection Mechanism

Next, the movements of the electrical contact protection mechanism in this embodiment will be described in detail. FIGS. 22-25 are schematic drawings depicting the movements of the electrical contact protection mechanism, which occur as the cartridge B is inserted (advanced) into the apparatus main assembly A.

Figure 22:
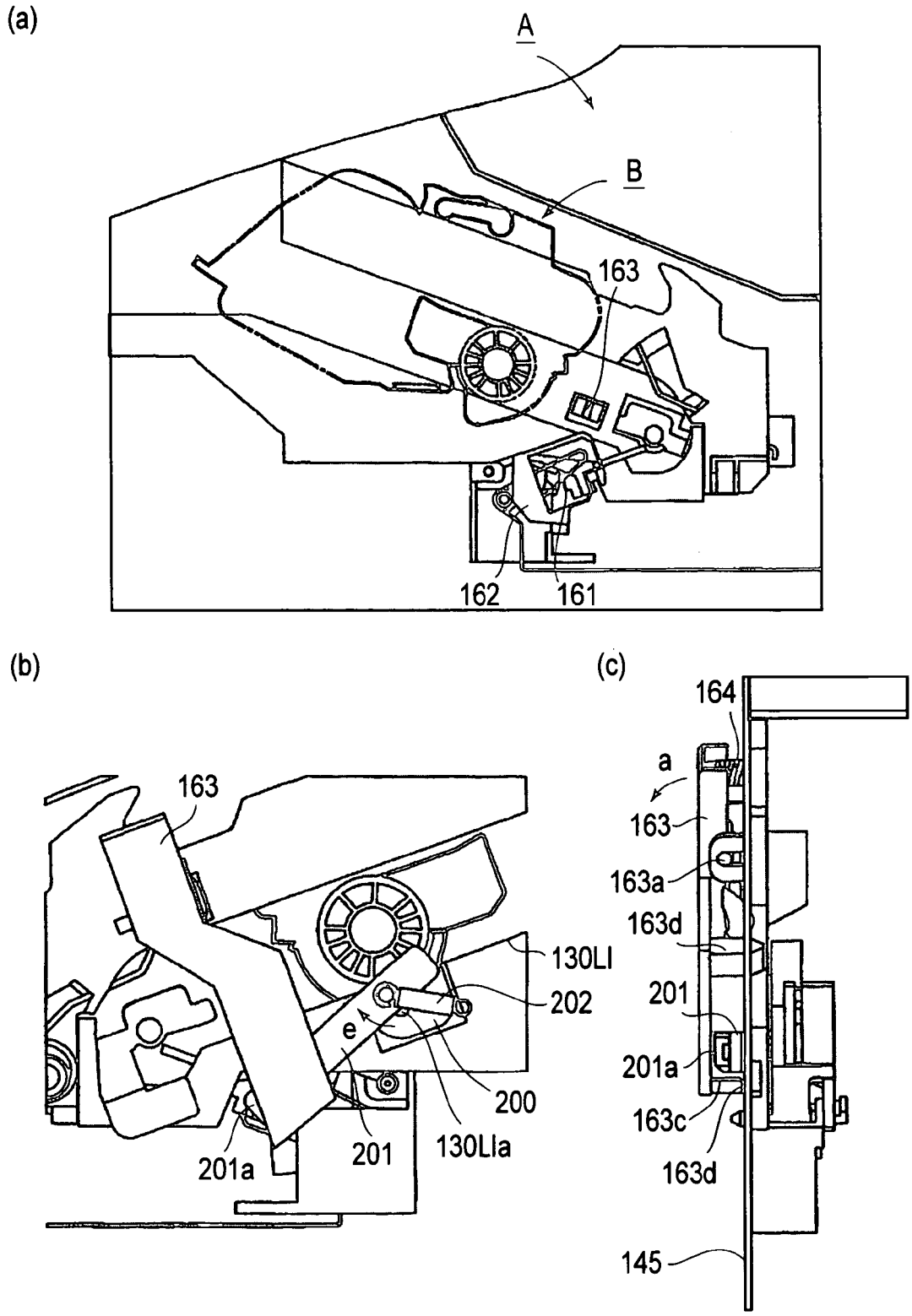
FIG. 22 is a schematic drawing depicting the movements of the electrical contact protection mechanism (No. 1).

FIGS. 22(*a*)-25(*a*) are drawings of the electrical contact protection mechanism as seen from the direction indicated by the arrow mark Y in FIG. 18(*a*). FIGS. 22(*b*)-25(*b*) are drawings of the electrical contact protection mechanism as seen from the direction indicated by the arrow mark Y2 in FIG. 18(*a*). FIGS. 22(*c*)-25(*c*) are drawings of the electrical contact protection mechanism as seen from the direction indicated by the arrow mark Z2 in FIG. 22(*b*). These drawings are provided for the understanding of the movement of the retaining member 163.

FIGS. 22(*a*)-22(*c*) show the states of the electrical contact protection mechanism in various stages of the cartridge B insertion into the apparatus main assembly A. Referring to FIG. 22(*a*), the movable member 162 is in the protective position in which it covers the development bias transmission electrical contact 161, and the retaining member 163 is in the retaining position in which it retains the movable member 162. When the retaining member 163 is in the retaining position, it prevents the movable member 162 from moving from the protective position to the exposing position. The retaining member 163 is kept pressured by the elastic member 164 in the direction indicated by an arrow mark a. The retaining portion 163*c* of the retaining member 163 does not directly retain the movable member 162; the linking member 201 rotatably connected to the movable member 162 is retained by the retaining portion 163*c*. As for the releasing member 200, referring to FIG. 22(*b*), it has been rotated about the shaft 130L1*a* in the clockwise direction (direction indicated by arrow mark e); it has been retracted into the recess of the guide 130L1 of the apparatus main assembly A. The elastic member 202 is disposed so that its resiliency acts in the direction to rotate the releasing member 200 in the arrow e direction.

Figure 23:
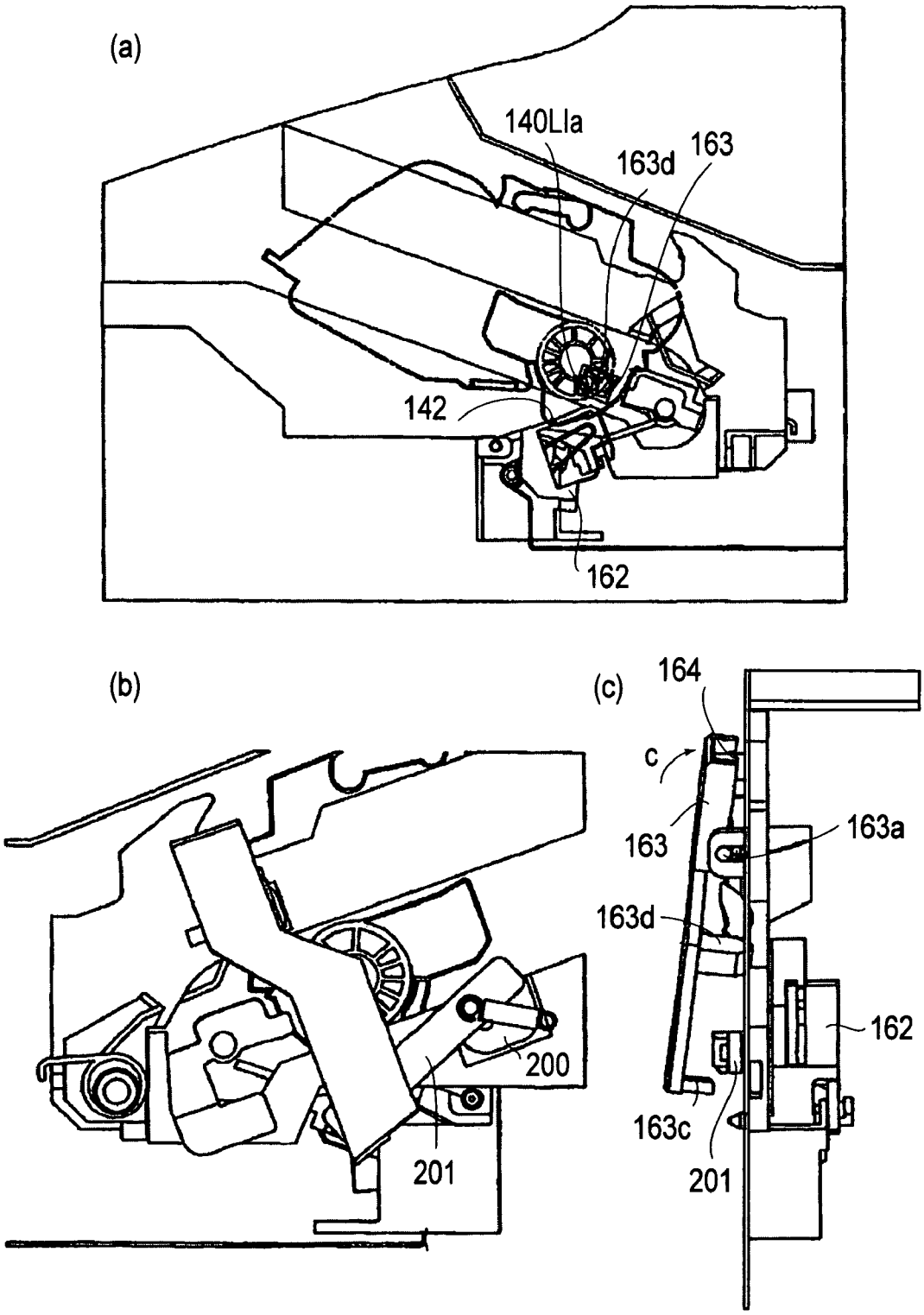
FIG. 23 is a schematic drawing depicting the movements of the electrical contact protection mechanism (No. 2).

FIGS. 23(*a*)-23(*c*) show the state of the electrical contact protection mechanism in a more advanced stage in the insertion of the cartridge B into the apparatus main assembly A than that shown in FIG. 22. In this stage, the engaging portion 140L1*a* as the first engaging portion of the cartridge B has engaged with the projection 163*d* of the retaining member 163, and has rotated the retaining member 163 about the shaft 163*c* in the direction indicated by an arrow mark c, having thereby moved the retaining member 163 into the releasing position, as shown in FIG. 23(*c*). When the retaining member 163 is in the releasing position, the retaining portion 163*c* of the retaining member 163 is away from the position in which it prevents the linking member 201 from moving. Therefore, the movable member 162 is rotatable. In this stage, however, the movable member 162 has not come into contact with the projection 142 of the drum frame, as shown in FIG. 23(*a*). Therefore, the releasing member 200 and linking member 201 remain in the same attitudes as they are in FIG. 22 (FIG. 23(*b*).

Figure 24:
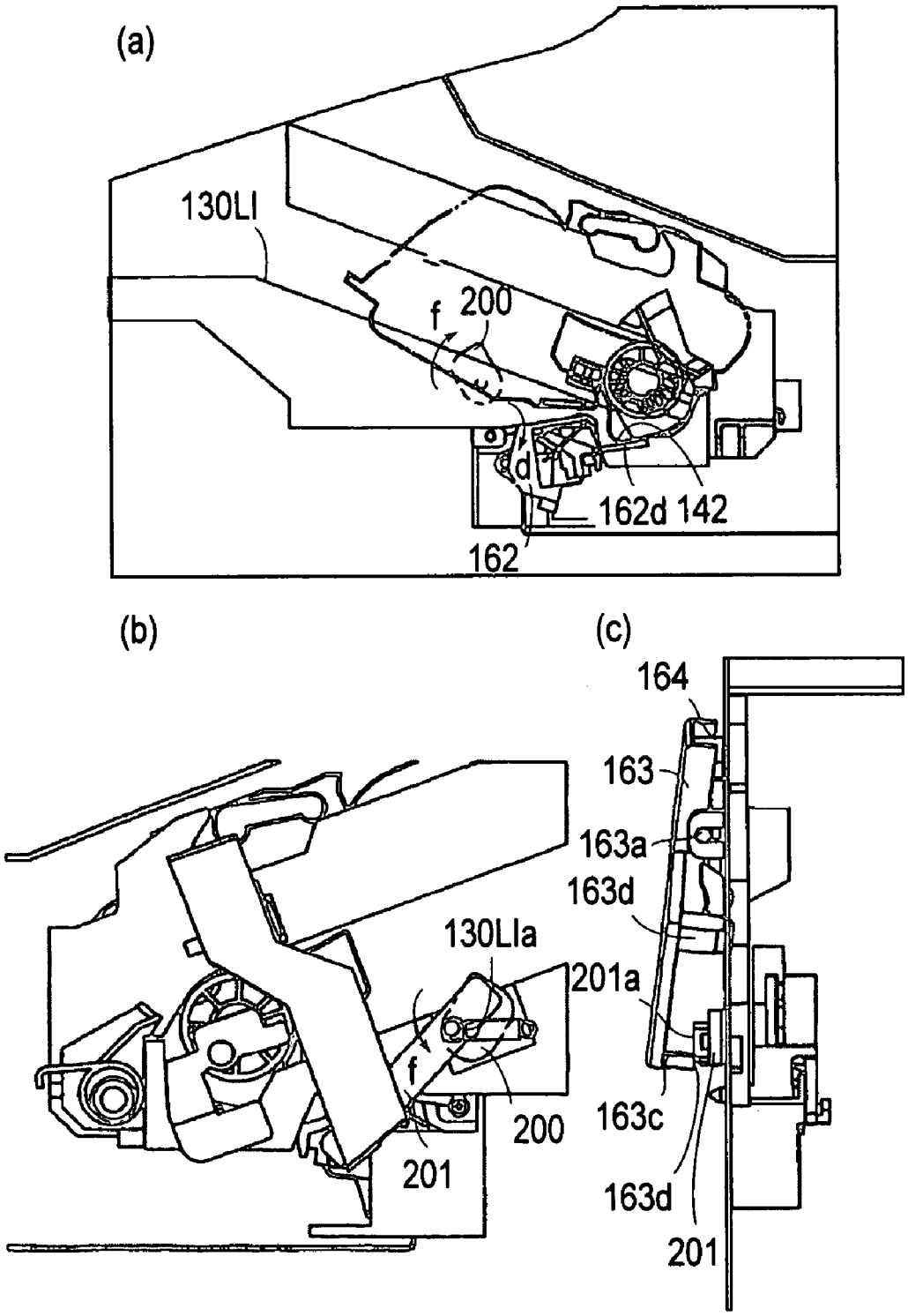
FIG. 24 is a schematic drawing depicting the movements of the electrical contact protection mechanism (No. 3).

FIGS. 24(*a*)-24(*c*) show the state of the electrical contact protection mechanism in a more advanced stage in the insertion of the cartridge B into the apparatus main assembly A than that shown in FIG. 23. In this stage, the projection 142 of the drum frame has engaged with the engaging portion 162*d* of the movable member 162, as shown in FIG. 24(*a*), placing therefore the movable member 162 under the pressure which acts to rotate the movable member 162 in the direction indicated by an arrow mark d. As the movable member 162 is rotated, the linking member 201 is moved as shown in FIG. 24(*b*). The movement of the linking member 201 causes the releasing member 200 to rotated about the shaft 130L1*a* in the direction indicated by an arrow mark f. As a result, a part of the releasing member 200 projects from the recess of the guide 130L1 of the apparatus main assembly A as shown in FIG. 24(*a*). Further, the movement of the linking member 201 causes the surface 201*a* of the linking member 201 to come into contact with the engaging surface 163*d* of the retaining member 163.

Figure 25:
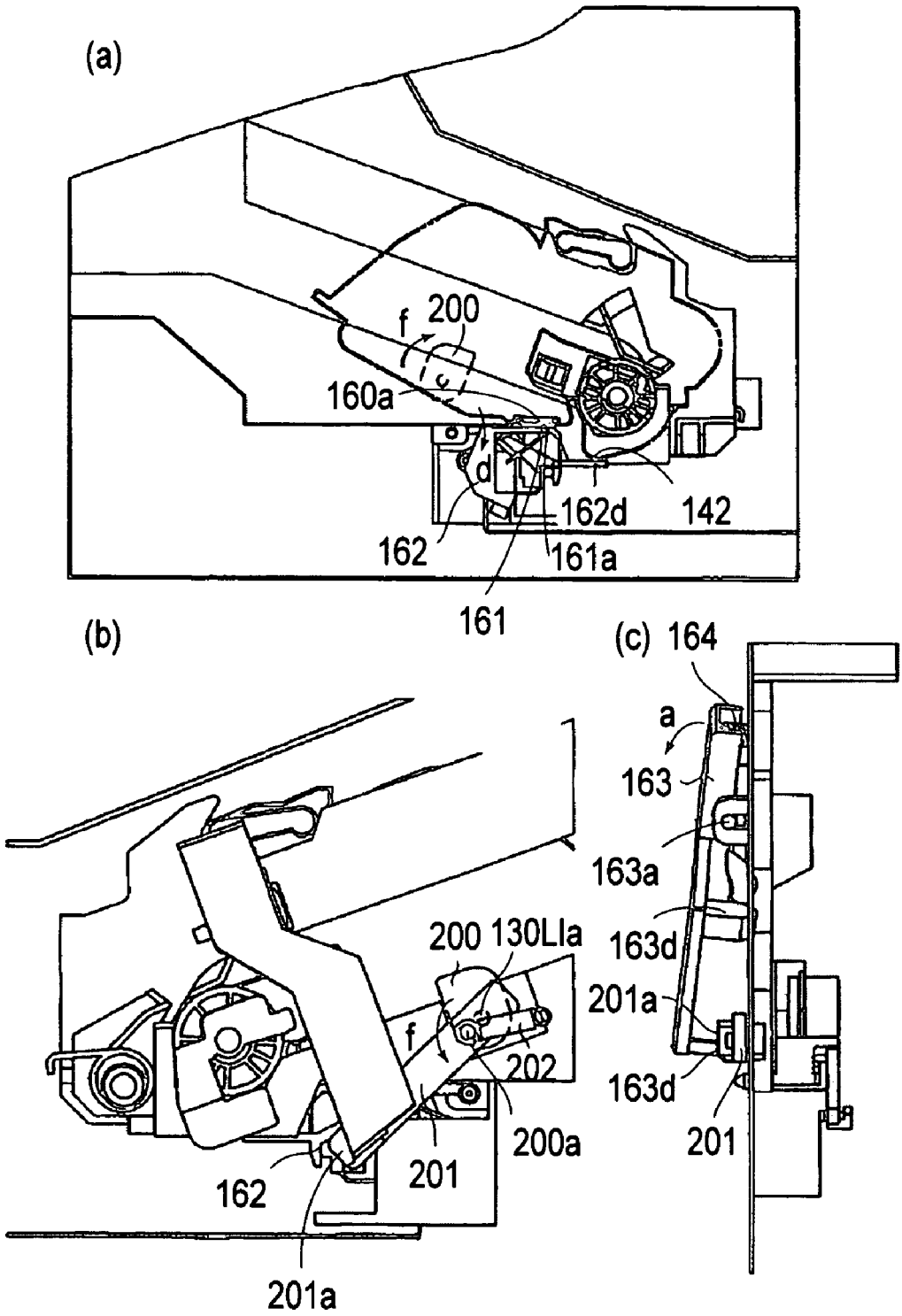
FIG. 25 is a schematic drawing depicting the movements of the electrical contact protection mechanism (No. 4).

FIGS. 25(*a*)-25(*c*) show the state of the electrical contact protection mechanism in the stage in which the cartridge B has settled in the image forming position. Referring to FIG. 25(*a*), the movable member 162 has rotated further in the arrow d direction from its position shown in FIG. 24, exposing thereby the development bias transmission electrical contact 161. As the cartridge B was mounted into this position, the actual contact portion 161*a* of the development bias transmission electrical contact 161 and actual contact portion 160*a* of the development bias reception electrical contact 160 came into contact with each other, establishing electrical connection between the apparatus main assembly A and cartridge B. The image formation is carried out in this stage. As for the releasing member 200, it has been rotated further in the arrow f direction from its position shown in FIG. 24, into the position shown in FIG. 25. Referring to FIG. 25(*b*), the rotation of the movable member 162 moves the linking member 201 further, causing the releasing member 200 to move into the position shown in the drawing. As a result, the shaft 200*a* to which the elastic member 202 is hooked is positioned below the rotational axis 130L1*a* of the releasing member 200, causing the resiliency of the elastic member 202 to act in the direction to rotate the releasing member 200 in the arrow f direction. Therefore, unlike the projection 142 of the drum frame in the first embodiment, the projection 142 of the drum frame in this embodiment does not retain the movable member 162, by the engaging portion 162*d*, as will be evident from in FIG. 25(*a*). Referring to FIG. 25(*c*), the surface 201*a* of the linking member 201 catches the surface 163*d* of the retaining member 163, preventing thereby the retaining member 163 from rotating in the arrow a direction. In other words, in this embodiment, the portion 141*a* (FIG. 21), that is, recessed portion, of the extension portion 141 of the drum frame is not structured to retain the retaining member 163.

Figure 26:
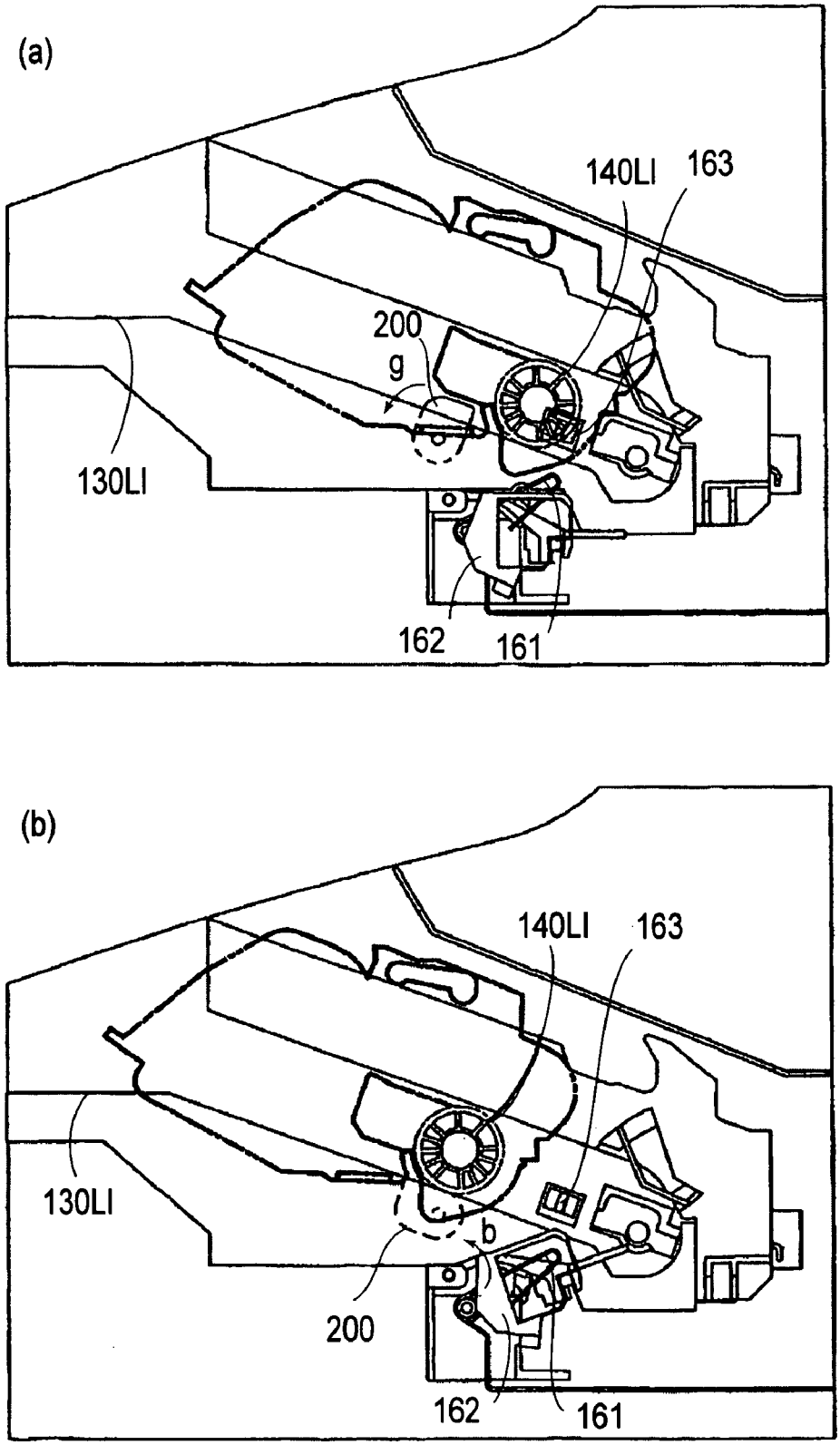
FIG. 26 is a schematic drawing depicting the movements of the electrical contact protection mechanism (No. 5).

FIGS. 26(*a*) and 26(*b*) are drawings showing the movements of the electrical contact protection mechanism which occur during the extraction of the cartridge B from the apparatus main assembly A. Referring to FIG. 26(*a*), when the cartridge B is extracted from the apparatus main assembly A, the guide 140L1 of the cartridge is guided by the guide 130L1 of the apparatus main assembly A. As has been described above, the releasing member 200 rotatably supported by the guide 130L1 of the apparatus main assembly A is projecting from the recess of the guide 130L1 of the apparatus main assembly A. Thus, as the cartridge B is pulled outward, the guide 140L1 of the cartridge B comes into contact with the releasing member 200, causing the releasing member 200 to rotate in the direction indicated by an arrow mark g. When the releasing member 200 is in the position shown in FIG. 26(*a*), the movable member 162 is in the exposing position in which it keeps the development bias transmission electrical contact 161 exposed, and also, the retaining member 163 is kept in the releasing position. In this stage of the extraction, the relationship between the retaining member 163 and linking member 201 is as shown in FIGS. 25(*b*) and 25(*c*). In other words, the surface 163*d* of the retaining member 163 and the surface 201*a* of the linking member 201 are in contact with each other, as shown in FIG. 25(*c*).

FIG. 26(*b*) shows the state of the electrical contact protection mechanism, in which the releasing member 200 has come into contact with the guide 140L1 of the cartridge B, and has been made to retract into the recess of the guide 130L1 of the apparatus main assembly A. The releasing member 200 rotates, through the linking member 201, which has already been described, the movable member 162 in the arrow b direction, moving thereby the movable member 162 into the protective position in which the movable member 162 covers the development bias transmission electrical contact 161. As the releasing member 200 is moved into the position shown in FIG. 26(*b*), the retaining member 163 is moved into the retaining position. In this stage, the relationship between the retaining member 163 and linking member 201 is as shown in FIGS. 22(*b*) and 22(*c*). In other words, the linking member 201 has rotated upward, having thereby caused the surface 201*a* of the linking member 201 to disengage from the surface 163*d* of the retaining member 163, as shown in FIG. 22(*c*). As a result the retaining member 163 has been rotated by the elastic member 164 in the arrow a direction, causing thereby the retaining portion 163*c* to prevent the linking member 201 from moving.

In summary, this embodiment can yield the following effects.

1) Even if an operator inserts his hand into the image forming apparatus main assembly A to take care of a paper jam or the like problem after removing the process cartridge B from the image forming apparatus main assembly A, the hand does not easily come into contact with the electrical contact 161 on the main assembly side, because the electrical contact 161 is not projecting inward of the apparatus main assembly A. Therefore, it does not occur that a bad electrical connection occurs between the process cartridge B and apparatus main assembly A due to the adhesion of human sweat and/or the internal grease of the apparatus main assembly A to the electrical contact 161.

2) The electrical contact protecting movable member is moved by the movement of the cartridge B, making it unnecessary for an operator to perform an operation dedicated to the establishment of electrical connection between the cartridge B and apparatus main assembly A.

3) The apparatus main assembly A is provided with the retaining member 163 for preventing the movable member 162 from moving into the exposing position in which the movable member 162 keeps the electrical contact of the apparatus main assembly A exposed, while no cartridge B is in the apparatus main assembly A. In other words, in order for an operator to touch the electrical contact 161 of the apparatus main assembly A, the movable member 162 must be moved into the electrical contact exposing position while retaining the retaining member 163 in the releasing position. Therefore, even if an operator inserts his hand into the apparatus main assembly A in order to maintain the image forming apparatus, for example, to deal with paper jam or the like problem, it is far less likely for the hand of the operator to accidentally touch the electrical contact 161, compared to the case in which an operator inserts his hand into the main assembly of an image forming apparatus in accordance with the prior art.

6) The apparatus main assembly A and cartridge B are structured so that when the cartridge B is in the apparatus main assembly A, the rotational axis of the movable member 162 is parallel to the axial line of the photosensitive drum 107, and the movable member 162 is rotatable relative to the apparatus main assembly A; that when the cartridge B is in the apparatus main assembly A, the rotational axis of the development bias transmission electrical contact 161 as one of the electrical contacts on the main assembly side is parallel to the axial line of the photosensitive drum 107, and the development bias transmission electrical contact 161 rotates relative to the apparatus main assembly A; and that the movable member 162, and the development bias transmission electrical contact 161 as one of the electrical contacts of the main assembly A, are disposed in a manner of overlapping in the direction parallel to the aforementioned axial line, contributing to space saving.

Embodiment 3

Next, the third embodiment of the present invention will be described. The structure of the image forming apparatus 100 in this embodiment is similar to that of the image forming apparatus in the first and second embodiments described above. Here, therefore, only the structural features different from those of the image forming apparatus in the preceding embodiments will be described. Further, the components of the image forming apparatus in this embodiment, which are identical in structural feature and function to the counterparts in the preceding embodiments, will be given the same referential symbols so that the descriptions of the counterparts in the first and second embodiments can be referred to.

Figure 27:
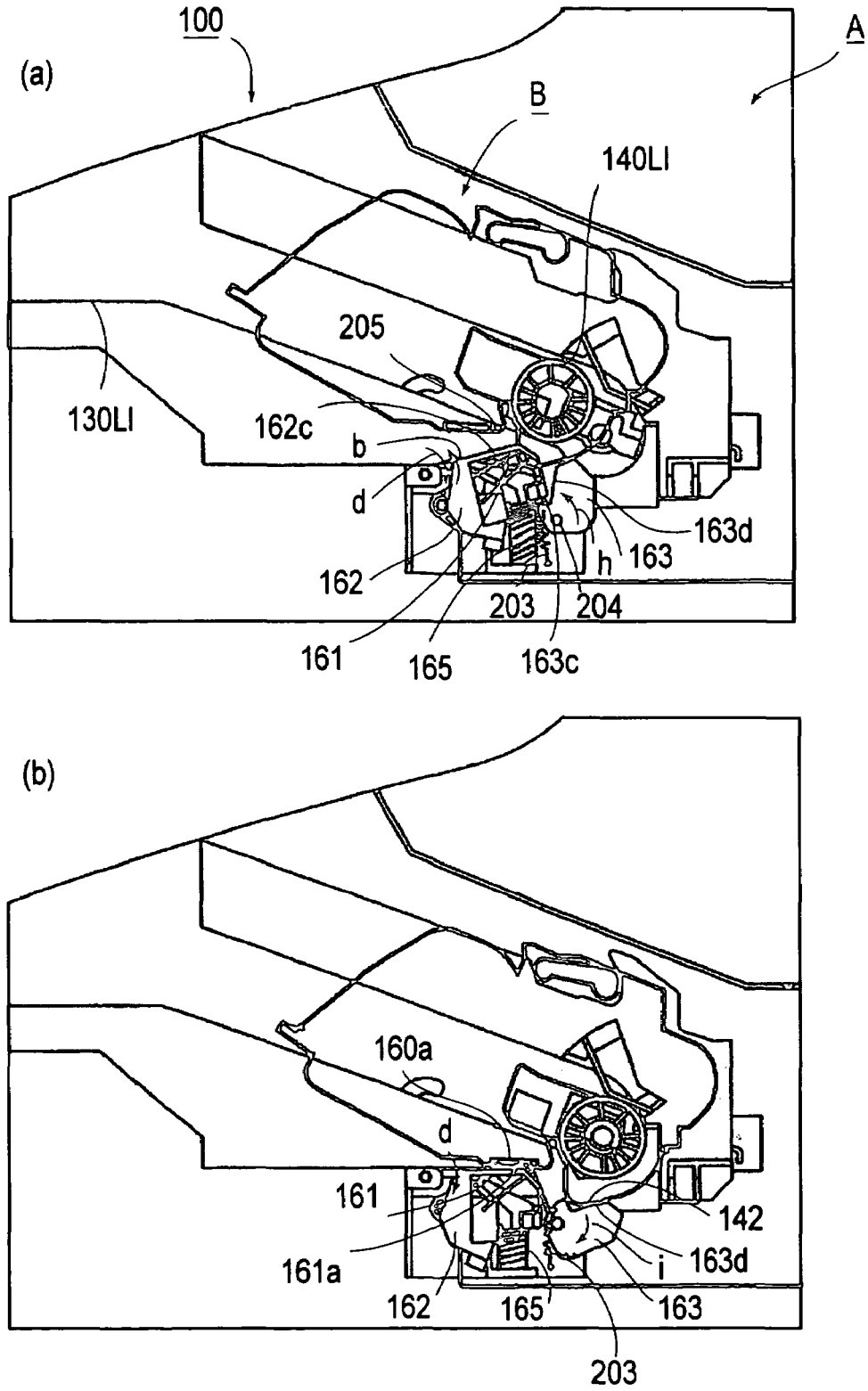
FIG. 27 is a schematic drawing the electrical contact protection mechanism, and its adjacencies, in the third embodiment of the present invention, showing the structures and movements thereof.

FIG. 27 is a schematic sectional view of the image forming apparatus 100 in this embodiment. It shows the image forming apparatus 100 as seen from the same direction as that from which the image forming apparatuses in the first and second embodiments are seen (from direction indicated by arrow mark Y in FIG. 18(*a*)).

The cartridge B is inserted into the apparatus main assembly A, with its guide 104L1 supported by the guide 130L1 of the apparatus main assembly A. FIG. 27(*a*) shows the state of the electrical contact protection mechanism, in the early stage of the cartridge insertion, in which the movable member 162 is in the protective position in which it covers the development bias transmission electrical contact 161, and is retained by the retaining member 163; the movable member 162 is prevented by the retaining portion 163*c* of the retaining member 163 from rotating in the arrow d direction. The retaining member 163 is kept pressured by the elastic member 203 to rotate about the shaft 204 in the direction indicated by an arrow mark h. Further, the movable member 162 is kept pressured by the elastic member 165 to rotate in the direction indicated by the arrow mark b.

FIG. 27(*b*) shows the state of the electrical contact protection mechanism, in which the cartridge has been moved into the image forming position. While the cartridge B was moved into the image forming position, the projection 142 of the cartridge B came into contact with the engaging portion 163*d* of the retaining member 163, rotating thereby the retaining member 163 in the direction indicated by an arrow mark i. When the cartridge B is in the image forming position (FIG. 27(*b*)), the engaging portion 163*d* and projection 142 remain in contact with each other. In other words, in this embodiment, the projection 142 has the functions of the first engaging portion and first retaining portion.

As the retaining member 163 is rotated in the arrow i direction, the movable member 162 is released by the retaining member 163, and the engaging portion 205 of the cartridge B engages with the surface 162*c* of the movable member 162, retaining thereby the movable member 162. In other words, the engaging portion 205 has the functions of the second engaging portion and second retaining portion, and the surface 162*c* of the movable member 162 is the surface by which the movable member 162 is retained by the second retaining portion. Shortly before the cartridge B has settled in this position, the actual contact portion 161*a* of the development bias transmission electrical contact 161 came into contact with the actual contact portion 160*a* of the development bias reception electrical contact 160, establishing electrical connection between the apparatus main assembly A and cartridge B. The image formation is carried out in this state. As the cartridge B is extracted from the apparatus main assembly A, the movable member 162 and retaining member 163 return to the positions shown in FIG. 27(*a*); the movable member 162 and retaining member 163 return to the protective and retaining positions, respectively.

Figure 28:
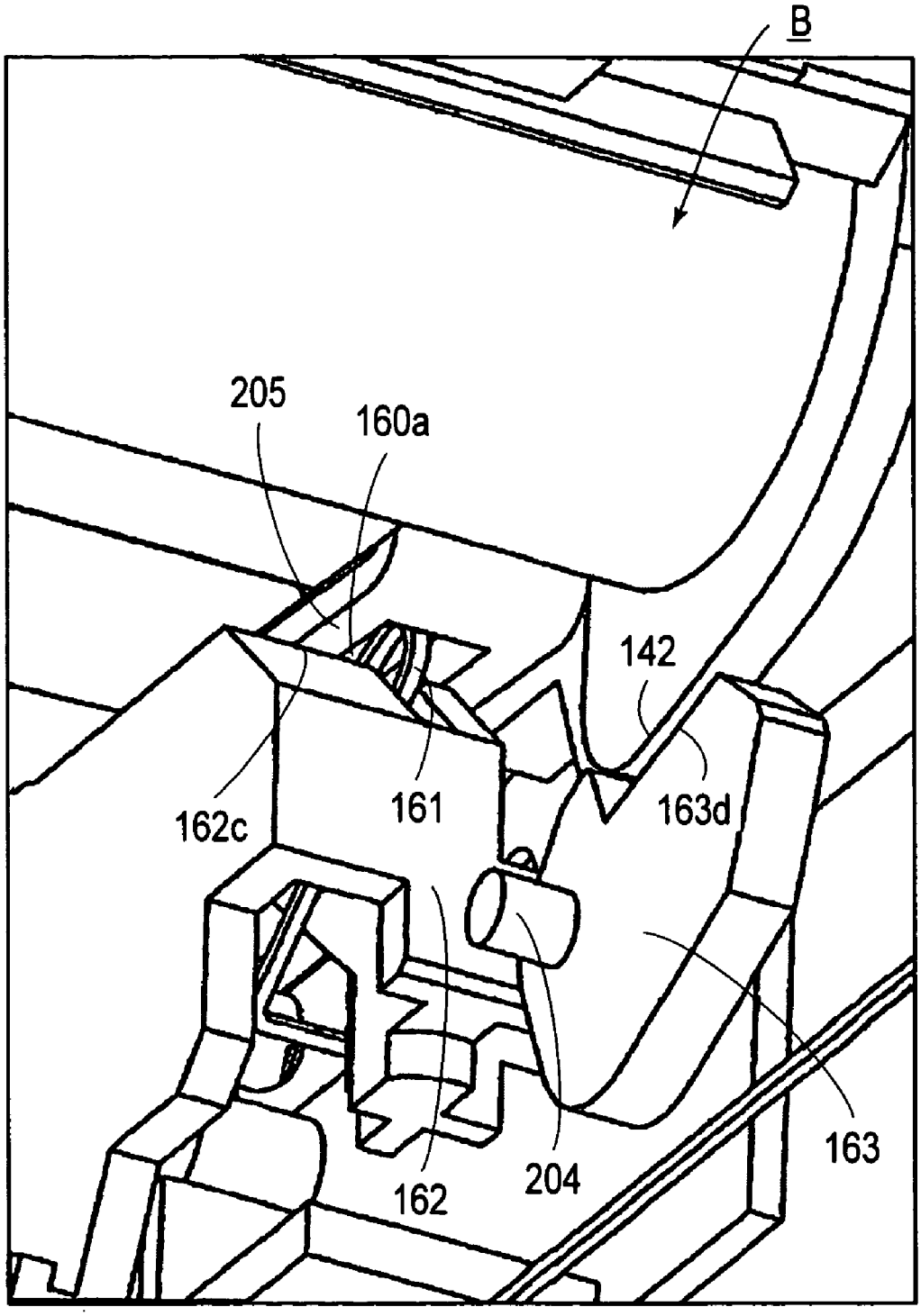
FIG. 28 is a perspective drawing depicting the structure of the electrical contact protection mechanism.

FIG. 28 is a perspective drawing depicting the states of the movable member 162 and retaining member 163 when the cartridge B is in the image forming position. When the cartridge B is in the image forming position, the projection 142 of the cartridge B is in contact with the engaging portion 163*d* of the retaining member 163, retaining thereby the retaining member 163 by the engaging portion 163*d*. Further, the engaging portion 205 of the cartridge B is in contact with the surface 162*c* of the movable member 162, retaining thereby the movable member 162 by the surface 162*c*. In this state, the development bias transmission electrical contact 161 and development bias reception electrical contact 160 are in contact with each other, maintaining electrical contact between the apparatus main assembly A and cartridge B.

With the employment of the above described structural arrangement, effects similar to those yielded by the second embodiment are yielded.

1) Even if an operator inserts his hand into the image forming apparatus main assembly A to take care of a paper jam or the like problem after removing the process cartridge B from the image forming apparatus main assembly A, the hand does not easily come into contact with the electrical contact 162 on the main assembly side, because the electrical contact 162 is not projecting inward of the apparatus main assembly A. Therefore, it does not occur that a bad electrical connection occurs between the process cartridge B and apparatus main assembly A due to the adhesion of human sweat and/or the internal grease of the apparatus main assembly A to the electrical contact 161.

2) The electrical contact protecting movable member is moved by the movement of the cartridge B, making it unnecessary for an operator to perform an operation dedicated to the establishment of electrical connection between the cartridge B and apparatus main assembly A.

3) The apparatus main assembly A is provided with the retaining member 163 for preventing the movable member 162 from moving into the exposing position in which the movable member 162 keeps the electrical contact of the apparatus main assembly A exposed, while no cartridge B is in the apparatus main assembly A. In other words, in order for an operator to touch the electrical contact 161 of the apparatus main assembly A, the movable member 162 must be moved into the electrical contact exposing position while retaining the retaining member 163 in the releasing position. Therefore, even if an operator inserts his hand into the apparatus main assembly A in order to maintain the image forming apparatus, for example, to deal with paper jam or the like problem, the hand of the operator is far less likely to accidentally touch the electrical contact 161, compared to the case in which an operator inserts his hand into the main assembly of an image forming apparatus in accordance with the prior art.

4) The apparatus main assembly A and cartridge B are structured so that when the cartridge B is in the apparatus main assembly A, the rotational axis of the movable member 162 is parallel to the axial line of the photosensitive drum 107, and the movable member 162 is rotatable relative to the apparatus main assembly A; that when the cartridge B is in the apparatus main assembly A, the rotational axis of the development bias transmission electrical contact 161 as one of the electrical contacts on the main assembly side is parallel to the axial line of the photosensitive drum 107, and the development bias transmission electrical contact 161 rotates relative to the apparatus main assembly A; and that the movable member 162, and the development bias transmission electrical contact 161 as one of the electrical contacts of the main assembly A, are disposed in a manner of overlapping in the direction parallel to the aforementioned axial line, contributing to space saving.

Embodiment 4

Next, the fourth embodiment of the present invention will be described.

(General Structure of Electrophotographic Image Forming Apparatus and Structure of Process Cartridge)

First, referring to FIGS. 33 and 34, the electrophotographic image forming apparatus employing a process cartridge removably mountable in the main assembly of the image forming apparatus will be described regarding its general structure, along with the structure of the cartridge.

Figure 33:
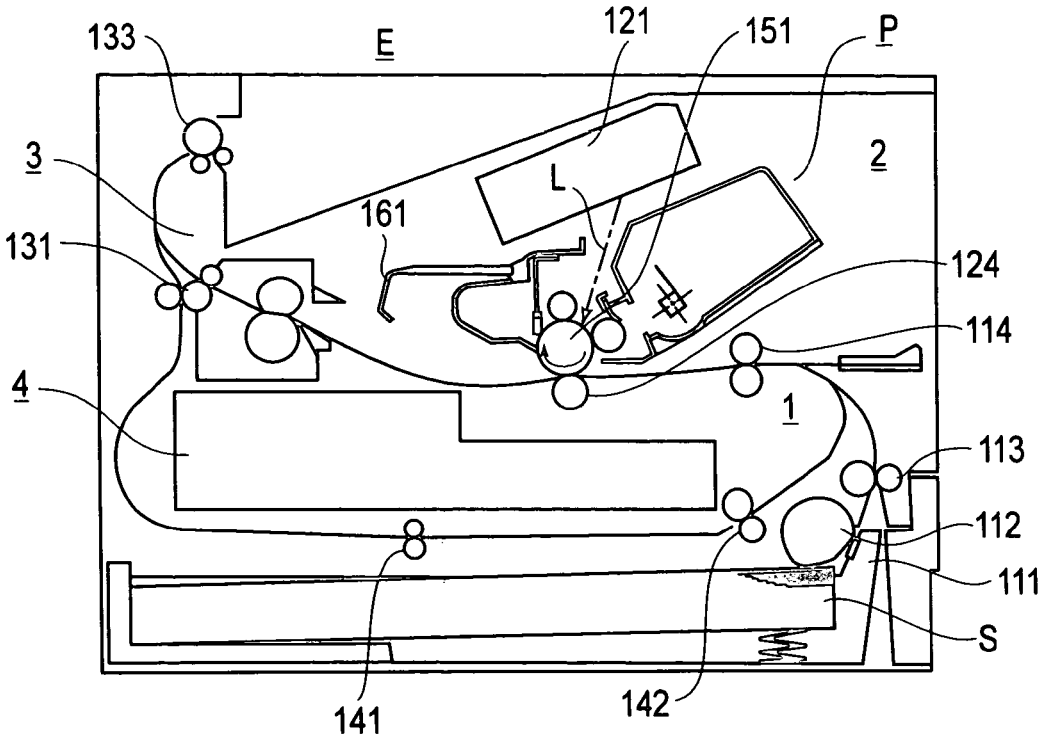
FIG. 33 is a schematic sectional view of the electrophotographic image forming apparatus (laser beam printer), showing the general structure thereof.
Figure 34:
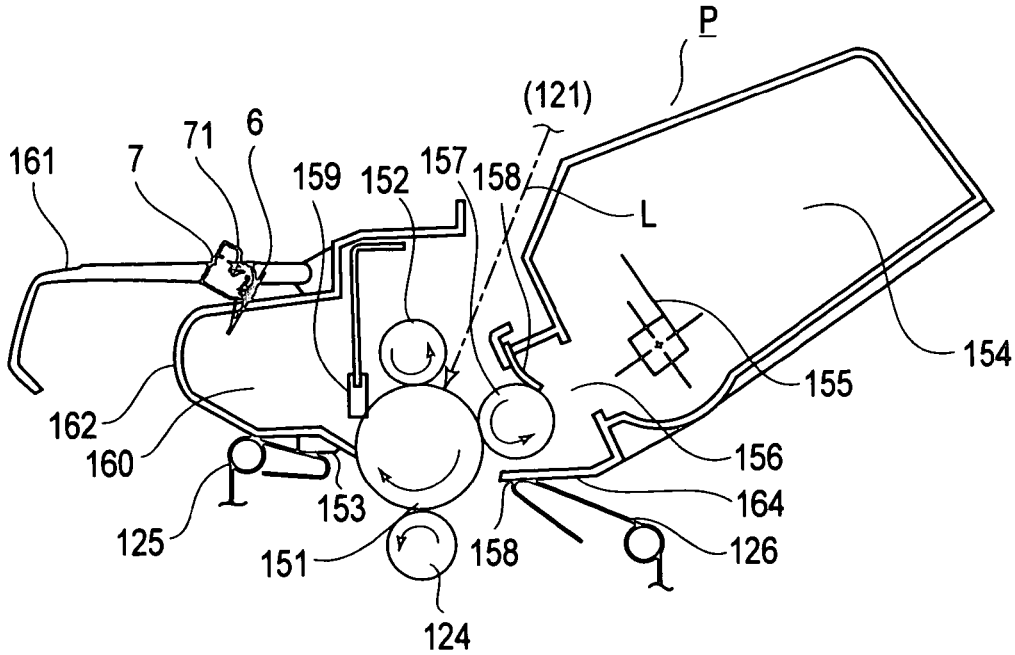
FIG. 34 is a schematic sectional view of the process cartridge removably mountable in the main assembly of the electrophotographic image forming apparatus, showing the general structures of the electrical contact protection mechanism of the process cartridge.

FIG. 33 is a schematic sectional view of the electrophotographic image forming apparatus (which in this embodiment is a laser beam printer), showing the general structure thereof, and FIG. 34 is a schematic sectional view of the process cartridge removably mountable in the main assembly of the image forming apparatus, and the electrical contacts thereof, showing the general structures thereof.

First, referring to FIG. 33, the general structure of the image forming apparatus will be described following the movement of a sheet of recording medium S in the apparatus main assembly. The laser beam printer E forms an image with the use of one of the electrophotographic image forming methods. A sheet of recording medium S is conveyed by a recording medium feeding and conveying means to an image forming means, and a toner image is transferred onto the sheet of recording medium S. Then, the sheet of recording medium S is conveyed to a fixing means, in which the toner image is fixed. Then, the sheet of recording medium S is discharged into a delivery tray portion. More specifically, a cassette 111 in which a plurality of sheets of recording medium S are stored in layers is mounted in the bottom portion of the main assembly of the image forming apparatus. The sheets of recording medium S stored in the cassette 111 of a recording medium feeding portion 1 are sequentially drawn out of the cassette 111 by a feed roller 112, starting from the topmost sheet, and are sent to an image forming portion 2 by a pair of conveyance rollers 113 and a pair of conveyance rollers 114. In the image forming portion 2, a beam of laser light is projected by a laser scanner 121, while being modulated with image formation data, onto the peripheral surface of the photosensitive drum 151 being rotated in the clockwise direction. As a result, an electrostatic latent image is formed on the peripheral surface of the photosensitive drum 151. This electrostatic latent image is developed with toner, in a developing portion in the process cartridge P; it is developed into an image formed of toner (which hereinafter will be referred to simply as toner image). This toner image is transferred, as an unfixed image, by a transfer roller 124 onto the sheet of recording medium S. Then, the sheet of recording medium S is sent to a fixing portion 3, through which the sheet of recording medium S is conveyed. While the sheet of recording medium S is conveyed through the fixing portion 3, the toner image is fixed to the sheet of recording medium S. Thereafter, the sheet of recording medium S is conveyed further, and is discharged from the main assembly of the image forming apparatus, by a pair of discharge rollers 133. Designated by a referential number 4 is an electrical portion comprising the electrical power source and the control circuit for controlling the image forming apparatus.

To describe the process of recording on both surfaces of the sheet of recording medium S, after the sheet of recording medium S, on the top surface of which an image has been formed, is passed through the fixing portion 3, it is switched back by the reversal driving of the pair of conveyance-discharge rollers 133 and the pair of conveyance rollers 131, and then, is conveyed by a pair of conveyance rollers 141 and a pair of conveyance rollers 142 to the image forming portion, for the second time. Then, an image is formed on the bottom side of the sheet of the recording medium S. Then, the sheet of recording medium S is discharged from the image forming apparatus.

Referring to FIG. 34, as for the process cartridge P, the photosensitive drum 151 is rotated, and as the photosensitive drum 151 is rotated, its peripheral surface is uniformly charged by the voltage applied to a charge roller 152 as a charging means. The voltage to be applied to the charge roller 152 is supplied to the charge roller 152 from the electrical portion 4 of the apparatus main assembly through the electrical contact 125 on the main assembly side, and the electrical contact 153 on the cartridge side. Next, a latent image is formed on the peripheral surface of the photosensitive drum 151 by projecting a beam of laser light L onto the peripheral surface of the photosensitive drum 151 from the laser scanner 121, while modulating it with image formation data. This latent image is developed by a developing means, which uses toner.

To describe in more detail, the charge roller 152 is disposed in contact with the photosensitive drum 151, and charges the photosensitive drum 151. The charge roller 152 is rotated by the rotation of the photosensitive drum 151. The developing means develops the latent image, formed on the photosensitive drum 151, by supplying with toner the portion of the peripheral surface of the photosensitive drum 151, which is in the development range.

The developing means sends the toner in the toner container 154 into the development chamber 156 by the rotation of a stirring member 155. It also rotates a development roller 157 in which a magnetic roller (stationary magnet) is disposed, and forms a layer of frictionally charged toner on the peripheral surface of the development roller 157, by a development blade 158. It develops the latent image on the photosensitive drum 157 by transferring the toner on the peripheral surface of the development roller 157 onto the peripheral surface of the photosensitive drum 151, in the pattern of the latent image, by applying voltage to the development roller 157; it develops the latent image into a visible image, that is, an image formed of toner. As for the application of voltage to the development roller 157, voltage is supplied from the electrical portion 4 of the apparatus main assembly to the development roller 157 through the development bias transmission electrical contact 126 on the main assembly side to the development bias reception electrical contact 158 on the process cartridge side. Not only does the development blade 158 regulate in amount the toner on the peripheral surface of the development roller 157, but also, it frictionally charges the toner on the peripheral surface of the development roller 157.

After the transfer of the toner image onto the sheet of recording medium S by the transfer roller 24, the photosensitive drum 151 is cleared by a cleaning means, of the toner remaining thereon. Then, the cleared portion of the peripheral surface of the photosensitive drum 151 is used for the following image formation process. The cleaning means scrapes down the toner remaining on the peripheral surface of the photosensitive drum 151, by its elastic cleaning blade 159 disposed in contact with the peripheral surface of the photosensitive drum 151, and collects the scraped toner into a waste toner bin 160.

The process cartridge P is provided with a memory tag 6 as an information storage medium, which is attached to the surface of the process cartridge P. The memory tag 6 communicates with the apparatus main assembly by being electrically connected to the electrical contact 71 with which the connector 7 of the main assembly is provided.

Designated by a referential numeral 161 is a drum shutter. When the process cartridge P is out of the apparatus main assembly, the drum shutter 161 is kept in the position in which it covers the hole of the process cartridge P, through which the photosensitive drum 151 is partially exposed, in order to protect the photosensitive drum 151. As the process cartridge P is mounted into the apparatus main assembly, the drum shutter 161 is moved into the open position and kept therein, allowing the photosensitive drum 151 to be exposed across the bottom area, as shown in FIGS. 33 and 34.

Next, the frame of the process cartridge P will be described. Referring to FIG. 34, the photosensitive drum 151, charge roller 152, cleaning means such as the elastic cleaning blade 159 or the like, are attached to a drum frame 162, that is, one of the sub-frames of the frame of the process cartridge P, making up the photosensitive member unit. The developing means unit is made up of the toner container 154, development roller 157, development blade 158, and the developing means supporting frame 164 to which the preceding components are attached. The photosensitive member unit and developing means unit are connected to each other with the use of connector pins (unshown), being enabled to be pivoted relative to each other. In other words, the process cartridge P is made up of the photosensitive member unit and developing means unit.

(Structural Arrangement for Mounting or Dismounting Process Cartridge, and Process Cartridge Compartment)

Figure 35:
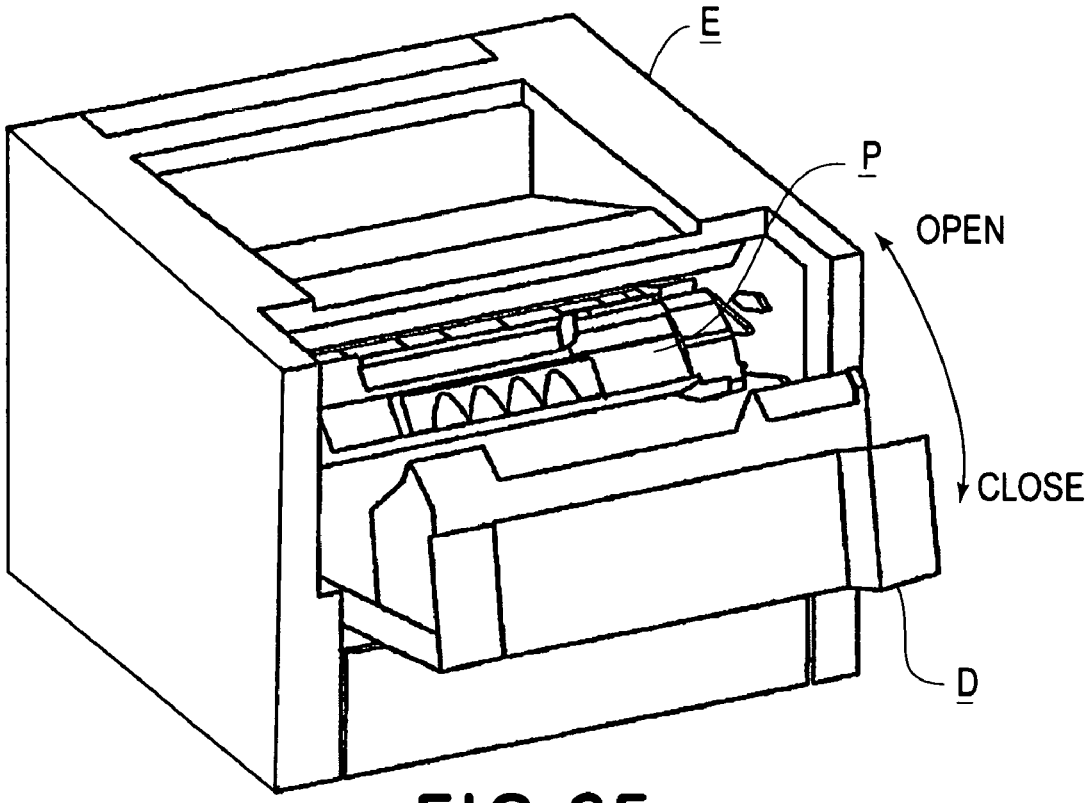
FIG. 35 is a perspective view of the electrophotographic image forming apparatus, the cartridge access door of which is open for mounting or dismounting the process cartridge.
Figure 36:
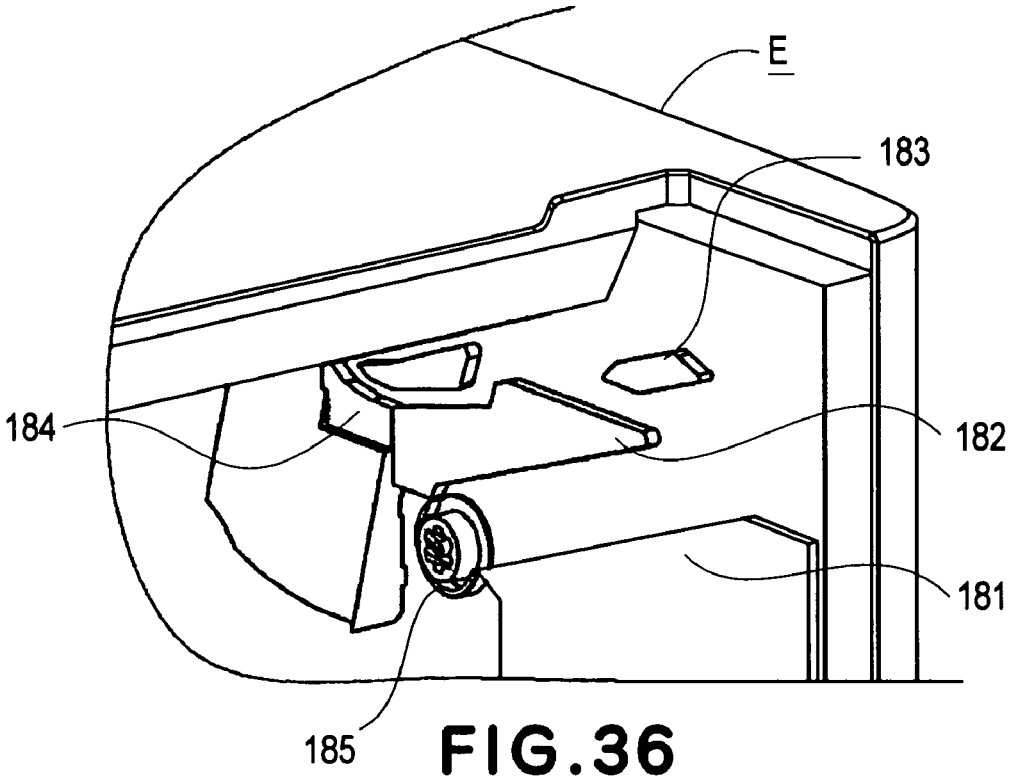
FIG. 36 is a perspective view of one of the lengthwise ends of the top end portion of the apparatus main assembly, showing the process cartridge mounting means of the apparatus main assembly (No. 1).
Figure 37:
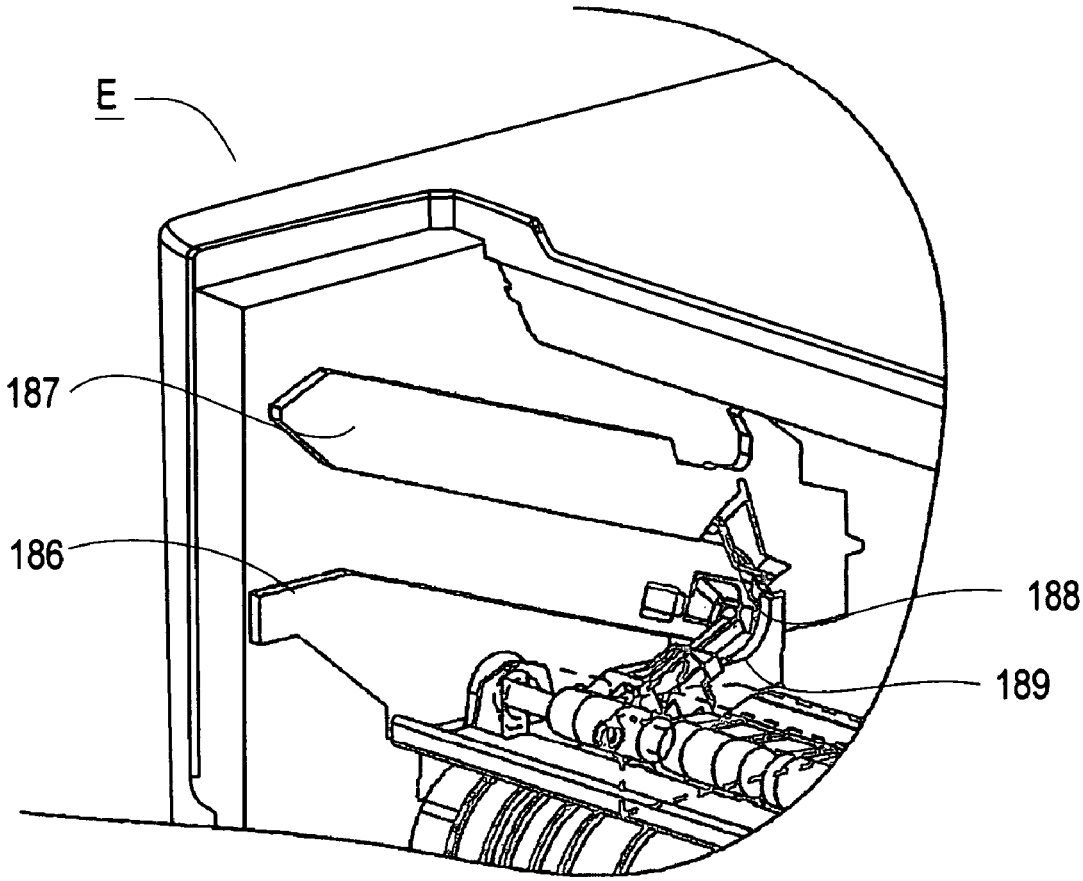
FIG. 37 is a perspective view of the other lengthwise end of the top end portion of the apparatus main assembly, showing the process cartridge mounting means of the apparatus main assembly (No. 2).
Figure 38:
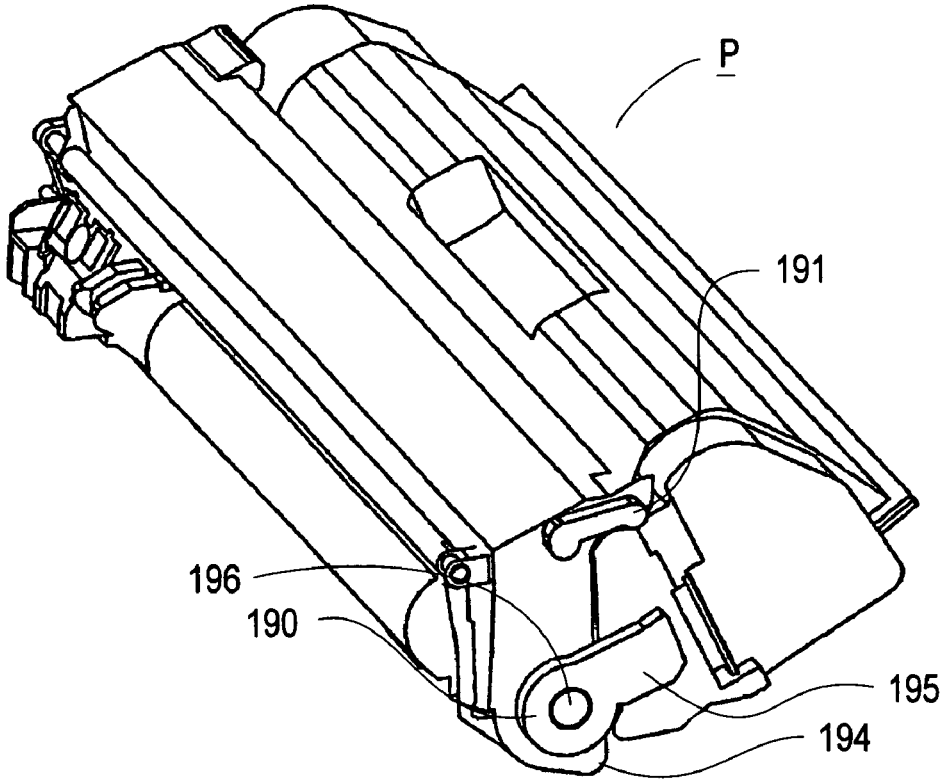
FIG. 38 is a schematic perspective view of the process cartridge (No. 1).
Figure 39:
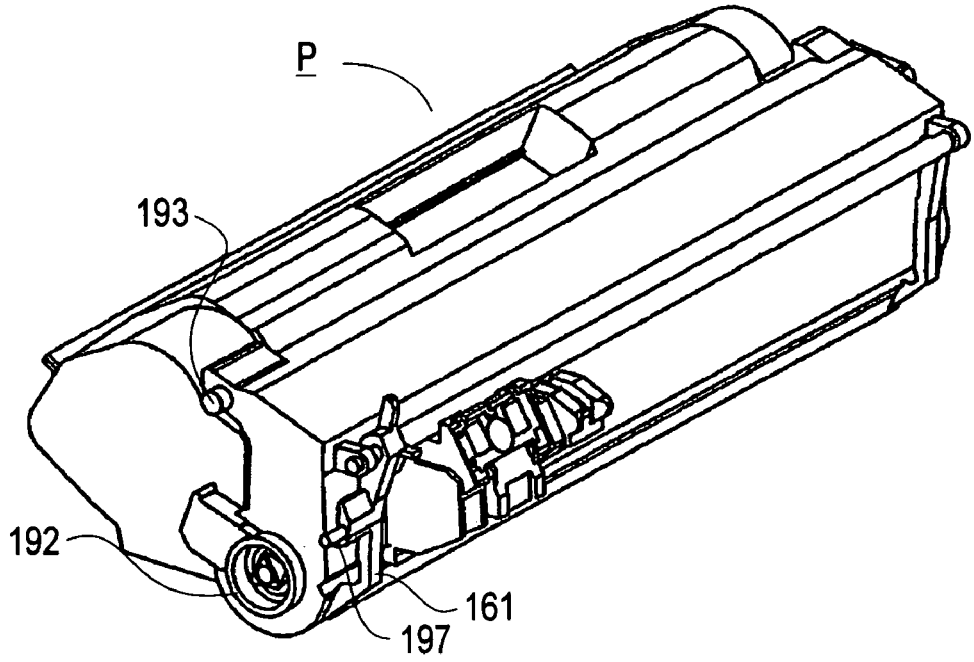
FIG. 39 is a schematic perspective view of the process cartridge (No. 2).

Referring to FIGS. 35-39, the guides for mounting or dismounting the process cartridge P, and the process cartridge compartment, will be described regarding their structures. FIG. 35 is a perspective view of the main assembly of the image forming apparatus, the cartridge access door of which is open for mounting or dismounting the process cartridge, showing the general structure thereof. FIGS. 36 and 37 are perspective views of the process cartridge compartment of the apparatus main assembly, showing the process cartridge mounting (dismounting) means of the apparatus main assembly. FIGS. 38 and 39 are schematic perspective views of the process cartridge.

In order to mount the process cartridge P into the apparatus main assembly E, the cartridge access door D (FIG. 35) of the apparatus main assembly E must be opened by a user, and then, the process cartridge P is to be placed on the cartridge mounting means of the apparatus main assembly E so that the process cartridge P is removably mounted into the cartridge compartment of the apparatus main assembly E.

First, the guiding members or the like with which the process cartridge P is provided will be described. The process cartridge P is provided with a pair of guiding members 190 and 191 (FIGS. 38 and 39), which are roughly cylindrical and project from the end surfaces of the process cartridge P, one for one. The process cartridge P is also provided with a rotation control projections 191 and 193, which are also on the end surfaces of the process cartridge P, one for one, being located so that when the process cartridge P is in the apparatus main assembly E, they will be at the top edge of the end surfaces of the process cartridge P.

Next, the guiding members with which the apparatus main assembly E is provided will be described. The apparatus main assembly E is provided with guiding members 181-189 (FIGS. 36 and 37). The guiding members 181 and 186 are tilted relative to the direction in which the process cartridge P is inserted into the apparatus main assembly E, and are connected to the guiding portions 185 and 189, respectively. When the process cartridge P is inserted into the apparatus main assembly E, the guiding portions 192 and 190 of the process cartridge P are engaged with the guiding members 181 and 186, respectively. The guiding members 183, 182, and 187 are also tilted relative to the direction in which the process cartridge P is mounted into the apparatus main assembly E. When the process cartridge P is inserted into the apparatus main assembly E, the rotation control projections 191 and 193 of the process cartridge P are engaged with the guiding members 183, 182, and 187, respectively. The drum shutter 161 is opened or closed as the cylindrical portion 197 (FIG. 39) is guided by the guiding portions 182 and 184 of the apparatus main assembly E.

The engaging portion 194 and retaining portion 195 of the process cartridge P, which will be described later in detail, have the functions of moving the retaining member and movable member, respectively, of the apparatus main assembly E.

(Structure of Electrical Contact Protection Mechanism)

Figure 40:
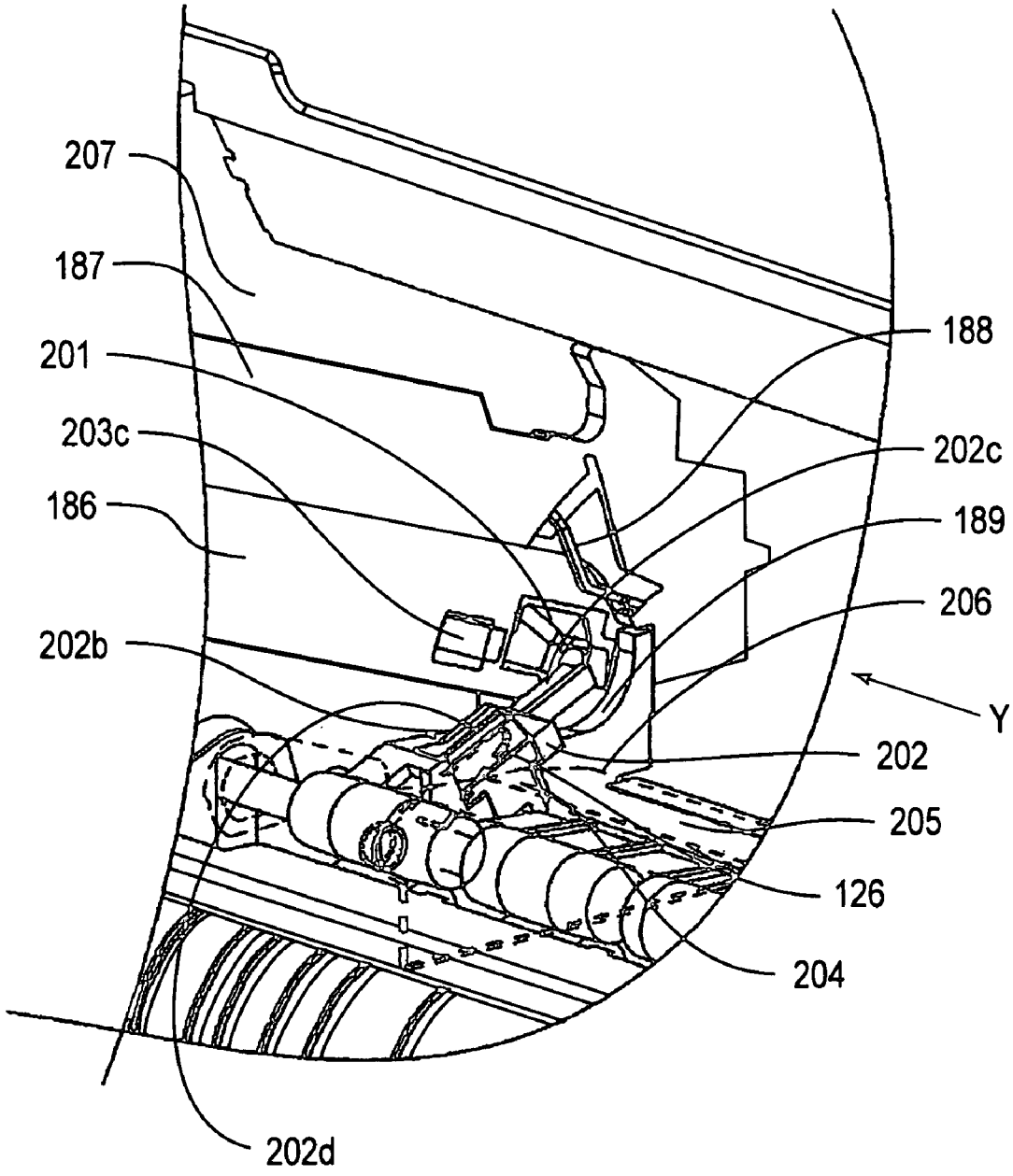
FIG. 40 is a schematic perspective view of the electrical contact protection mechanism of the apparatus main assembly (before mounting of cartridge).
Figure 41:
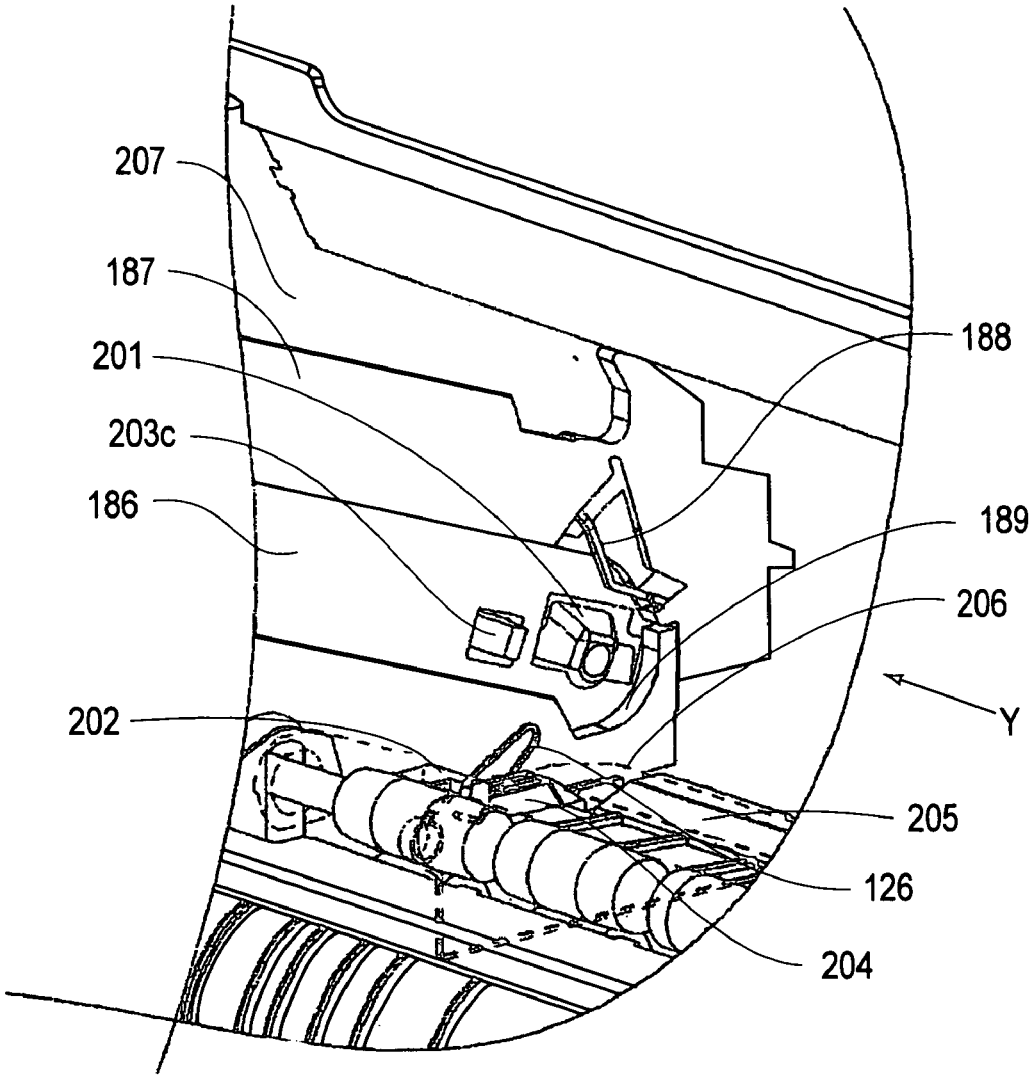
FIG. 41 is a schematic perspective view of the electrical contact protection mechanism of the apparatus main assembly (after mounting of cartridge).
Figure 42:
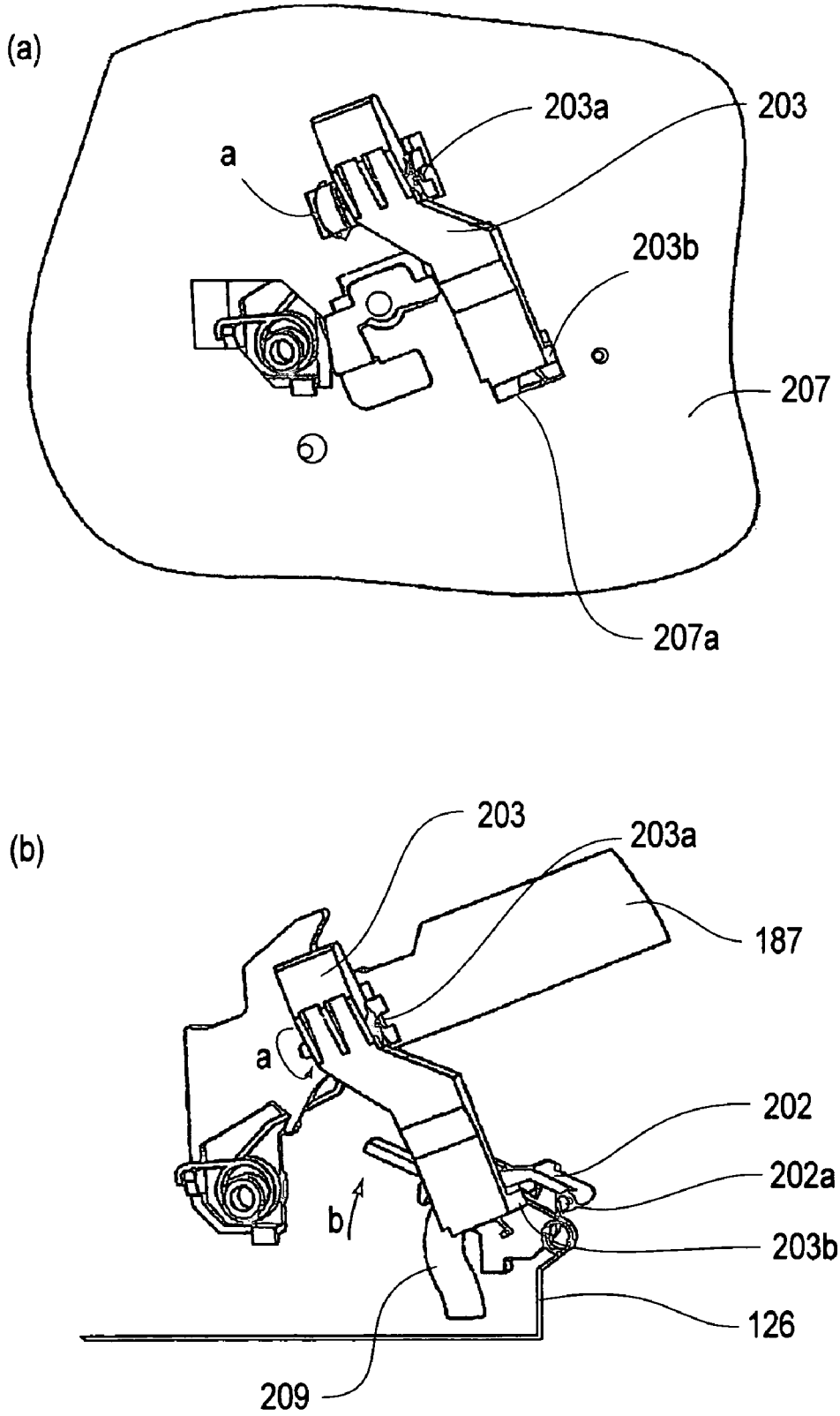
FIG. 42 is a drawing of the electrical contact protection mechanism of the apparatus main assembly, as seen from the opposite direction from the direction in which it is seen in FIG. 40.

Next, the electrical contacts of the main assembly of the electrophotographic image forming apparatus, and the structure of the mechanism for protecting the electrical contacts, will be described in detail. FIGS. 40-42 are perspective views of various portions of the apparatus main assembly of the electrophotographic image forming apparatus, showing the structures thereof. They are the internal views of the cartridge compartment of the apparatus main assembly E as seen through the opening through which the process cartridge P is to be mounted or dismounted. FIG. 40 is a perspective view of the cartridge compartment in which the process cartridge P is not present, and FIG. 41 is a perspective view of the cartridge compartment in which the process cartridge P is present, although the process cartridge P is not shown. Referring to FIG. 40, the apparatus main assembly E is provided with guides 186 and 187 for facilitating the mounting of the process cartridge P. It is also provided with a retainer spring 188 for keeping the process cartridge P in place after the mounting of the process cartridge P into the apparatus main assembly E, and grounding contact 201 which is placed in contact with the drum shaft 196 (FIG. 38) to ground the photosensitive drum 151. In addition, the apparatus main assembly E has: a movable member 202 movable between the protective position in which it covers a development bias transmission electrical contact 126 (FIG. 40 (broken line)) as one of the electrical contacts on the main assembly side, and the exposing position (FIG. 41) in which it exposes the electrical contact 126; a retaining member 203 (FIG. 42) for retaining the movable member 202; and an electrically conductive member 204 attached to the movable member 202 and movable with the movable member 202.

The electrically conductive member 204 is disposed next to the electrical contact 126. It is disposed inside the cartridge compartment of the apparatus main assembly.

Further, the apparatus main assembly E is provided with a conveyance guide (bottom) 205 and a conveyance guide (top) 206 (outlined by broken lines in FIGS. 40 and 41), which constitute parts of the recording medium path. These guides 205 and 206 are always grounded, and so is an internal plate 207, which is located on the inward side of the electrical contact 126 when the cartridge compartment is seen through the opening of the apparatus main assembly E.

Next, the structures of the movable member 202, electrically conductive member 204, and retaining member 203 will be described in more detail. Referring to FIG. 42, the movable member 202 is rotatably supported by a shaft 202*a*, and is kept pressured by a spring to rotate into the protective position shown in FIG. 40. The conductive member 204 is attached to the movable member 202. All that is necessary to move the movable member 202 and electrically conductive member 204 into the exposing position (FIG. 41) in which the movable member 202 exposes the electrical contact 126 is to mount the process cartridge P into the apparatus main assembly E. As for the process of mounting the process cartridge P into the apparatus main assembly E, which will be described again later, while the process cartridge P is mounted into the apparatus main assembly E, the engaging portion 194 (FIG. 38) of the cartridge P engages with the engaging portion 202*b*, which is a part of the movable member 202 (FIG. 40). As the cartridge P is mounted into the image forming position, the engaging portion 194 (FIG. 38) of the cartridge P comes into contact with the surface area 202*c* of the movable member 202, retaining thereby the movable member 202 and electrically conductive member 204 in the exposing position (FIG. 41), in which the movable member 202 allows the electrical contact 126 to be exposed through the slit 202*d* of the movable member 202. The internal plate 207 is provided with a hole 207*a*, through which the engaging portion 203*b* of the retaining member 203 for retaining the movable member 202 is allowed to partially project into the cartridge compartment (FIG. 42). FIG. 42 is a perspective view of the electrical contact protection mechanism as seen from the direction opposite to the direction from which the cartridge compartment is seen in FIG. 40. Referring to FIG. 42(*a*), the retaining member 203 is rotatably supported by a shaft 203*a*, and is kept pressured in the direction indicated by an arrow mark a by an elastic member (unshown) disposed between the remaining member 203 and internal plate 207. Thus, the engaging portion 203*b* of the remaining member 203 is made to slip into the underside of the movable member 202, preventing thereby the movable member 202 from rotating into the exposing position, as will be understood from FIG. 42(*b*).

(Description of Structure and Movements of Electrical Contact Protection Mechanism)

Next, the movements of the electrical contact protection mechanism will be described in detail. FIGS. 29-32 are schematic drawings for describing the movements of the electrical contact protection mechanism, which occur as the cartridge P is inserted (advanced) into the apparatus main assembly E.

Figure 29:
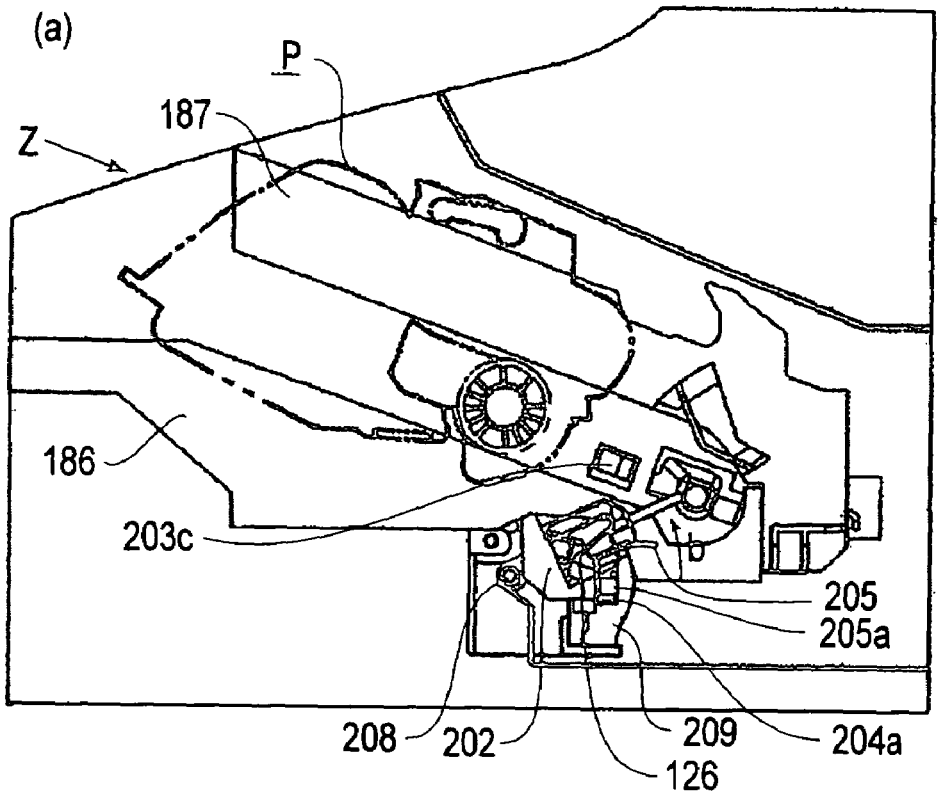
FIG. 29 is a schematic drawing depicting the movements of the electrical contact protection mechanism, which occur as the process cartridge is mounted into the apparatus main assembly (No.1).
Figure 29:
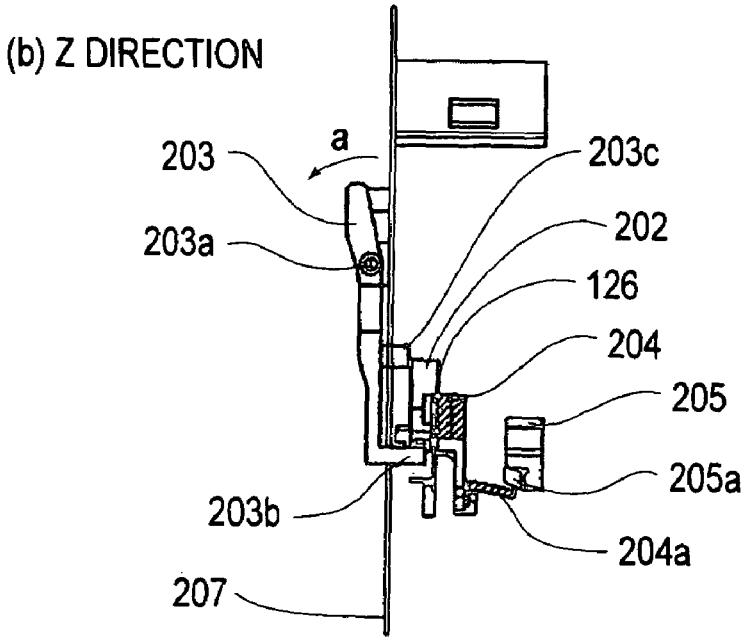

FIGS. 29(*a*), 30(*a*), 31(*a*), and 32(*a*) are drawings of the electrical contact protection mechanism, and the components related thereto, as seen from where the guiding members 181 and 182 of the apparatus main assembly E are present, toward the internal plate 207 (as seen from direction indicated by arrow mark Y in FIG. 40). FIGS. 29)*b*), 30(*b*), 31(*b*), and 32(*b*) are drawings of the same portions as those shown in FIG. 29(*a*), 30(*a*), 31(*a*), and 32(*a*), as seen from the direction indicated by an arrow mark Z. In FIGS. 29(*a*), 30(*a*), 31(*a*), and 32(*a*), the cartridge P is outlined in the broken line for ease of understanding. Further, for the purpose of showing the development bias transmission electrical contact 161, a part of the movable member 202 and a part of the conductive member 204, are not shown. Further, In FIGS. 29(*b*)-32(*b*), the conductive member 204 are hatched for ease of understanding. The development bias transmission electrical contact 126 is supported by a shaft 208, being thereby rendered rotatable.

FIGS. 29(*a*) and 29(*b*) show the states of the electrical contact protection mechanism and its adjacencies, during or prior to the mounting of the cartridge P into the apparatus main assembly A. The movable member 202 and conductive member 204 are in the position in which they cover the development bias transmission electrical contact 126, and the retaining member 203 is in the position in which it retains the movable member 202. The springy portion 204*a* of the conductive member is kept pressed upon the conductive member seat portion 205*a* of the conveyance guide (bottom) 205, grounding thereby the conductive member 204. With the springy portion 204*a* being resiliently bent, a predetermined amount of contact pressure is present. The movable member 202 is kept pressured in the direction indicated by an arrow mark b by the elastic member 209. As described above, the retaining member 203 is kept pressured in the arrow a direction by an elastic member (unshown). Thus, the engaging portion 203*c* of the retaining member 203 is projecting into the cartridge compartment through the hole 207*a* of the internal plate 207 as shown in FIG. 42, having slipped into the underside of the movable member 202, preventing thereby the movable member 202 and conductive member 204 from rotating.

With the employment of the above described structural arrangement, if the hand of a user, which has accumulated static electricity prior to the insertion of the cartridge P, is placed in the adjacencies of the electrical contact 126, the static electricity of the hand is discharged to the conductive member 204, and therefore, it does not discharge to the electrical contact 126.

Figure 30:
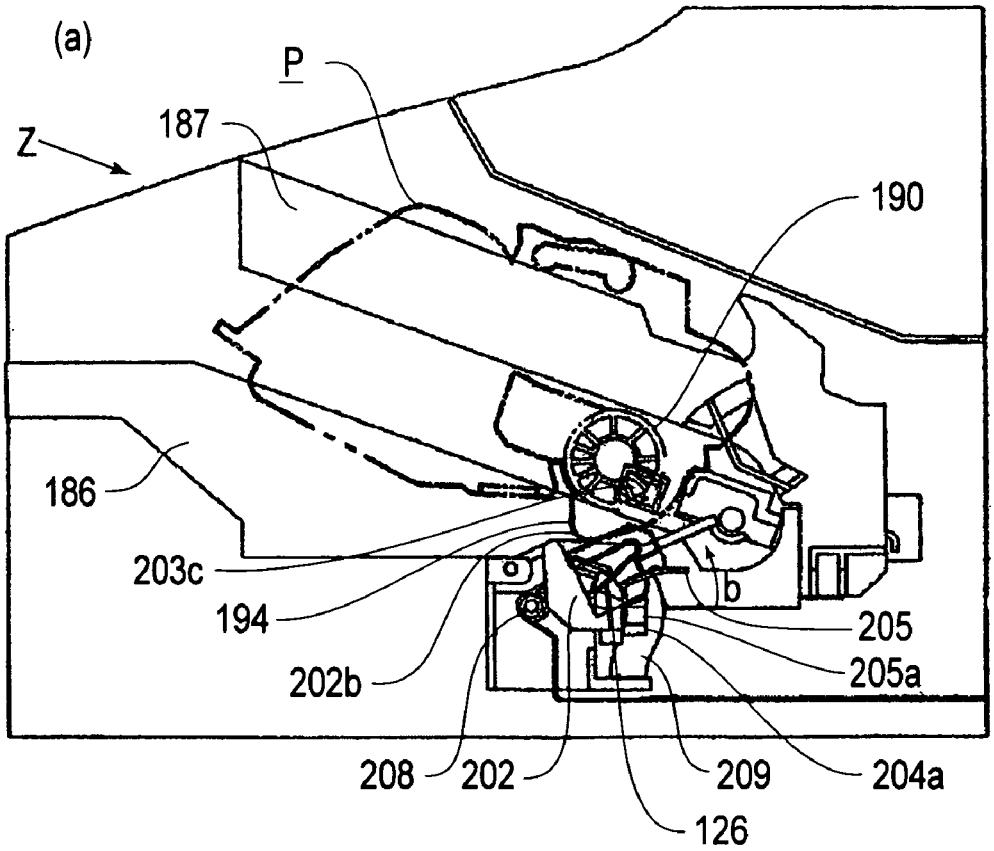
FIG. 30 is a schematic drawing depicting the movements of the electrical contact protection mechanism, which occur as the process cartridge is mounted into the apparatus main assembly (No.2).
Figure 30:
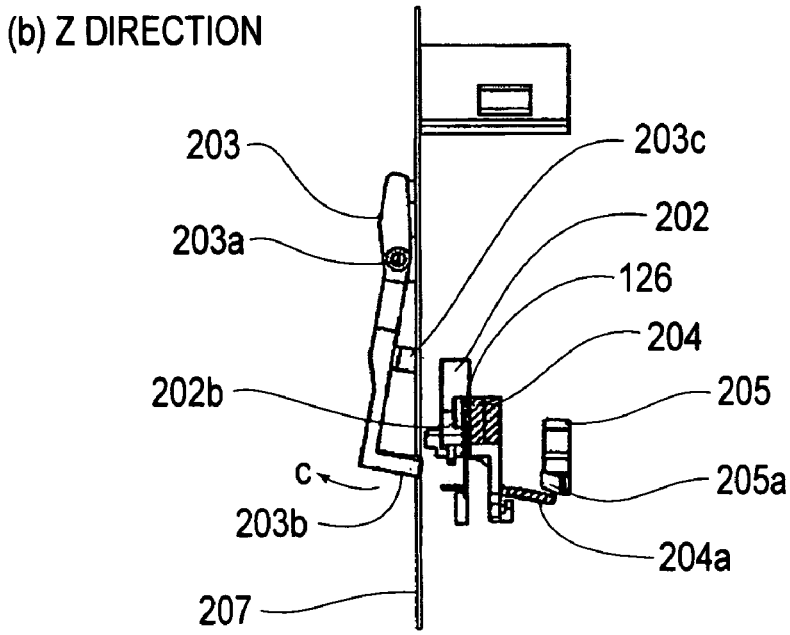

FIGS. 30(*a*) and 30(*b*) show the states of the electrical contact protection mechanism, in which the cartridge P has been advanced deeper in the apparatus main assembly E from the position shown in FIGS. 29(*a*) and 29(*b*), respectively. They show the very moment when the engaging portion 194 of the cartridge P has just engaged with the engaging portion 202*b* of the movable member 202 of the apparatus main assembly E (FIG. 30(*a*)). In this state, the projection 203*c* of the retaining member 203 has come into contact with the end surface of the guiding portion 190, being thereby pressed by the guiding portion 190. As a result, the retaining member 203 has rotated about the shaft 203*a* in the direction indicated by an arrow mark c, having been thereby moved into the releasing position (FIG. 30(*b*)). When the retaining member 203 is in the releasing position, the engaging portion 203*b* of the retaining member 203 is away from the position in which it prevents the movable member 202 from rotating. Therefore, the movable member 202 is allowed to rotate. In other words, when the retaining member 203 is in the releasing position, it allows the movable member 202 to rotate. The elastic member for pressing the retaining member 203 is disposed in the compressed state.

Figure 31:
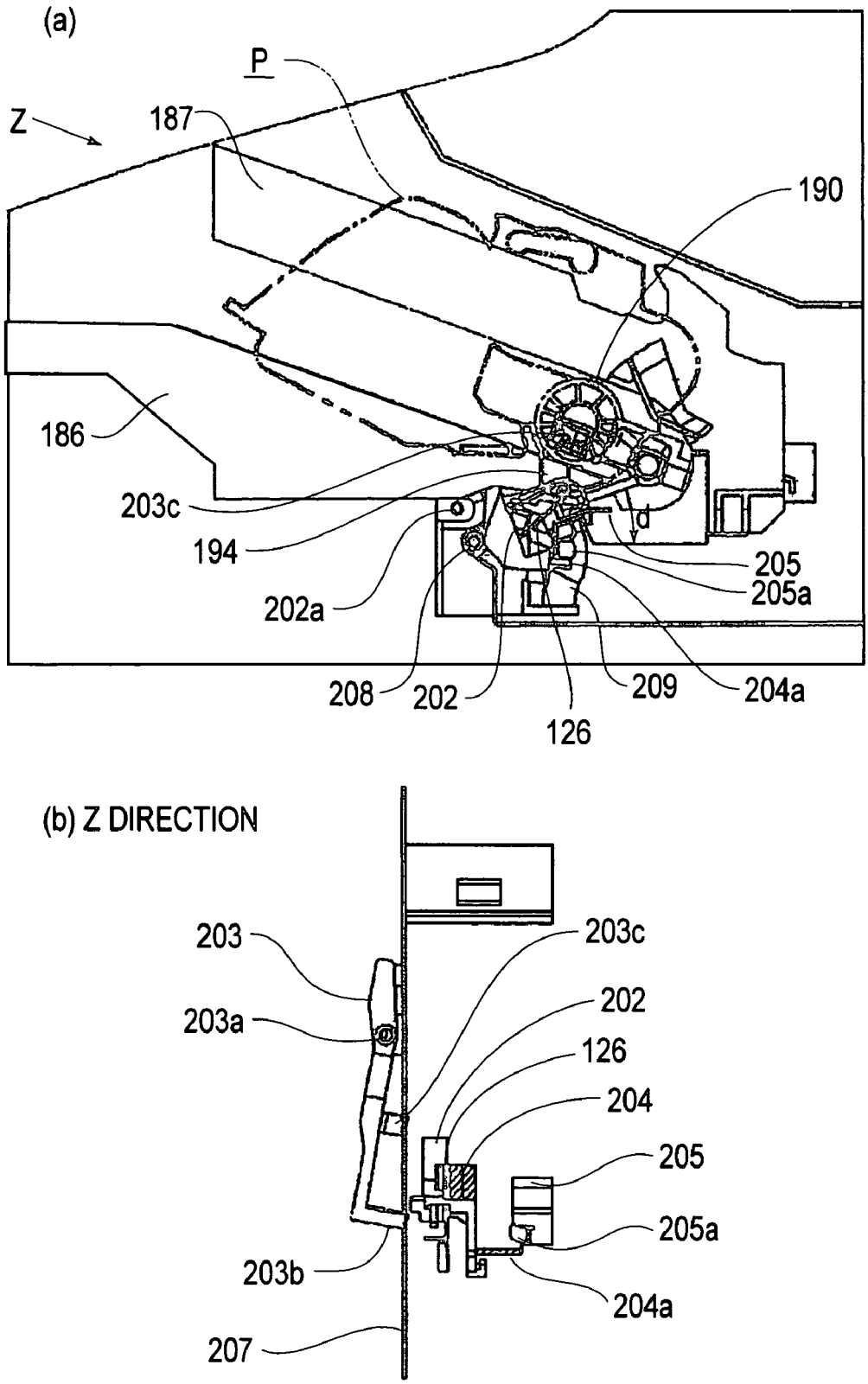
FIG. 31 is a schematic drawing depicting the movements of the electrical contact protection mechanism, which occur as the process cartridge is mounted into the apparatus main assembly (No.3).

FIGS. 31(*a*) and 31(*b*) show the state of the electrical contact protection mechanism and its adjacencies, in which the cartridge P has been advanced even further into the apparatus main assembly E from the position shown in FIGS. 30(*a*) and 30(*b*), respectively. The retaining member 203 is kept in the same attitude as that shown in FIGS. 30(*a*) and 30(*b*), by the end surface of the guiding portion 190 of the cartridge P. As for the movable member 202, it is pressed by the engaging portion 194, being therefore rotated in the direction indicated by an arrow mark d about the shaft 202*a*, against the resiliency of the elastic member 209.

Figure 32:
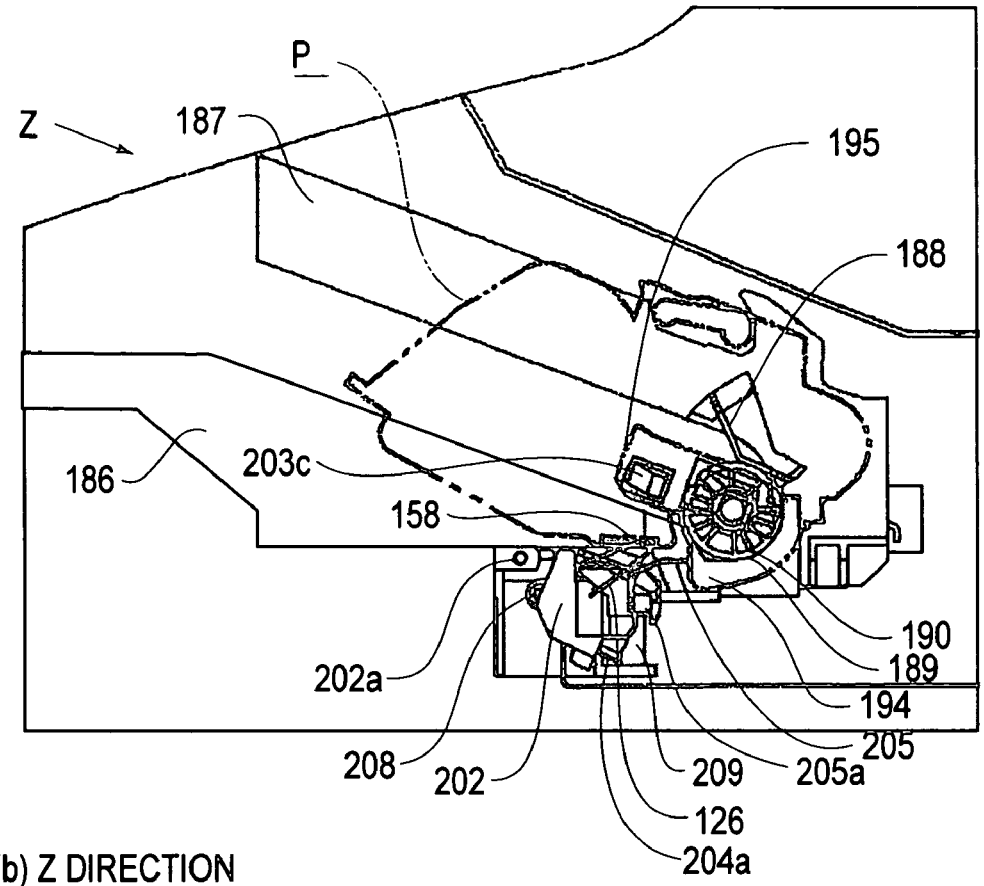
FIG. 32 is a schematic drawing depicting the movements of the electrical contact protection mechanism, which occur as the process cartridge is mounted into the apparatus main assembly (No.4).
Figure 32:
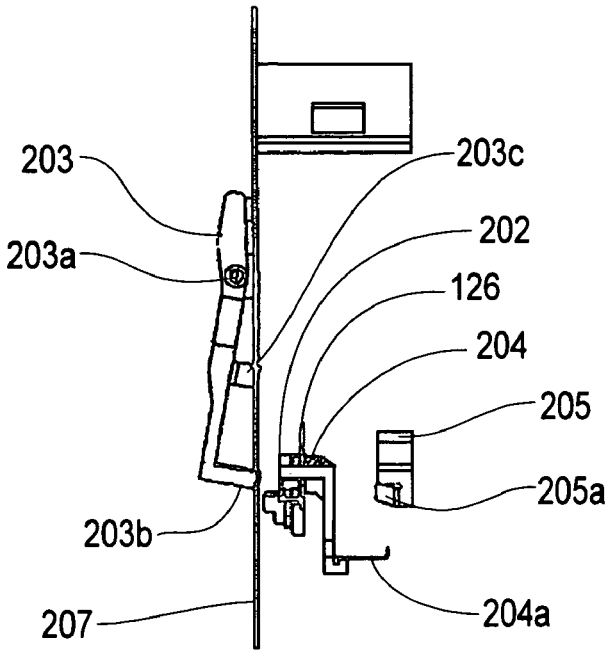

FIGS. 32(*a*) and 32(*b*) show the state of the electrical contact protection mechanism, in which the cartridge P has been inserted into the image forming position. In this state, the guiding portion 190 is engaged with the positioning portion 189 of the guiding portion of the apparatus main assembly E, being precisely positioned relative to the apparatus main assembly E. As for the top portion of the guiding portion 190, it is in contact with a retainer spring 188, being thereby pressured downward by the spring 188. The retaining member 203 is held by the retaining portion 195 (FIG. 38) of the cartridge P, by its engaging portion 203*c*. Further, the movable member 202 and conductive member 204 are retained by the engaging portion 194, in the exposing position in which they keep the development bias transmission electrical contact 126 exposed. As the cartridge P is inserted into this position, the springy portion 204*a* of the conductive member 204 is separated from the conductive member seat portion 205*a* of the conveyance guide (bottom) 205, ceasing thereby the grounding of the conductive member 204. Further, the development bias transmission electrical contact 126 comes into contact with the development bias reception electrical contact 158, establishing electrical connection between the apparatus main assembly E and the cartridge P. The image forming operation is carried when the cartridge P is in this state. When the development bias transmission electrical contact 126 becomes electrically connected to the electrical contact 158 of the cartridge P, high voltage with a voltage level of several thousands is applied from the electrical power source on the main assembly side. Although the development bias transmission electrical contact 126 and conductive member 204 are disposed close to each other, it is ensured that the conductive member 204 remains electrically separated from the conveyance guide (bottom) 205 (grounded).

In summary, this embodiment of the present invention can yield the following effects.

1) If a user looks into the cartridge compartment of the image forming apparatus, while standing in the position in which the user mounts the process cartridge into the apparatus main assembly E, when the process cartridge is not in the main assembly of the image forming apparatus, the electrical contact 126 is directly behind the conductive member 204. Thus, even if the hand of a user has static electricity when an operator inserts his hand into the adjacencies of the electrical contact 126 in the image forming apparatus main assembly E to take care of a paper jam or the like problem after removing the process cartridge P from the image forming apparatus main assembly A, the static electricity discharges to the conductive member 204. Therefore, it does not occur that electrostatic noises are applied to the electrical contact 126 of the image forming apparatus main assembly. Therefore, it does not occur that the elements of the electrical circuit are affected by the static electricity.

2) While the process cartridge is in the main assembly of the image forming apparatus, the conductive member 204 is not grounded, being thereby definitely electrically separated from the grounded components. Therefore, the process cartridge and image forming apparatus in this embodiment are superior to a process cartridge and an image forming apparatus in accordance with the prior art, in terms of the reliability of the connection between the electrical contact of the apparatus main assembly and the electrical contact of the process cartridge, and also, in the supplying of electrical power from the electrical contact of the apparatus main assembly to the electrical contact of the process cartridge.

3) The conductive member is moved by the movement of the process cartridge, which occurs as the process cartridge is mounted or dismounted. Therefore, it is unnecessary for a user to carry out an operation dedicated to the movement of the conductive member.

Embodiment 5

Next, the fifth embodiment of the present invention will be described. The components in the fifth embodiment similar in structure and function to those in the fourth embodiment will be given identical referential symbols as those given for the description of the fourth embodiment, and will not be described. In other words, this embodiment will be described only regarding its features that characterize this embodiment.

(Description of Structure and Movements of Electrical Contact Protection Mechanism)

Figure 43:
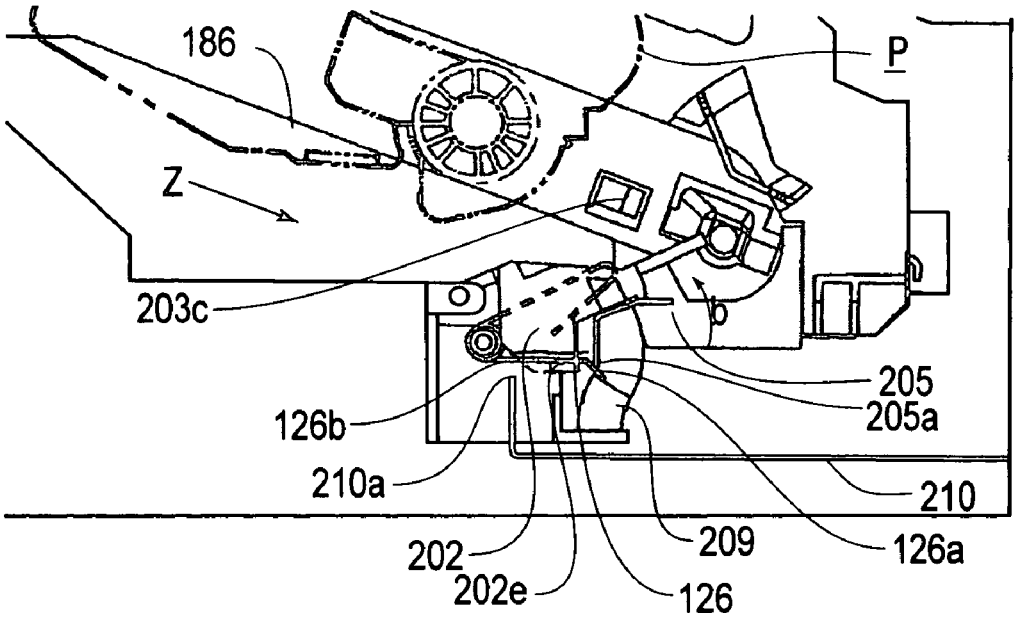
FIG. 43 is a schematic drawing of the electrical contact protection mechanism, showing the movements thereof during one of the steps of the cartridge insertion sequence in the fifth embodiment of the present invention (No. 1).
Figure 43:
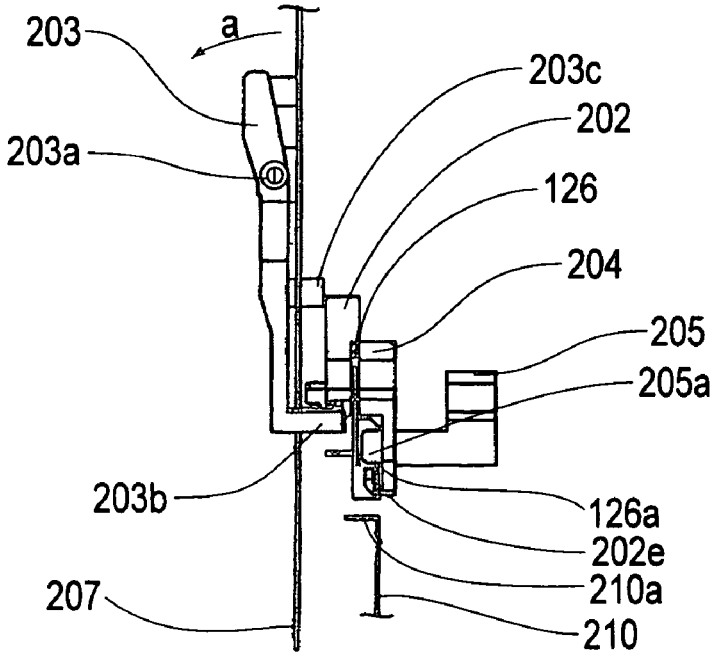
Figure 44:
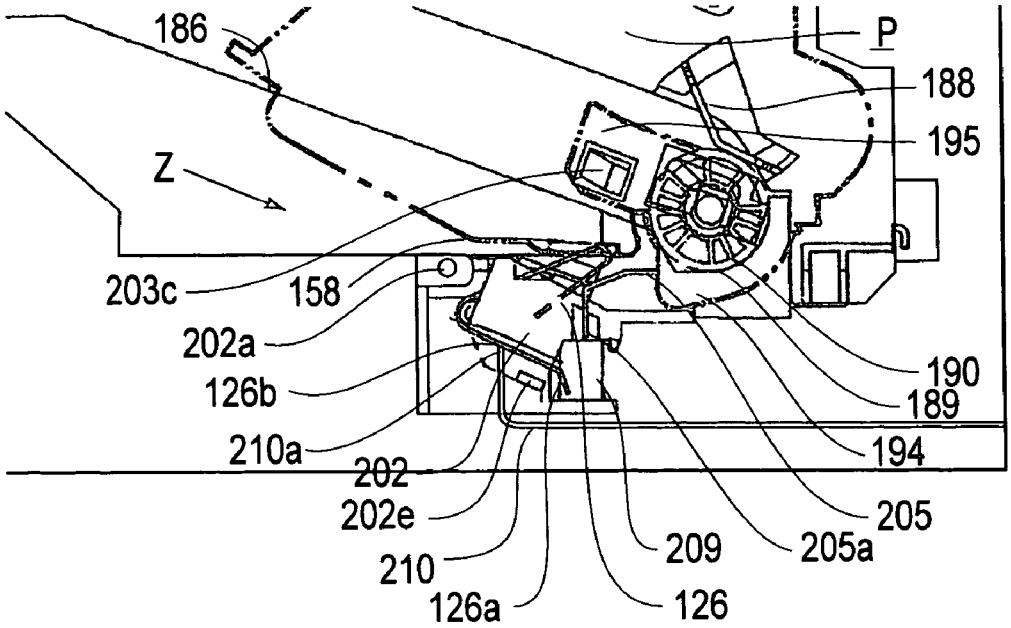
FIG. 44 is a schematic drawing of the electrical contact protection mechanism, showing the movements thereof during another step of the cartridge insertion sequence in the fifth embodiment of the present invention (No. 2).
Figure 44:
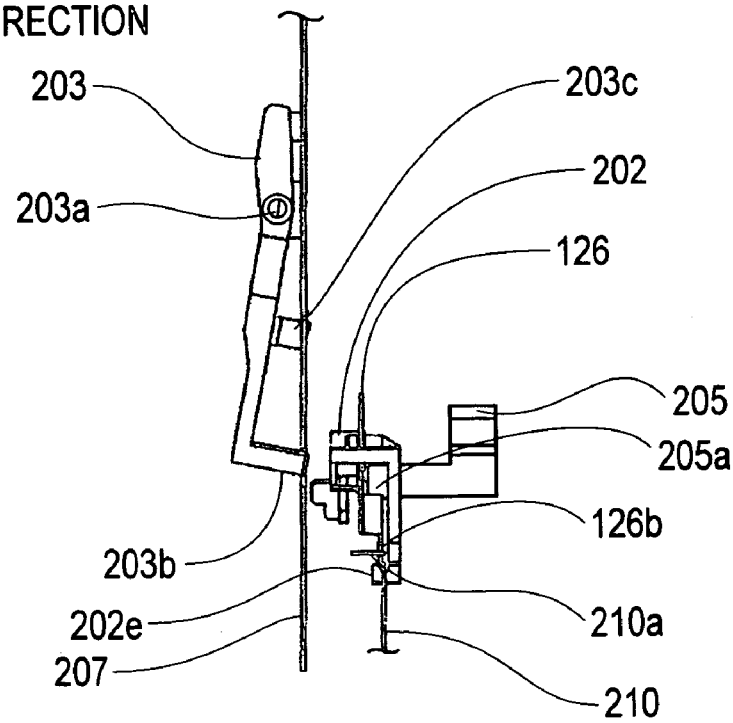

Next, the structure and movements of the electrical contact protection mechanism in this embodiment will be described in detail. FIGS. 43 and 44 are schematic drawings depicting the movements of the electrical contact protection mechanism, which occur as the cartridge P is inserted (advanced) into the apparatus main assembly E.

FIGS. 43(*a*) and 44(*a*) are drawings of the electrical contact protection mechanism, and the components related thereto, as seen from the side where the guiding members 181 and 182 of the apparatus main assembly E are present, toward the internal plate 207 (as seen from direction indicated by arrow mark Y in FIG. 40). FIGS. 43(*b*) and 44(*b*) are drawings of the same portions as those shown in FIG. 43(*a*) and 44(*a*), as seen from the direction indicated by an arrow mark Z. In FIGS. 43(*a*) and 44(*a*), the cartridge P is outlined in the broken line for ease of understanding. Further, for the purpose of showing the development bias transmission electrical contact 126, a part of the movable member 202 and a part of the coil portion of the electrical contact 126, are not shown. The development bias transmission electrical contact 126 is supported by a shaft 208, being thereby rendered rotatable. A connective contact spring 210 is connected to the electrical portion 4 (unshown).

FIGS. 43(*a*) and 43(*b*) show the states of the electrical contact protection mechanism and its adjacencies, during or prior to the mounting of the cartridge P into the apparatus main assembly E. The movable member 202 is in the position in which it is prior to the cartridge insertion, and the retaining member 203 is in the retaining position in which it retains the movable member 202. The grounding portion 126*a* and connective portion 126*b* of the electrical contact 126 are hooked to the hook portion 202*e* of the movable member 202. The movable member 202 is kept pressured in the direction indicated by an arrow mark b by the elastic member 209. Therefore, the grounding portion 126*a* of the electrical contact 126 is pressed upon the portion 205*a* of the conveyance guide (bottom) 205, grounding thereby the electrical contact 126. As described above, the retaining member 203 is kept pressured in the arrow a direction by an elastic member (unshown). Thus, the engaging portion 203*c* of the retaining member 203 is projecting into the cartridge compartment through the hole of the internal plate 207 as shown in FIG. 42, having slipped into the underside of the movable member 202, preventing thereby the movable member 202 and conductive member 204 from rotating.

With the employment of the above described structural arrangement, if the hand of a user, which has accumulated static electricity prior to the insertion of the cartridge P, is placed in the adjacencies of the electrical contact 126, and the static electricity discharges from the hand, the static electricity of the hand is discharged to the ground, and therefore, it does not discharge to the electrical portion 4.

FIGS. 44(*a*) and 44(*b*) show the states of the electrical contact protection mechanism, in which the cartridge P has been inserted into the image forming position. The movements of the movable member 202 and retaining member 203, which occur up to this point during the insertion of the cartridge P, are the same as those which occur during the insertion of the cartridge P in the fourth embodiment, and therefore, will not be described. In this state, the guiding portion 190 is engaged with the positioning portion 189 of the guiding portion of the apparatus main assembly E, being precisely positioned relative to the apparatus main assembly E. As for the top portion of the guiding portion 190, it is in contact with a retainer spring 188, being thereby pressured downward by the spring 188. The retaining member 203 is held by the retaining portion 195 (FIG. 38) of the cartridge P, by its engaging portion 203*c*. Further, the grounding portion 126*a* and connective portion 126*b* of the electrical contact 126, are separated, in terms of electrical connection, from the hook portion 202*e* of the movable member 202. As the cartridge P is inserted into this position, the grounding portion 126*a* of the electrical contact 126 is separated from the portion 205*a* of the conveyance guide (bottom) 205, eliminating the connection to the ground. Further, the connective portion 126*b* of the electrical contact 126 comes into contact with the connective portion 210*a* of the connective contact spring 210. Also as the cartridge P is moved into this position, the development bias transmission electrical contact 126 comes into contact with the electrical contact 158 of the cartridge P, and the connective portion 126*b* of the electrical contact 126 comes into contact with the connective portion 210*a* of the connective contact spring 210, establishing electrical connection between the apparatus main assembly E and cartridge P. The image forming operation is carried when the cartridge P is in this state. When the development bias transmission electrical contact 126 becomes electrically connected to the electrical contact 158 of the cartridge P, high voltage with a voltage level of several thousands is applied. However, the grounding portion 126*a* of the electrical contact 126 is definitely not in contact with the portion 205*a* (grounded) of the conveyance guide (bottom) 205. Thus, this embodiment yields the following effects.

1) If a user inserts his hand into the adjacencies of the electrical contact 126 in the main assembly of the image forming apparatus in order to deal with a paper jam or the like problem, and the hand happens to have accumulated static electricity, static noises are applied to the electrical contact 126 of the apparatus main assembly E. However, when the process cartridge is not in the main assembly of the image forming apparatus, the electrical contact 126 is grounded. Therefore, the static noises are not applied to the electrical circuit. Therefore, the electrical circuit is not affected by the static noises.

2) As the process cartridge is mounted into the apparatus main assembly E, the electrical contact 126 is connected to the connective contact spring 210, being thereby connected to the electrical portion 4 of the apparatus main assembly E. Further, the electrical contact 126 is disconnected from the ground, being ensured that it is electrically separated from the grounded components. Therefore, the process cartridge and image forming apparatus in this embodiment are superior to a process cartridge and an image forming apparatus in accordance with the prior art, in terms of the reliability of the connection between the electrical contact of the apparatus main assembly and the electrical contact of the process cartridge, and also, in the supplying of electrical power from the electrical contact of the apparatus main assembly to the electrical contact of the process cartridge.

3) The electrical connection is automatically switched by the movement of the process cartridge, which occurs as the process cartridge is mounted or dismounted. Therefore, it is unnecessary for a user to carry out an operation dedicated to the switching of the electrical connection.

Embodiment 6

Next, the sixth embodiment of the present invention will be described. The components in the sixth embodiment similar in structure to those in the fourth embodiment will be given referential symbols identical to those given for the description of the fourth embodiment, and will not be described. In other words, this embodiment will be described only regarding its features that characterize this embodiment.

(Description of Structure and Movements of Electrical Contact Protection Mechanism)

Figure 45:
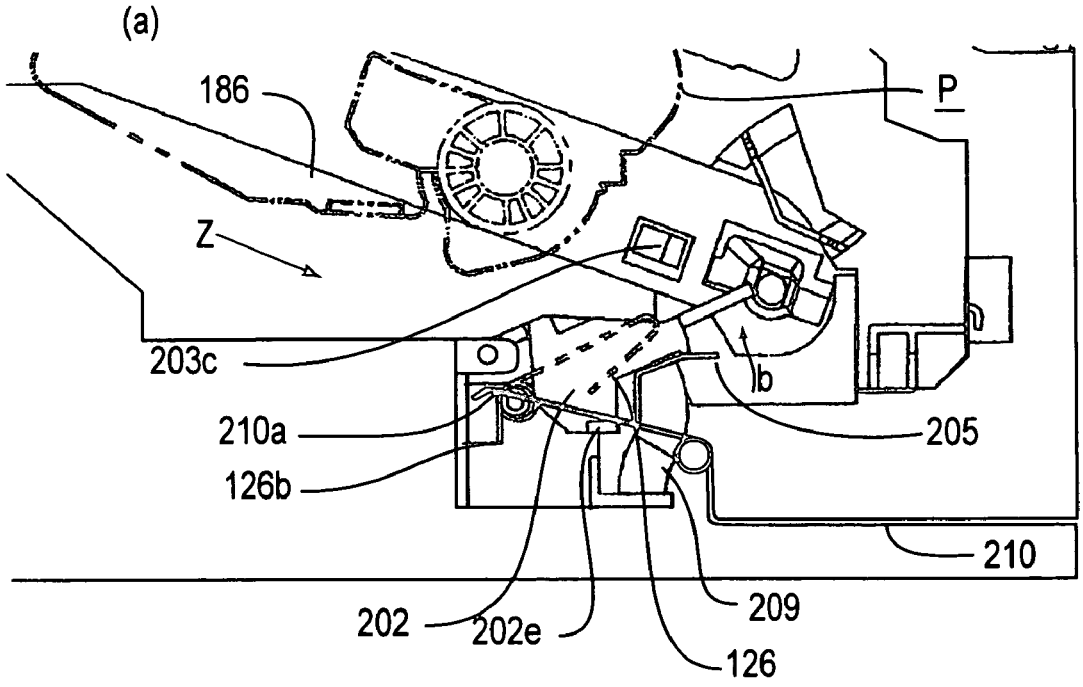
FIG. 45 is a schematic drawing of the electrical contact protection mechanism, showing the movements thereof during another step of the cartridge insertion sequence in the sixth embodiment of the present invention (No. 1).
Figure 45:
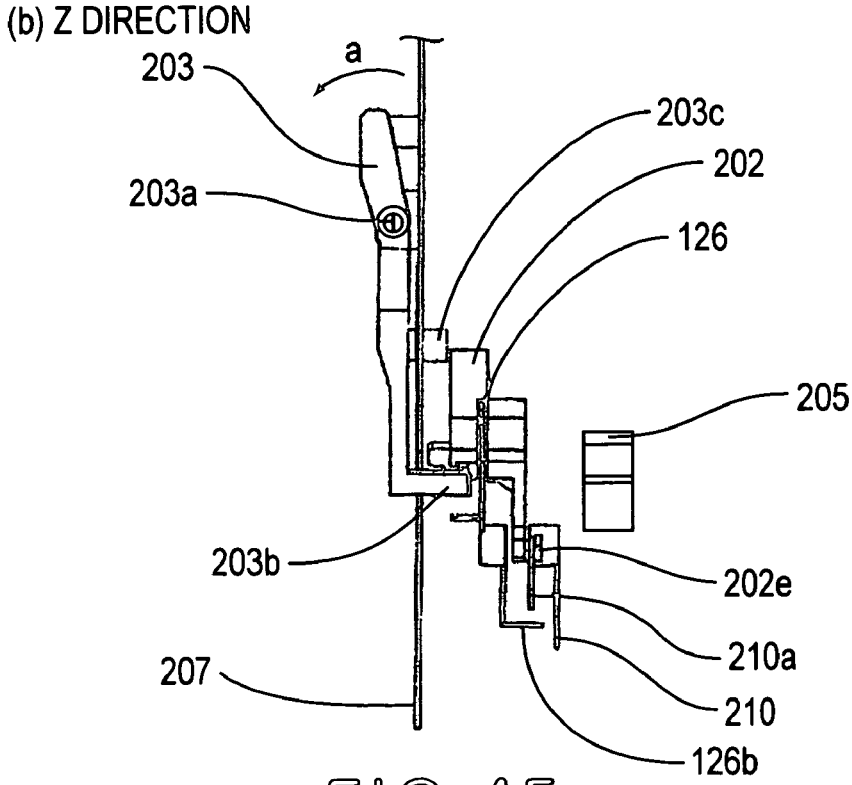
Figure 46:
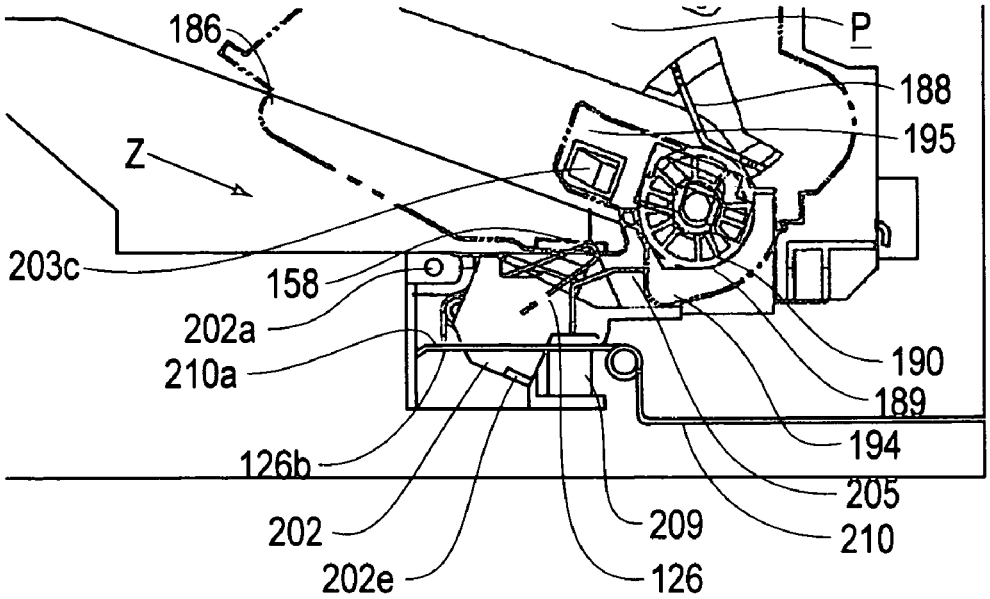
FIG. 46 is a schematic drawing of the electrical contact protection mechanism, showing the movements thereof during another step of the cartridge insertion sequence in the sixth embodiment of the present invention (No. 2).
Figure 46:
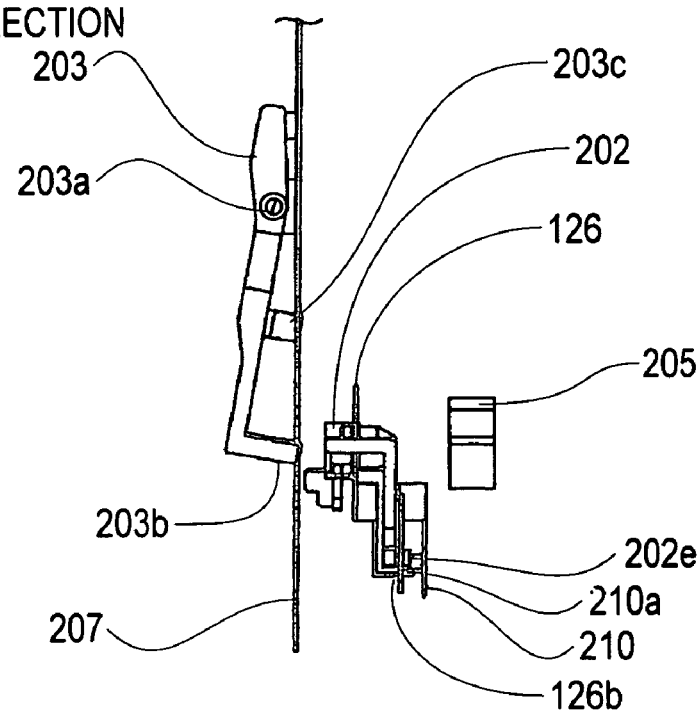

Next, the structure and movements of the electrical contact protection mechanism in this embodiment will be described in detail. FIGS. 45 and 46 are schematic drawings depicting the movements of the electrical contact protection mechanism, which occur as the cartridge P is inserted (advanced) into the apparatus main assembly E.

FIGS. 45(*a*) and 46(*a*) are drawings of the electrical contact protection mechanism, and the components related to, as seen from the side where the guiding members 181 and 182 of the apparatus main assembly E are present, toward the internal plate 207 (as seen from direction indicated by arrow mark Y in FIG. 40). FIGS. 45(*b*) and 46(*b*) are drawings of the same portions as those shown in FIG. 45(*a*) and 46(*a*), as seen from the direction indicated by an arrow mark Z. In FIGS. 45(*a*) and 46(*a*), the cartridge P is outlined in the broken line for ease of understanding. The development bias transmission electrical contact 126 is supported by a shaft 208, being thereby rendered rotatable. A connective contact spring 210 is connected to the electrical portion 4 (unshown).

FIGS. 45(*a*) and 45(*b*) show the states of the electrical contact protection mechanism and its adjacencies, during or prior to the mounting of the cartridge P into the apparatus main assembly E. The movable member 202 is in the position in which it is prior to the cartridge insertion, and the retaining member 203 is in the retaining position in which it retains the movable member 202. The connective portion 210*a* of the connective contact spring 210 is hooked to the hook portion 202*e* of the movable member 202. The movable member 202 is kept pressured in the direction indicated by an arrow mark b by the elastic member 209. Therefore, the connective portion 210*a* of the connective contact spring 210 is kept separated from the connective portion 126*b* of the electrical contact 126, keeping the electrical contact 126 floating in terms of electrical connection. As described above, the retaining member 203 is kept pressured in the arrow a direction by an elastic member (unshown). Thus, the engaging portion 203*c* of the retaining member 203 is projecting into the cartridge compartment through the hole of the internal plate 207 as shown in FIG. 42, having slipped into the underside of the movable member 202, preventing thereby the movable member 202 and conductive member 204 from rotating.

With the employment of the above described structural arrangement, when the cartridge P is not in the apparatus main assembly E, the electrical contact 126 is afloat in terms of electrical connection. Therefore, even if the hand of a user, which has accumulated static electricity prior to the insertion of the cartridge P, is placed in the adjacencies of the electrical contact 126, the static electricity of the hand is not discharged to the electrical contact 126, and therefore, it is not applied to the electrical portion 4.

FIGS. 46(*a*) and 46(*b*) show the states of the electrical contact protection mechanism, in which the cartridge P has been inserted into the image forming position. The movements of the movable member 202 and retaining member 203, which occur up to this point during the insertion of the cartridge P, are the same as those which occur during the insertion of the cartridge P in the fourth embodiment, and therefore, will not be described. In this state, the guiding portion 190 is engaged with the positioning portion 189 of the guiding portion of the apparatus main assembly E, being precisely positioned relative to the apparatus main assembly E. As for the top portion of the guiding portion 190, it has come into contact with a retainer spring 188, being thereby pressured downward by the spring 188. The retaining member 203 is held by the retaining portion 195 (FIG. 38) of the cartridge P, by its engaging portion 203*c*. Further, the connective portion 210*a* of the connective contact spring 210 has been separated from the hook portion 202*e* of the movable member 202. As this separation has occurred, the connective portion 126*b* of the electrical contact 126 has come into contact with the connective portion 210*a* of the connective contact spring 210. As the cartridge P is inserted into this position, the connective portion 126*b* of the electrical contact 126 comes into contact with the connective portion 210*a* of the connective contact spring 210. Also as the cartridge P is moved into this position, the development bias transmission electrical contact 126 comes into contact with the electrical contact 158 of the cartridge P, and the connective portion 126*b* of the electrical contact 126 comes into contact with the connective portion 210*a* of the connective contact spring 210, establishing electrical connection between the apparatus main assembly E and cartridge P. The image forming operation is carried out when the cartridge P is in this state. When the development bias transmission electrical contact 126 becomes electrically connected to the electrical contact 158 of the cartridge P, high voltage with a voltage level of several thousands is applied. At the moment of this application of high voltage, however, there is no grounded component in the adjacencies of the electrical contact 126.

Thus, this embodiment yields the following effects.

1) When the process cartridge is not in the main assembly of the image forming apparatus, the electrical contact 126 is afloat in terms of electrical connection. Therefore, even if a user inserts his hand into the adjacencies of the electrical contact 126 in the main assembly of the image forming apparatus in order to deal with a paper jam or the like problem, and the hand happens to have accumulated static-electricity, static noises are not applied to the electrical contact 126 of the apparatus main assembly E. Therefore, the static noises are not applied to the electrical circuit. Therefore, the elements of the electrical circuit are not affected by the static noises.

2) As the process cartridge is mounted into the apparatus main assembly E, the electrical contact 126 is connected to the connective contact spring 210, being thereby connected to the electrical portion 4 of the apparatus main assembly E. Therefore, the process cartridge and image forming apparatus in this embodiment are superior to a process cartridge and an image forming apparatus in accordance with the prior art, in terms of the reliability of the connection between the electrical contact of the apparatus main assembly and the electrical contact of the process cartridge, and also, in the supplying of electrical power.

3) The electrical connection is switched by the movement of the process cartridge, which occurs as the process cartridge is mounted or dismounted. Therefore, it is unnecessary for a user to carry out an operation dedicated to the switching of the electrical connection.

In the above, the first to sixth embodiments were described with reference to the electrical contacts for development bias. Obviously, however, the present invention is also applicable to the electrical contacts of a process cartridge and the main assembly of an image forming apparatus other than the development bias contacts, for example, the electrical contacts for charge bias, electrical contacts for a memory (storage element), and the like.

Further, the preceding embodiments were described with reference to the laser beam printer as an example of an electrophotographic image forming apparatus. It is obvious, however, that the above described structural arrangement in accordance with the present invention is also compatible with an image forming apparatus, other than the laser beam printer, which forms an image on recording medium, such as recording paper, OHP sheet, fabric, etc., with the use of one of the electrophotographic image forming methods, for example, an electrophotographic copying machine, an electrophotographic printer (for example, LED printer, laser beam printer, etc.), an electrophotographic facsimileing machine, an electrophotographic wordprocessor, etc.

According to the above described present invention, it is possible to improve a process cartridge and an electrophotographic image forming apparatus in terms of the reliability in the electrical connection which occurs between the electrical contacts of the process cartridge and the electrical contacts of the main assembly of the electrophotographic image forming apparatus as the process cartridge is mounted into the main assembly of the electrophotographic image forming apparatus.

Also according to the present invention, even if the hand of a user happens to have accumulated static electricity when the user places his hand in the adjacencies of the electrical contacts in the main assembly of an electrophotographic image forming apparatus, the static electricity discharges to the electrical conductive member. Therefore, the electrical contacts of the main assembly are not affected by the static electricity. Further, when the process cartridge is in the main assembly, the conductive member is not grounded. Therefore, the process cartridge and main assembly are superior to those in accordance with the prior art in terms of the reliability of the electrical connection between the electrical contacts of the main assembly and the electrical contacts of the process cartridge for supplying the process cartridge with electrical power from the apparatus main assembly. Further, the conductive member is moved by the movement of the process cartridge, which occurs as the process cartridge is mounted or dismounted. Therefore, it is unnecessary for a user to perform an operation dedicated to the movement of the conductive member.

Further, only as the process cartridge is mounted into the apparatus main assembly, do the electrical contacts of the apparatus main assembly become ready to be connected for supplying electrical power, improving thereby the image forming apparatus in terms of the reliability in electrical connection between the process cartridge and main assembly. Further, the electrical connection is switched by the movement of the process cartridge, which occurs as the process cartridge is mounted or dismounted. Therefore, it is unnecessary for a user to carry out an operation dedicated to the switching of the electrical connection.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 105245/2004 filed Mar. 31, 2004, which is hereby incorporated by reference.

What is claimed is:

1. A process cartridge detachably mountable to a main assembly of an electrophotographic image forming apparatus, wherein the main assembly includes a main assembly electrical contact, a movable member movable between a protecting position for covering the main assembly electrical contact and an exposing position for exposing the main assembly electrical contact, and a locking member movable between a locking position for limiting an operation of the movable member and a releasing position for permitting the operation of the movable member, said process cartridge comprising:

an electrophotographic photosensitive drum;

process means actable on said electrophotographic photosensitive drum;

a first engaging portion configured and positioned to move the locking member from the locking position to the releasing position in midstream of mounting said process cartridge to the main assembly of the apparatus;

a second engaging portion configured and positioned to move the movable member from the protecting position to the exposing position in midstream of mounting said process cartridge to the main assembly of the apparatus; and a cartridge contact configured and positioned to electrically connect with the main assembly electrical contact when said process cartridge is mounted to the main assembly of the apparatus.

2. A process cartridge according to claim 1, further comprising a first holding portion configured and positioned to hold the locking member at the releasing position when said process cartridge is mounted to the main assembly of the apparatus, and a second holding portion configured and positioned to hold the movable member at the exposing position when said process cartridge is mounted to the main assembly of the apparatus.

3. A process cartridge according to claim 1, wherein said first engaging portion is provided in a cartridge guide portion guidable by a mounting member provided in the main assembly of the apparatus, when said process cartridge is mounted to the main assembly of the apparatus.

4. A process cartridge according to claim 2, wherein said first holding portion is disposed at an end portion of said process cartridge with respect to a longitudinal direction of said process cartridge.

5. A process cartridge according to claim 2, wherein said first holding portion extends from a cartridge guide portion upstream with respect to a mounting direction in which said process cartridge is mounted to the main assembly of the apparatus.

6. A process cartridge according to claim 2, wherein said second holding portion projects from a bottom portion of said process cartridge when said process cartridge is mounted to the main assembly of the apparatus.

7. An electrophotographic image forming apparatus for forming an image on a recording material, to which a process cartridge is detachably mountable, said apparatus comprising:

(a) a main assembly electrical contact;

(b) a movable member movable between a protecting position for covering the main assembly electrical contact and an exposing position for exposing the main assembly electrical contact;

(c) a locking member movable between a locking position for limiting an operation of said movable member and a releasing position for permitting the operation of said movable member;

(d) a mounting member configured and positioned to detachably mount said process cartridge, said process cartridge including an electrophotographic photosensitive drum, process means actable on the electrophotographic photosensitive drum, a first engaging portion configured and positioned to move said locking member from the locking position to the releasing position in midstream of mounting the process cartridge to the main assembly of said apparatus, a second engaging portion configured and positioned to move said movable member from the protecting position to the exposing position in midstream of mounting the process cartridge to the main assembly of said apparatus, and a cartridge contact configured and positioned to electrically connect with said main assembly electrical contact when the process cartridge is mounted to the main assembly of said apparatus; and (e) feeding means configured and positioned to feed the recording material.

8. An apparatus according to claim 7, further comprising a first elastic member configured and positioned to urge said locking member toward the locking position, and a second elastic member configured and positioned to urge said movable member toward the protecting position, wherein when the process cartridge is mounted to the main assembly of said apparatus, said locking member is held at the releasing position against an elastic force of said first elastic member by a first holding portion provided in the process cartridge, and said movable member is held at the exposing position against an elastic force of said second elastic member by a second holding portion provided in the process cartridge.

9. An apparatus according to claim 7, wherein said movable member has an electroconductive member configured and positioned for electrical grounding at the protecting position.

10. An apparatus according to claim 7, wherein said movable member has a center line of rotation which is parallel with an axis of the electrophotographic photosensitive drum, and is rotatable relative to said main assembly of said apparatus during movement thereof.

11. An apparatus according to claim 7, wherein said main assembly electrical contact has a center line of rotation which is parallel with an axis of the electrophotographic photosensitive drum, and is rotatable relative to said main assembly of said apparatus during movement thereof.

12. A process cartridge detachably mountable to a main assembly of an electrophotographic image forming apparatus, wherein the main assembly includes a main assembly electrical contact, an electroconductive member movable between a protecting position for electrically connecting with a ground and an exposing position for electrically disconnecting with the ground, and a locking member movable between a locking position for limiting an operation of the electroconductive member and a releasing position for permitting the operation of the electroconductive member, said process cartridge comprising:

an electrophotographic photosensitive drum;

process means actable on said electrophotographic photosensitive drum;

a first engaging portion configured and positioned to move the locking member from the locking position to the releasing position in midstream of mounting said process cartridge to the main assembly of the apparatus;

a second engaging portion configured and positioned to move the electroconductive member from the protecting position to the exposing position in midstream of mounting said process cartridge to the main assembly of the apparatus; and a cartridge contact configured and positioned to electrically connect with the main assembly electrical contact when said process cartridge is mounted to the main assembly of the apparatus.

13. A process cartridge according to claim 12, further comprising a first holding portion configured and positioned to hold the locking member at the releasing position when said process cartridge is mounted to the main assembly of the apparatus, and a second holding portion configured and positioned to hold the electroconductive member at the exposing position when said process cartridge is mounted to the main assembly of the apparatus.

14. A process cartridge according to claim 12, wherein said first engaging portion is provided in a cartridge guide portion guidable by a mounting member provided in the main assembly of the apparatus, when said process cartridge is mounted to the main assembly of the apparatus.

15. A process cartridge according to claim 13, wherein said first holding portion is disposed at an end portion of said process cartridge with respect to a longitudinal direction of said process cartridge.

16. A process cartridge according to claim 13, wherein said first holding portion extends from a cartridge guide portion upstream with respect to a mounting direction in which said process cartridge is mounted to the main assembly of the apparatus.

17. A process cartridge according to claim 13, wherein said second holding portion projects from a bottom portion of said process cartridge when said process cartridge is mounted to the main assembly of the apparatus.

18. An electrophotographic image forming apparatus for forming an image on a recording material, to which a process cartridge is detachably mountable, said apparatus comprising:

(a) a main assembly electrical contact;

(b) an electroconductive member movable between a protecting position for electrically connecting with a ground and a exposing position for electrically disconnecting with the ground, (c) a locking member movable between a locking position for limiting an operation of said movable member and a releasing position for permitting the operation of said movable member;

(d) a mounting member configured and positioned to detachably mount said process cartridge, said process cartridge including an electrophotographic photosensitive drum, process means actable on the electrophotographic photosensitive drum, a first engaging portion configured and positioned to move said locking member from the locking position to the releasing position in midstream of mounting the process cartridge to the main assembly of said apparatus, a second engaging portion configured and positioned to move said electroconductive member from the protecting position to the exposing position in midstream of mounting the process cartridge to the main assembly of said apparatus, and a cartridge contact configured and positioned to electrically connect with said main assembly electrical contact when the process cartridge is mounted to the main assembly of said apparatus; and (e) feeding means configured and positioned to feed the recording material.

19. An apparatus according to claim 18, further comprising a first elastic member configured and positioned to urge said locking member toward the locking position, and a second elastic member configured and positioned to urge said electroconductive member toward the protecting position, wherein when the process cartridge is mounted to the main assembly of said apparatus, said locking member is held at the releasing position against an elastic force of said first elastic member by a first holding portion provided in the process cartridge, and said electroconductive member is held at the exposing position against an elastic force of said second elastic member by a second holding portion provided in the process cartridge.

20. An apparatus according to claim 18, further comprising an opening for permitting mounting and demounting the process cartridge, wherein said electroconductive member is nearer to said opening than said main assembly electrical contact.

21. An apparatus according to claim 18, wherein said electroconductive member has a center line of rotation which is parallel with an axis of the electrophotographic photosensitive drum, and is rotatable relative to said main assembly of said apparatus during movement thereof.

22. An apparatus according to claim 18, wherein said main assembly electrical contact has a center line of rotation which is parallel with an axis of the electrophotographic photosensitive drum, and is rotatable relative to said main assembly of said apparatus during movement thereof.

* * * * *

UNITED STATES PATENT AND TRADEMARK OFFICE

CERTIFICATE OF CORRECTION

PATENT NO. : 7,242,885 B2
APPLICATION NO. : 11/091781
DATED : July 10, 2007
INVENTOR(S) : Daisuke Abe et al.

It is certified that error appears in the above-identified patent and that said Letters Patent is hereby corrected as shown below:

COLUMN 1:
Line 8, “apparatus” should read --apparatus.--.

COLUMN 4:
Line 56, “(a)(a)” should read --(a)--.

COLUMN 6:
Line 20, “drawing” should read --drawing depicting--.

COLUMN 10:
Line 12, “13OR1a” should read --130R1a--.

COLUMN 11:
Line 49, “retains” should read --retain--.

COLUMN 14:
Line 33, “13011” should read --130L1--.
Line 60, “1621” should read --162--.

COLUMN 16:
Line 12, “compart” should read --compartment--.

COLUMN 18:
Line 20, “to” should read --to be--.
Line 55, “from” should be deleted.

COLUMN 27:
Line 25, “FIGS. 29)b),” should read --FIGS. 29(b),--.

UNITED STATES PATENT AND TRADEMARK OFFICE

CERTIFICATE OF CORRECTION

PATENT NO. : 7,242,885 B2
APPLICATION NO. : 11/091781
DATED : July 10, 2007
INVENTOR(S) : Daisuke Abe et al.

It is certified that error appears in the above-identified patent and that said Letters Patent is hereby corrected as shown below:

COLUMN 37:

Line 23, “a” should read --an--.
Line 24, “ground,” should read --ground;--.

Signed and Sealed this

Twenty-fourth Day of February, 2009

JOHN DOLL
*Acting Director of the United States Patent and Trademark Office*